US008210102B2

(12) United States Patent
Hirata

(10) Patent No.: US 8,210,102 B2
(45) Date of Patent: Jul. 3, 2012

(54) SWITCH-OVER PROCESSING METHOD AND APPARATUS

(75) Inventor: Motoyasu Hirata, Tokyo (JP)

(73) Assignee: Komori Corporation, Tokyo (JP)

( * ) Notice: Subject to any disclaimer, the term of this patent is extended or adjusted under 35 U.S.C. 154(b) by 1186 days.

(21) Appl. No.: 12/011,357

(22) Filed: Jan. 25, 2008

(65) Prior Publication Data

US 2008/0178752 A1 Jul. 31, 2008

(30) Foreign Application Priority Data

Jan. 25, 2007 (JP) ..... 2007-015054
Aug. 2, 2007 (JP) ..... 2007-201667

(51) Int. Cl.
*B31F 1/07* (2006.01)
*B44C 1/24* (2006.01)
*B41F 19/02* (2006.01)

(52) U.S. Cl. ..... 101/32; 101/23; 162/362

(58) Field of Classification Search ..... 101/23, 101/32; 162/117, 362
See application file for complete search history.

(56) References Cited

U.S. PATENT DOCUMENTS

| | | | | |
|---|---|---|---|---|
| 4,094,243 | A * | 6/1978 | Braun | 101/349.1 |
| 4,309,945 | A * | 1/1982 | Marion | 101/247 |
| 4,848,265 | A | 7/1989 | Komori | |
| 5,186,103 | A * | 2/1993 | Gelinas et al. | 101/181 |
| 5,272,974 | A * | 12/1993 | Guarino et al. | 101/218 |
| 6,651,539 | B1 | 11/2003 | Eicher et al. | |
| 6,675,707 | B1 | 1/2004 | Heiler et al. | |

FOREIGN PATENT DOCUMENTS

| | | | |
|---|---|---|---|
| DE | 41 38 278 | A1 | 5/1993 |
| DE | 10 2005 025 741 | A1 | 1/2006 |
| EP | 0 842 774 | A2 | 5/1998 |
| EP | 1 285 755 | A1 | 2/2003 |
| JP | 59-142149 | A | 8/1984 |
| JP | 59-153228 | U | 10/1984 |
| JP | 03-205152 | A | 9/1991 |
| JP | 03-207653 | A | 9/1991 |
| JP | 05-147200 | A | 6/1993 |
| JP | 07-237812 | | 9/1995 |
| JP | 07-299897 | A | 11/1995 |
| JP | 10-138446 | | 5/1998 |
| JP | 2003-311690 | | 5/2003 |
| JP | 2006-250202 | A | 9/2006 |
| JP | 2006-305903 | A | 11/2006 |
| WO | WO 83/04004 | | 11/1983 |
| WO | WO 2006/077134 | A1 | 7/2006 |

* cited by examiner

*Primary Examiner* — Ren Yan
*Assistant Examiner* — Marissa Ferguson Samreth
(74) *Attorney, Agent, or Firm* — Blakely, Sokoloff, Taylor & Zafman

(57) ABSTRACT

A switch-over processing method includes the steps of performing a first process on a sheet passing between a first cylinder and a second cylinder with a first mounted body being mounted on a circumferential surface of the second cylinder arranged to oppose the first cylinder, and performing a second process different from the first process on the sheet passing between the first cylinder and the second cylinder with a second mounted body being mounted on a circumferential surface of the second cylinder in place of the first mounted body. A switch-over processing apparatus is also disclosed.

1 Claim, 66 Drawing Sheets

SWITCH-OVER PROCESSING METHOD AND APPARATUS

BACKGROUND OF THE INVENTION

The present invention relates to a switch-over processing method and apparatus for processing a sheet passing between two cylinders while switching among a plurality of processing operations.

Conventionally, when embossing a pattern portion of printed paper, after printing with a printing press, the paper is embossed with a dedicated embossing machine. Alternatively, a dedicated embossing unit is arranged after the printing unit of the printing press and embosses the paper. Such a conventional embossing method is described in reference 1 (Japanese Patent Laid-Open No. 2006-305903).

As the conventional embossing method employs a dedicated embossing machine or embossing unit, not only the space for the machine but also the cost increases.

SUMMARY OF THE INVENTION

The present invention has been made to solve these problems, and has as its object to provide a switch-over processing method and apparatus which can process a sheet such as printed paper while switching among a plurality of processing operations within a narrow space at a low cost.

In order to achieve the above object, according to an aspect of the present invention, there is provided a switch-over processing method comprising the steps of performing a first process on a sheet passing between a first cylinder and a second cylinder with a first mounted body being mounted on a circumferential surface of the second cylinder arranged to oppose the first cylinder, and performing a second process different from the first process on the sheet passing between the first cylinder and the second cylinder with a second mounted body being mounted on a circumferential surface of the second cylinder in place of the first mounted body.

According to another aspect of the present invention, there is also provided a switch-over processing apparatus comprising a first cylinder and a second cylinder which oppose each other, a plurality of mounted bodies which are individually mounted on a circumferential surface of the second cylinder and perform different processes on a sheet passing between the first cylinder and the second cylinder, and a control device which switches control for at least the first cylinder and the second cylinder to correspond to a mounted body mounted on the second cylinder.

DESCRIPTION OF THE PREFERRED EMBODIMENTS

The present invention will be described in detail with reference to the accompanying drawings. A case in which a coater also serves as an embossing apparatus will be explained in the first, second, and third embodiments, and a case in which a web offset printing press also serves as an embossing apparatus will be explained in the fourth, fifth, and sixth embodiments.

[First Embodiment]

An exemplary coater which also serves as an embossing apparatus will be described as the first embodiment of a switch-over processing apparatus of the present invention.

Figure 1A:
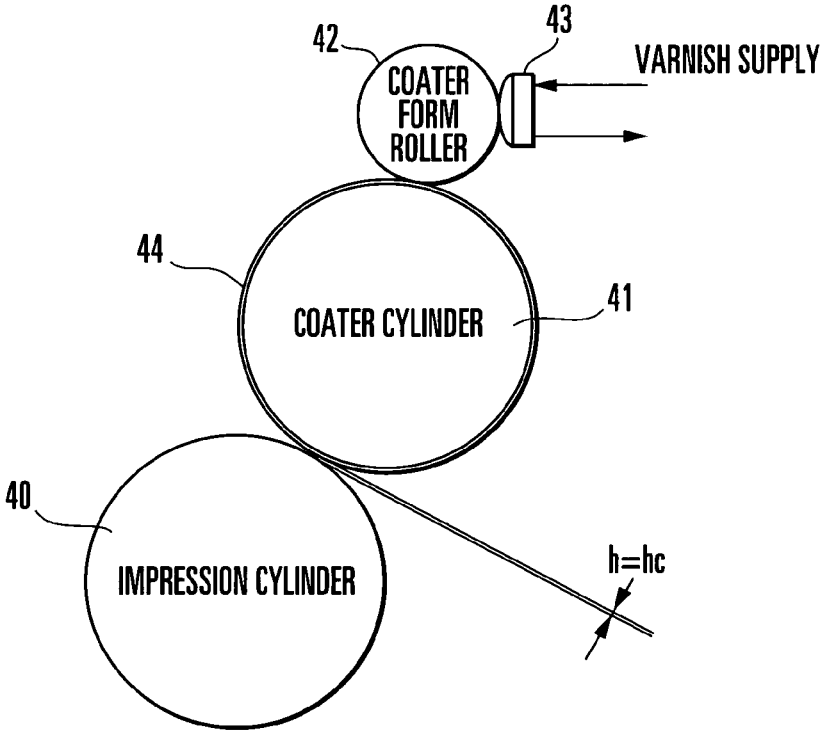
FIG. 1A is a view showing a state in which a coating plate is mounted on a coating cylinder in a coater as the first embodiment of a switch-over processing apparatus of the present invention which also serves as an embossing apparatus.

The coater according to this embodiment is arranged behind, e.g., the last printing unit of a web offset printing press, and comprises an impression cylinder 40, coater cylinder 41, coater form roller 42, chamber coater 43, and the like, as shown in FIG. 1A. The arrangement of the coater is described in, e.g., reference 2 (Japanese Patent Laid-Open No. 2006-250202). The coater cylinder 41 opposes the impression cylinder 40, the coater form roller 42 opposes the coater cylinder 41, and the chamber coater 43 is in contact with the coater form roller 42. A coating plate 44 is mounted on the coater cylinder 41 as a coating transfer body. When performing entire-surface coating, in place of the coating plate 44, a mere blanket may be used as the coating transfer body.

In this coater, when performing coating (to be described later), as shown in FIG. 1A, the coater cylinder 41 is set in an impression thrown-on state with respect to the impression cylinder 40, and a gap h between the coater cylinder 41 and impression cylinder 40 is set to a coating gap hc. The coater form roller 42 is in contact with the coater cylinder 41 to supply varnish to the chamber coater 43.

Figure 1B:
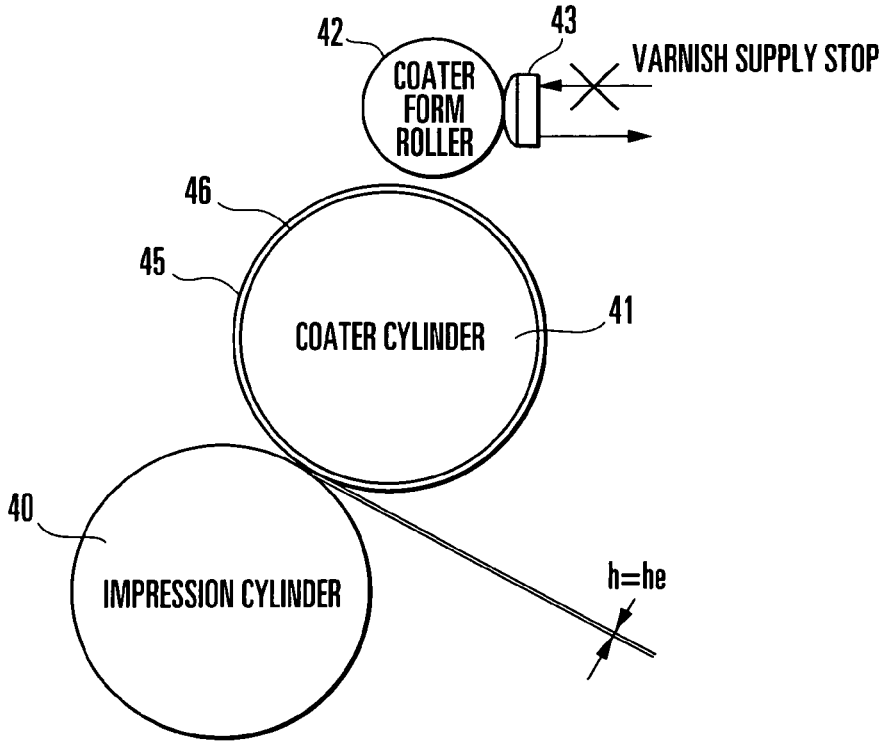
FIG. 1B is a view showing a state in which an embossing plate is mounted on the coating cylinder in the coater as the first embodiment.

When performing embossing (to be described later), as shown in FIG. 1B, the coater cylinder 41 is set in an impression through-on state with respect to the impression cylinder 40, and the gap h between the coater cylinder 41 and impression cylinder 40 is set to an embossing gap he. The coater form roller 42 is detached from the coater cylinder 41 to stop varnish supply to the chamber coater 43.

When performing embossing, the operator mounts an embossing plate 45 on the coater cylinder 41 in place of the coating plate 44. As the embossing plate 45 is thin, an embossing packing material 46 is interposed between the embossing plate 45 and coater cylinder 41.

Figure 2:
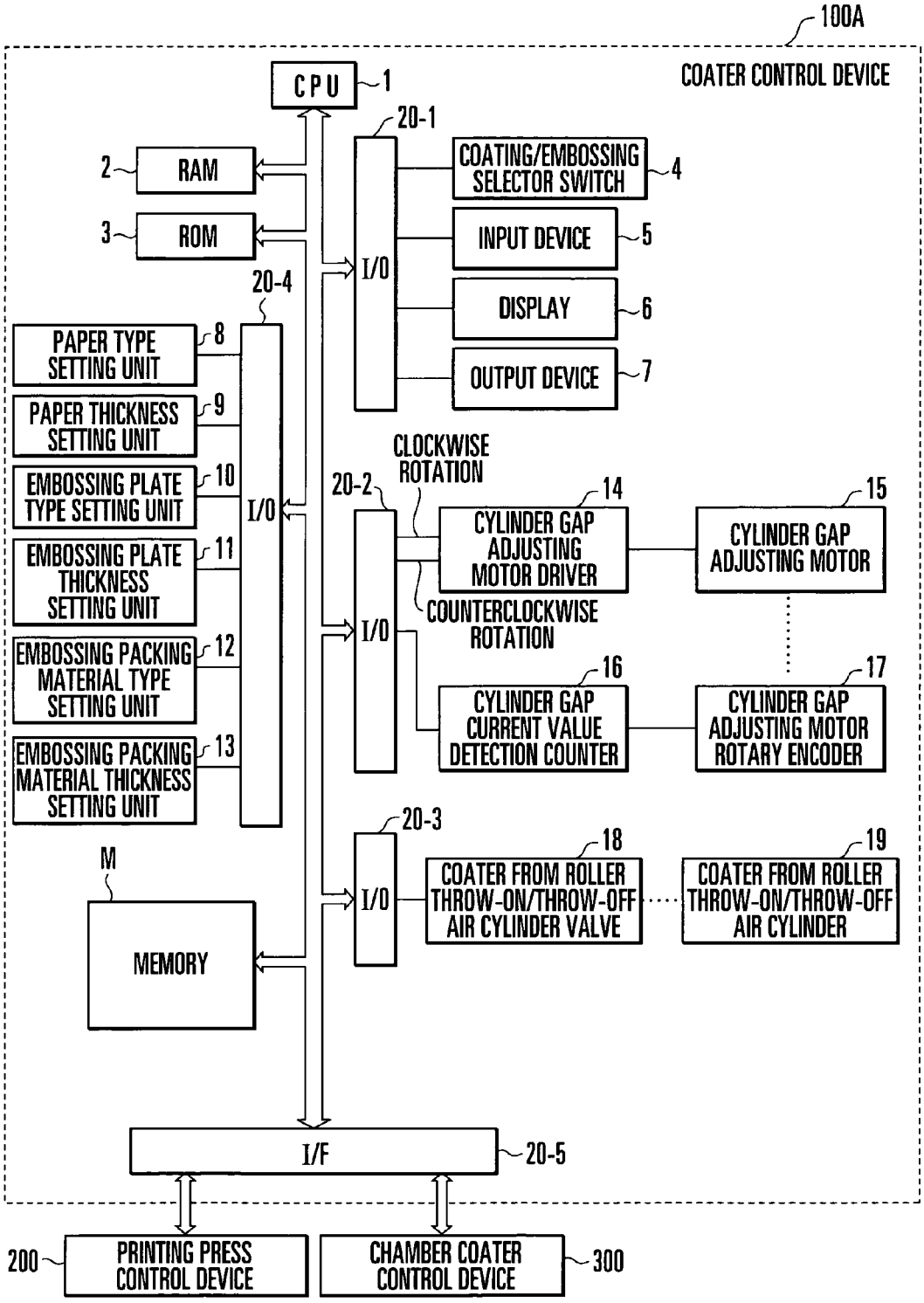
FIG. 2 is a block diagram showing the controller of the coater as the first embodiment.

As shown in FIG. 2, the coater of this embodiment is provided with a chamber coater control device 300 as a device that controls varnish supply to the chamber coater 43, and a coater control device 100A as a device that controls the operation of the coater as a whole. The coater control device 100A is connected to a printing press control device 200 as well as the chamber coater control device 300.

The coater control device 100A comprises a CPU 1, a RAM 2, a ROM 3, a coating/embossing selector switch 4, an input device 5, a display 6, an output device 7, a paper type setting unit 8, a paper thickness setting unit 9, an embossing plate type setting unit 10, an embossing plate thickness setting unit 11, an embossing packing material type setting unit 12, an embossing packing material thickness setting unit 13, a motor driver 14 for adjusting the gap between the coater cylinder and impression cylinder, a motor 15 for adjusting the gap between the coater cylinder and impression cylinder, a counter 16 for detecting the current value of the gap between the coater cylinder and impression cylinder, a rotary encoder 17 for the motor for adjusting the gap between the coater cylinder and impression cylinder, a coater form roller throw-on/throw-off air cylinder valve 18, a coater form roller throw-on/throw-off air cylinder 19, input/output interfaces 20-1 to 20-5, and a memory M. The output device 7 includes a FD driver, printer, and the like.

Figure 3:
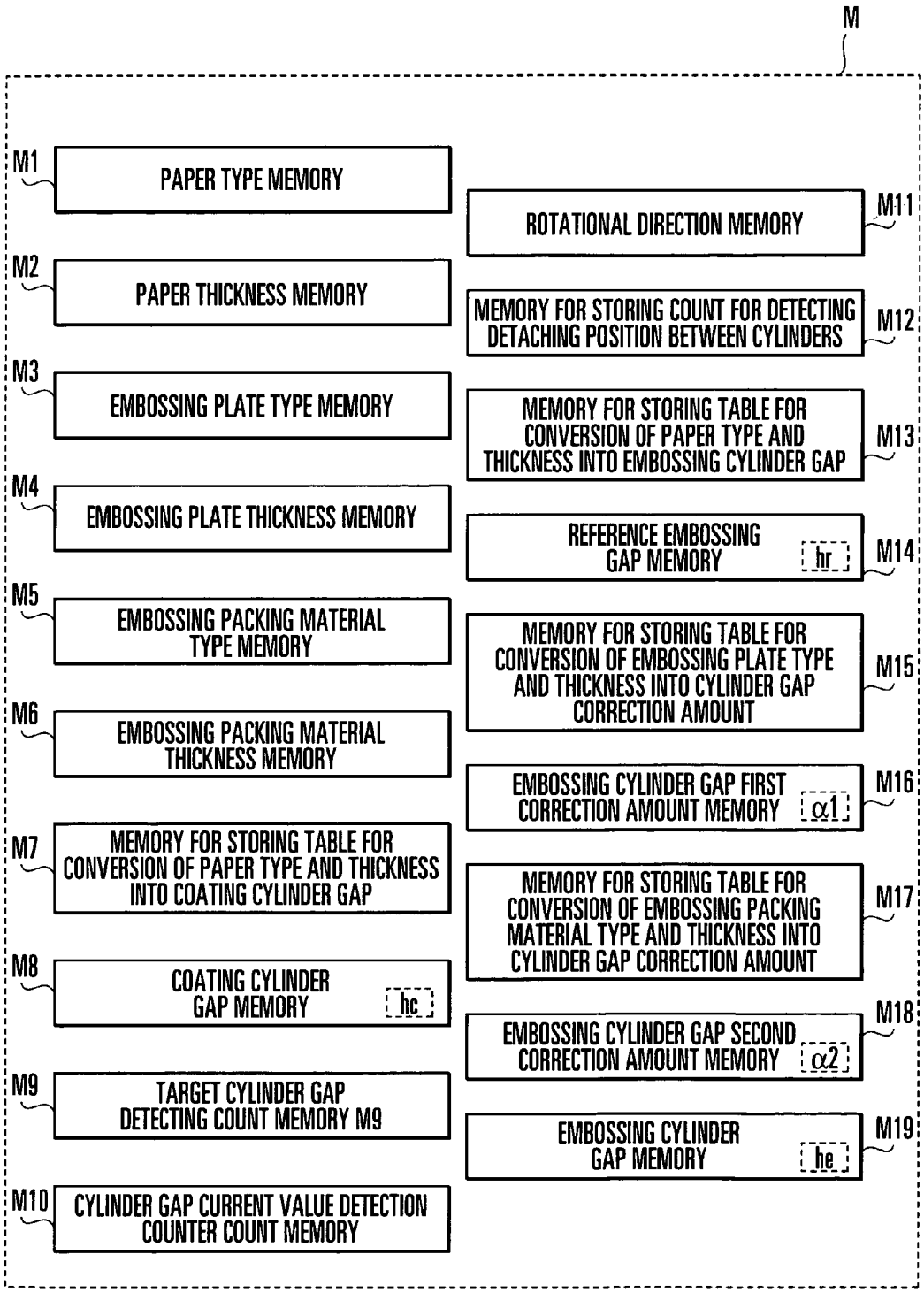
FIG. 3 is a block diagram showing the arrangement of a memory in a coater control device.

As shown in FIG. 3, the memory M comprises a paper type memory M1, a paper thickness memory M2, an embossing plate type memory M3, an embossing plate thickness memory M4, an embossing packing material type memory M5, an embossing packing material thickness memory M6, a memory M7 for storing a table for conversion of a paper type and thickness into a coating gap between the coater cylinder and impression cylinder, a memory M8 for storing a coating gap between the coater cylinder and impression cylinder, a target count memory M9 for detecting the gap between the coater cylinder and impression cylinder, a count memory M10 for a counter for detecting the current value of the gap between the coater cylinder and impression cylinder, a rotational direction memory M11, a count memory M12 for detecting a detaching position between the coater cylinder and impression cylinder, a memory M13 for storing a table for conversion of a paper type and thickness into an embossing gap between the coater cylinder and impression cylinder, a memory M14 for storing a reference embossing gap between the coater cylinder and impression cylinder, a memory M15 for storing a table for conversion of an embossing plate type and thickness into a correction amount of the gap between the coater cylinder and impression cylinder, a memory M16 for storing the first correction amount of the embossing gap between the coater cylinder and impression cylinder, a memory M17 for storing a table for conversion of an embossing packing material type and thickness into the correction amount of the gap between the coater cylinder and impression cylinder, a memory M18 for storing the second correction amount of the embossing gap between the coater cylinder and impression cylinder, and a memory M19 for storing an embossing gap between the coater cylinder and impression cylinder. The functions of the respective memories in the memory M will be described later.

Upon obtaining various types of input information through the input/output interfaces 20-1 to 20-5, the CPU 1 operates in accordance with a program stored in the ROM 3 while accessing the RAM 2 and memory M. The ROM 3 stores, as the program specific to this embodiment, a coating/embossing selector program which controls switching between coating and embossing. This program can be provided in the form of a computer-readable storage medium such as an optical disk or magnetic disk.

Processing operation performed by the CPU 1 of the coater control device 100A using the coating/embossing selector program will be described in accordance with the flowcharts divided into FIGS. 4A to 4H.

To make a coater also serve as an embossing apparatus, the operator inputs the type and thickness (paper thickness) of the paper to be subjected to coating and embossing, the type and thickness (plate thickness) of an embossing plate to be used, and the type and thickness (packing material thickness) of an embossing packing material to be used from the setting units 8 to 13.

When the paper type is input from the paper type setting unit 8 (YES in step S101, FIG. 4A), the CPU 1 stores it in the memory M1 (step S102). When the paper thickness is input from the setting unit 9 (YES in step S103), the CPU 1 stores it in the memory M2 (YES in step S104). When the embossing plate type is input from the setting unit 10 (YES in step S105), the CPU 1 stores it in the memory M3 (step S106). When the embossing plate thickness is input from the setting unit 11 (YES in step S107), the CPU 1 stores it in the memory M4 (step S108). When the embossing packing material type is input from the setting unit 12 (YES in step S109), the CPU 1 stores it in the memory M5 (step S110). When the embossing packing material thickness is input from the setting unit 13 (YES in step S111), the CPU 1 stores it in the memory M6 (step S112).

[Coating]

When performing coating, the operator mounts the coating plate 44 on the coater cylinder 41 (see FIG. 1A). The operator also switches the coating/embossing selector switch 4 to the coating side.

Figure 4A:
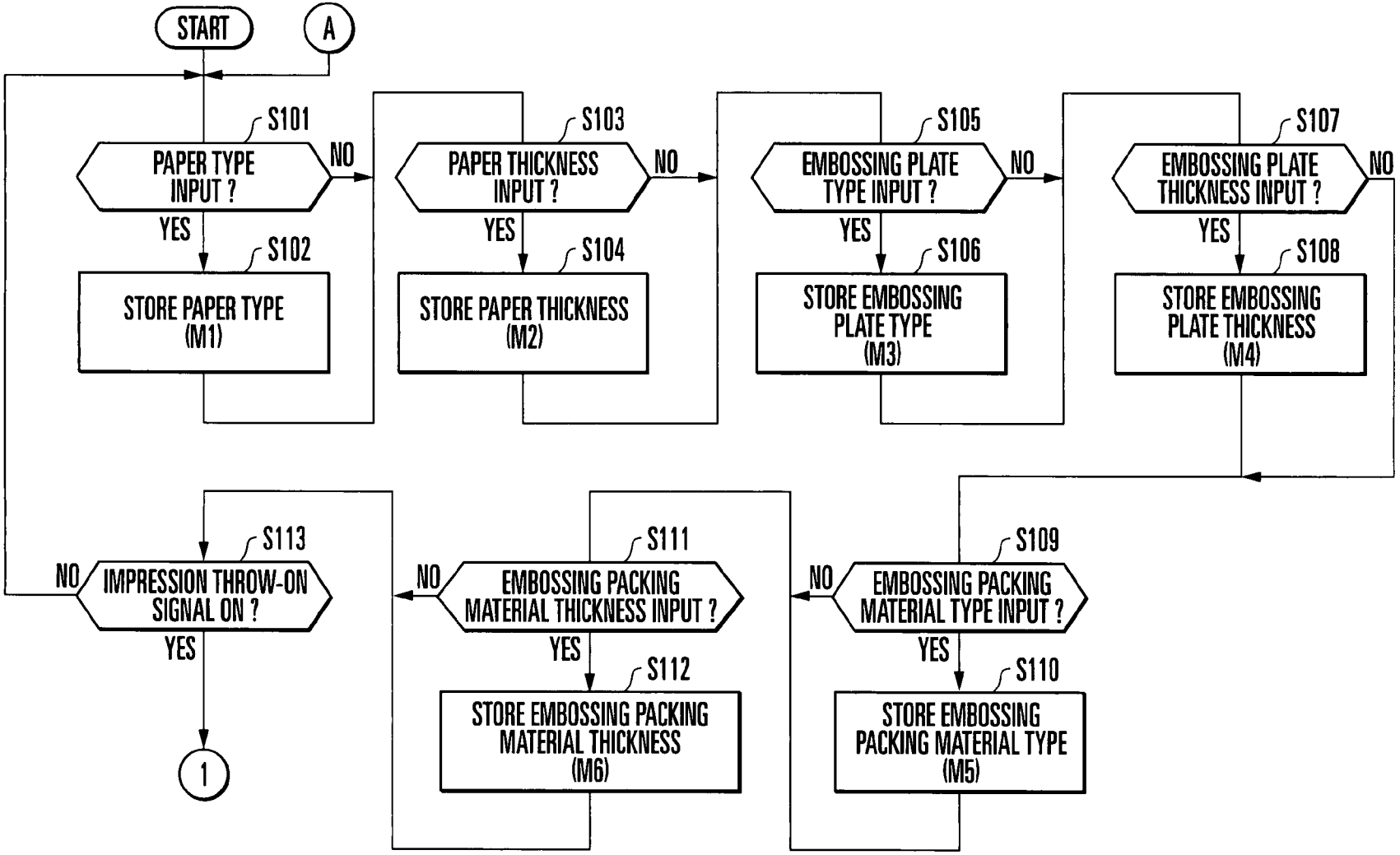
FIGS. 4A to 4H are flowcharts showing processing operation performed by the CPU of the coater control device.
Figure 4B:
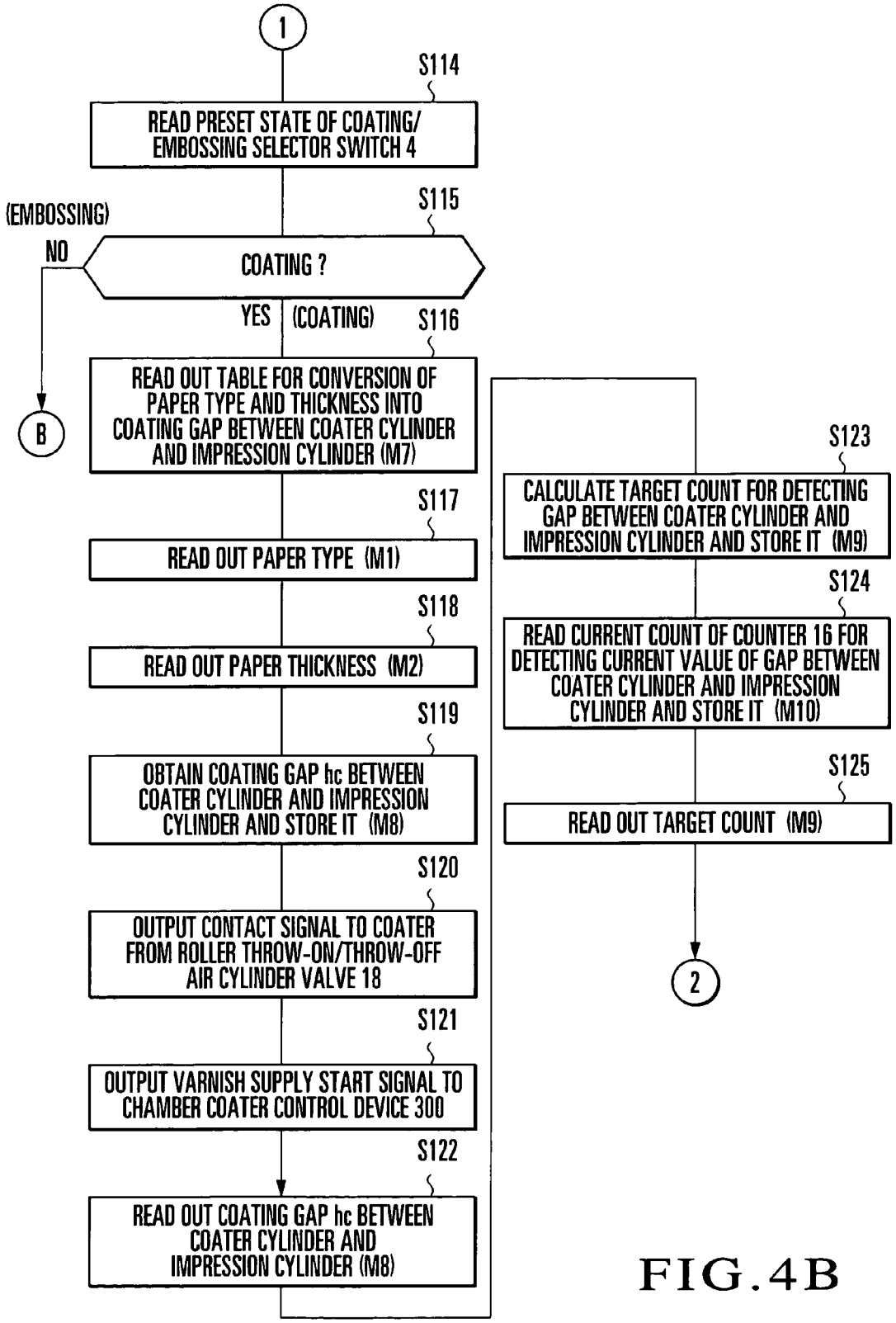
Figure 4C:
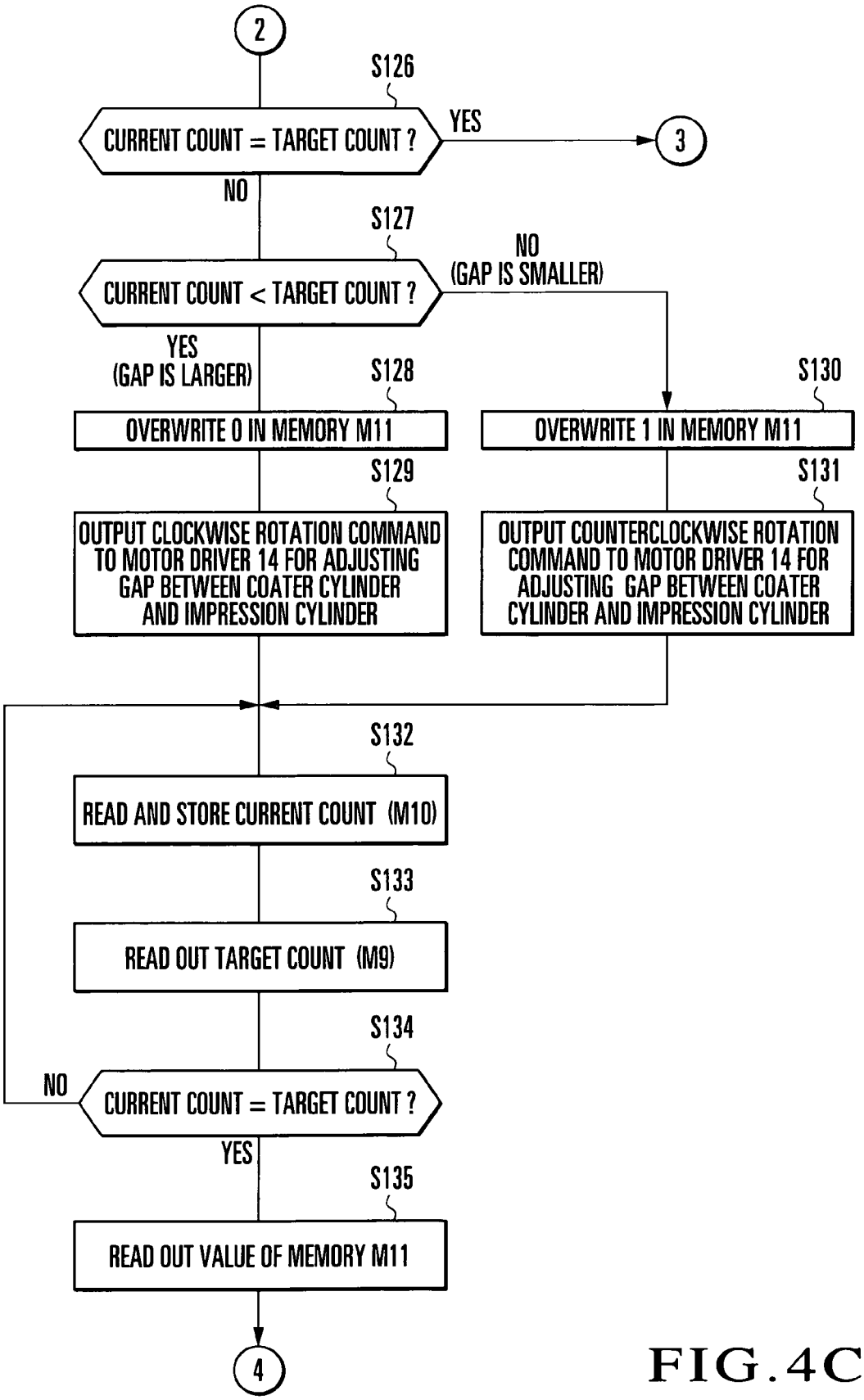
Figure 4D:
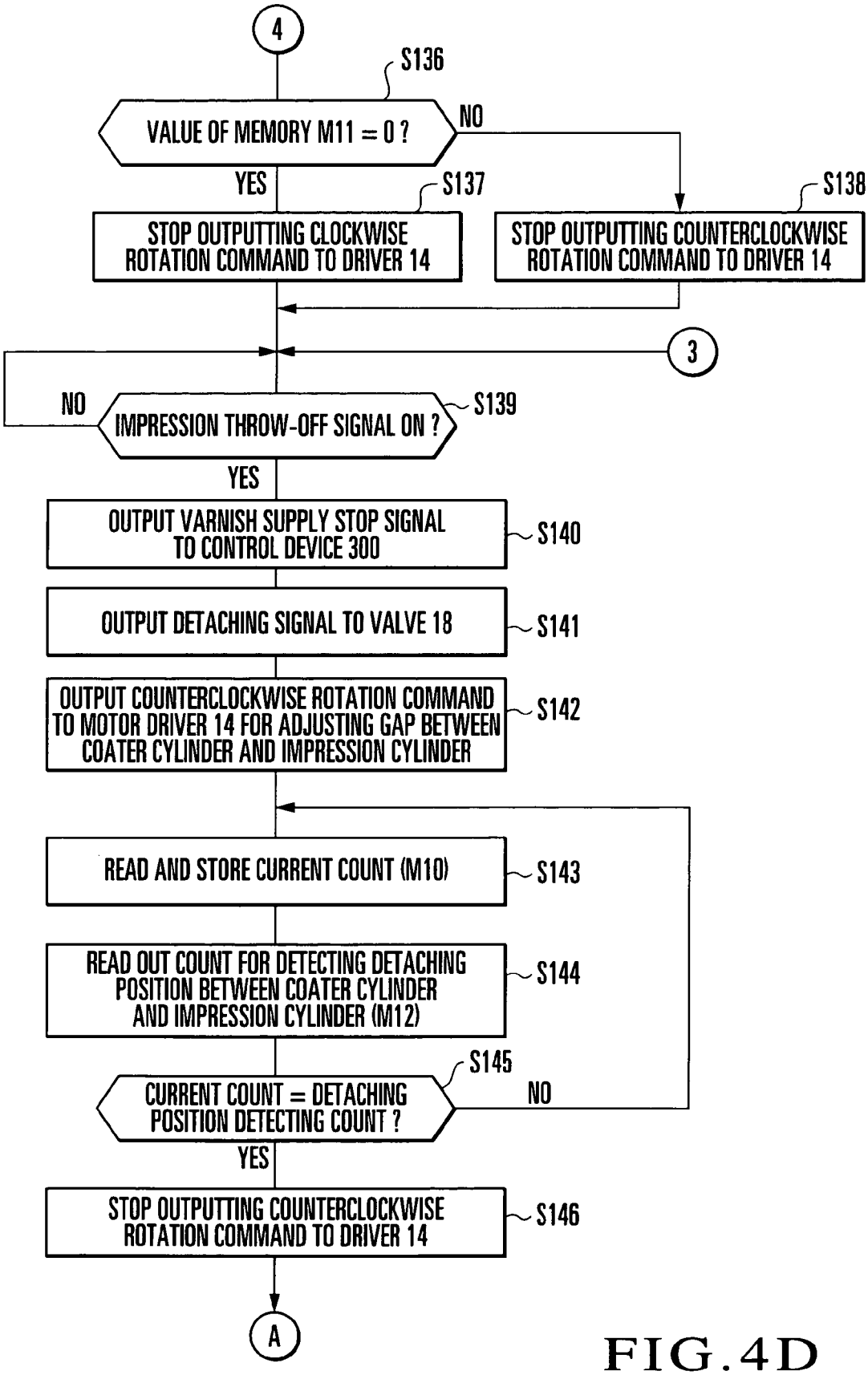
Figure 4E:
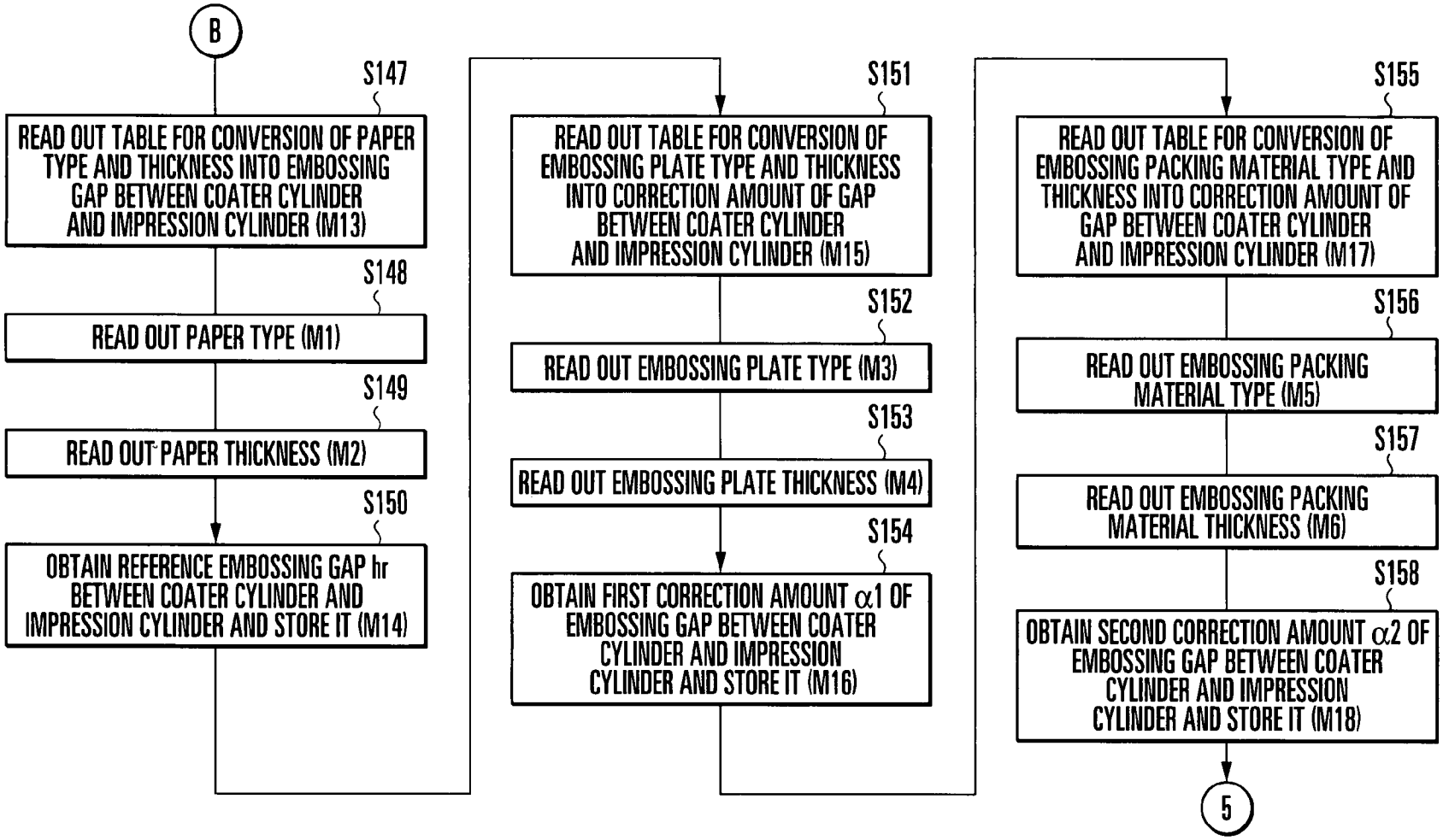

In this state, when an impression throw-on signal is input from the printing press control device 200 to the coater control device 100A (YES in step S113), the CPU 1 reads the preset state of the coating/embossing selector switch 4 (step S114, FIG. 4B). The CPU 1 confirms that the coating/embossing selector switch 4 is switched to the coating side (YES in step S115), and reads out the table for conversion of the paper type and thickness into the coating gap between the coater cylinder and impression cylinder (step S116).

The CPU 1 reads out the paper type from the memory M1 (step S117) and the paper thickness from the memory M2 (step S118). Using the table for conversion of the paper type and thickness into the coating gap between the coater cylinder and impression cylinder which is read out in step S116, the CPU 51 obtains the coating gap hc between the coater cylinder and impression cylinder from the paper type and thickness read out in steps S117 and S118, and stores the obtained gap hc in the memory M8 (step S119).

The CPU 1 then outputs a contact signal to the coater form roller throw-on/throw-off air cylinder valve 18 (step S120) to actuate the coater form roller throw-on/throw-off air cylinder 19, so the coater form roller 42 is brought into contact with the coater cylinder 41. Also, the CPU 1 sends a varnish supply start signal to the chamber coater control device 300 (step S121) to start varnish supply to the chamber coater 43.

The CPU 1 reads out the coating gap hc between the coater cylinder and impression cylinder from the memory M8 (step S122), calculates the target count for detecting the gap between the coater cylinder and impression cylinder from the readout coating gap hc between the coater cylinder and impression cylinder, and stores the calculated count in the memory M9 (step S123). The CPU 1 reads the count of the counter 16 for detecting the current value of the gap between the coater cylinder and impression cylinder, stores the readout count in the memory M10 as the current count (step S124), reads out the count for detecting the gap between the coater cylinder and impression cylinder which is stored in the memory M9 (step S125) as the target count, and compares the current count with the target count (step S126, FIG. 4C).

If the current count is smaller than the target count (YES in step S127), the CPU 1 determines that the current gap h between the coater cylinder and impression cylinder is larger than the target coating gap hc between the coater cylinder and impression cylinder, overwrites "0" in the rotational direction memory M11 (step S128), and sends a clockwise rotation command to the motor driver 14 for adjusting the gap between the coater cylinder and impression cylinder (step S129). Thus, the motor 15 for adjusting the gap between the coater cylinder and impression cylinder rotates clockwise, and the gap h between the coater cylinder and impression cylinder decreases.

In contrast to this, if the current count is larger than the target count (NO in step S127), the CPU 1 determines that the current gap h between the coater cylinder and impression cylinder is smaller than the target gap hc between the coater cylinder and impression cylinder, overwrites "1" in the rotational direction memory M11 (step S130), and sends a counterclockwise rotation pulse output command to the motor driver 14 for adjusting the gap between the coater cylinder and impression cylinder (step S131). Thus, the motor 15 for adjusting the gap between the coater cylinder and impression cylinder rotates counterclockwise, and the gap h between the coater cylinder and impression cylinder increases.

The CPU 1 reads the count (current count) of the counter 16 for detecting the constantly changing current value of the gap between the coater cylinder and impression cylinder (step S132) and compares it with the target count stored in the memory M9 (steps S133 and S134). If the current count is equal to the target count (YES in step S134), the CPU 1 reads out the value in the rotational direction memory M11 (step S135). If the value in the rotational direction memory M11 is "0" (YES in step S136, FIG. 4D), the CPU 1 stops outputting the clockwise rotation command to the motor driver 14 for adjusting the gap between the coater cylinder and impression cylinder (step S137) to stop rotation of the motor 15 for adjusting the gap between the coater cylinder and impression cylinder. If the count in the rotational direction memory M11 is "1" (NO in step S136), the CPU 1 stops outputting the counterclockwise rotation command to the motor driver 14 for adjusting the gap between the coater cylinder and impression cylinder (step S138) to stop rotation of the motor 15 for adjusting the gap between the coater cylinder and impression cylinder. Thus, the gap h between the coater cylinder and impression cylinder becomes equal to the target coating gap hc between the coater cylinder and impression cylinder.

The CPU 1 checks the presence/absence of an input of an impression throw-off signal from the printing press control device 200 (step S139). During this checking, the impression cylinder 40, coater cylinder 41, and coater form roller 42 continue rotation. Hence, varnish from the chamber coater 43 which is supplied to the coating plate 44 is applied to the paper (printed paper) passing between the coater cylinder 41 and impression cylinder 40. If the current count coincides with the target count in step S126, the process does not advance to step S127 but directly advances to step S139.

[Coating Operation End]

When printing and coating are ended and an impression throw-off signal is supplied from the printing press control device 200 (YES in step S139), the CPU 1 sends a varnish supply stop signal to the chamber coater control device 300 (step S140) to stop varnish supply to the chamber coater 43. The CPU 1 also outputs a detaching signal to the coater form roller throw-on/throw-off air cylinder valve 18 (step S141) to actuate the coater form roller throw-on/throw-off air cylinder 19, so the coater form roller 42 is detached from the coater cylinder 41.

The CPU 1 then sends a counterclockwise rotation command to the motor driver 14 for adjusting the gap between the coater cylinder and impression cylinder (step S142) to rotate the motor 15 for adjusting the gap between the coater cylinder and impression cylinder counterclockwise, so the gap h between the coater cylinder and impression cylinder increases.

During the counterclockwise rotation of the motor 15 for adjusting the gap between the coater cylinder and impression cylinder, the CPU 1 reads the current count of the counter 16 for detecting the current value of the gap between the coater cylinder and impression cylinder (step S143), and compares the current count with the count for detecting the detaching position between the coater cylinder and impression cylinder which is read out from the memory M12 (steps S144 and S145). If the current count is equal to the count for detecting the detaching position (YES in step S145), the CPU 1 stops outputting the counterclockwise rotation command to the motor driver 14 for adjusting the gap between the coater cylinder and impression cylinder (step S146) to stop rotation of the motor 15 for adjusting the gap between the coater cylinder and impression cylinder.

Thus, the coater cylinder 41 is detached from the impression cylinder 40, and the operation of coating the printed paper using the coater is ended.

[Embossing]

When performing embossing operation, the operator mounts the embossing plate 45 on the coater cylinder 41 in place of the coating plate 44 (see FIG. 1B). The embossing packing material 46 is interposed between the embossing plate 45 and coater cylinder 41. The coating/embossing selector switch 4 is switched to the embossing side.

In this state, when an impression throw-on signal is input from the printing press control device 200 to the coater control device 100A (YES in step S113, FIG. 4A), the CPU 1 reads the preset state of the coating/embossing selector switch 4 (step S114, FIG. 4B). The CPU 1 confirms that the coating/embossing selector switch 4 is switched to the embossing side (NO in step S115), and reads out from the memory M13 the table for conversion of the paper type and thickness into the embossing gap between the coater cylinder and impression cylinder (step S147, FIG. 4E).

The CPU 1 then reads out the paper type from the memory M1 (step S148) and the paper thickness from the memory M2 (step S149). Using the table for conversion of the paper type and thickness of the into the embossing gap between the coater cylinder and impression cylinder which is read out in step S147, the CPU 1 obtains a reference embossing gap hr between the coater cylinder and impression cylinder from the paper type and thickness read out in steps S148 and S149, and stores it in the memory M14 (step S150).

The CPU 1 then reads out the table for conversion of the embossing plate type and thickness into the correction amount of the gap between the coater cylinder and impression cylinder from the memory M15 (step S151), the embossing plate type from the memory M3 (step S152), and the embossing plate thickness from the memory M4 (step S153). Using the table for conversion of the embossing plate type and thickness into the correction amount of the gap between the coater cylinder and impression cylinder which is read out in step S151, the CPU 1 obtains a first correction amount $\alpha 1$ of the embossing gap between the coater cylinder and impression cylinder from the embossing plate type and thickness read out in steps S152 and S153, and stores it in the memory M16 (step S154).

The CPU 1 also reads out the table for conversion of the embossing packing material type and thickness into the correction amount of the gap between the coater cylinder and impression cylinder from the memory M17 (step S155), the embossing packing material type from the memory M5 (step S156), and the embossing packing material thickness from the memory M6 (step S157). Using the table for conversion of the embossing packing material type and thickness into the correction amount of the gap between the coater cylinder and impression cylinder which is read out in step S155, the CPU 1 obtains a second correction amount $\alpha 2$ of the embossing gap between the coater cylinder and impression cylinder from the embossing packing material type and thickness read out in steps S156 and S157, and stores it in the memory M18 (step S158).

Figure 4F:
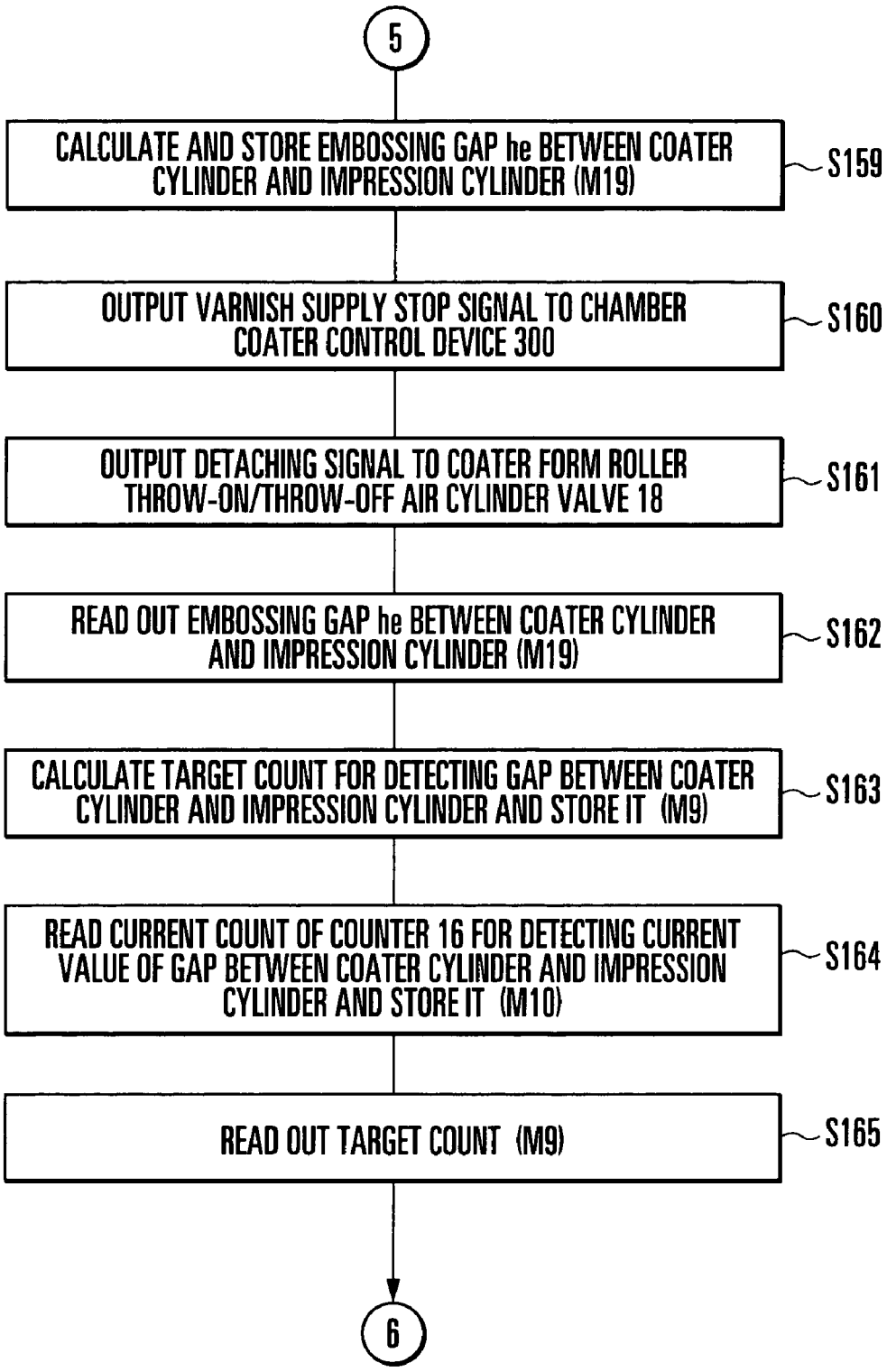
Figure 4G:
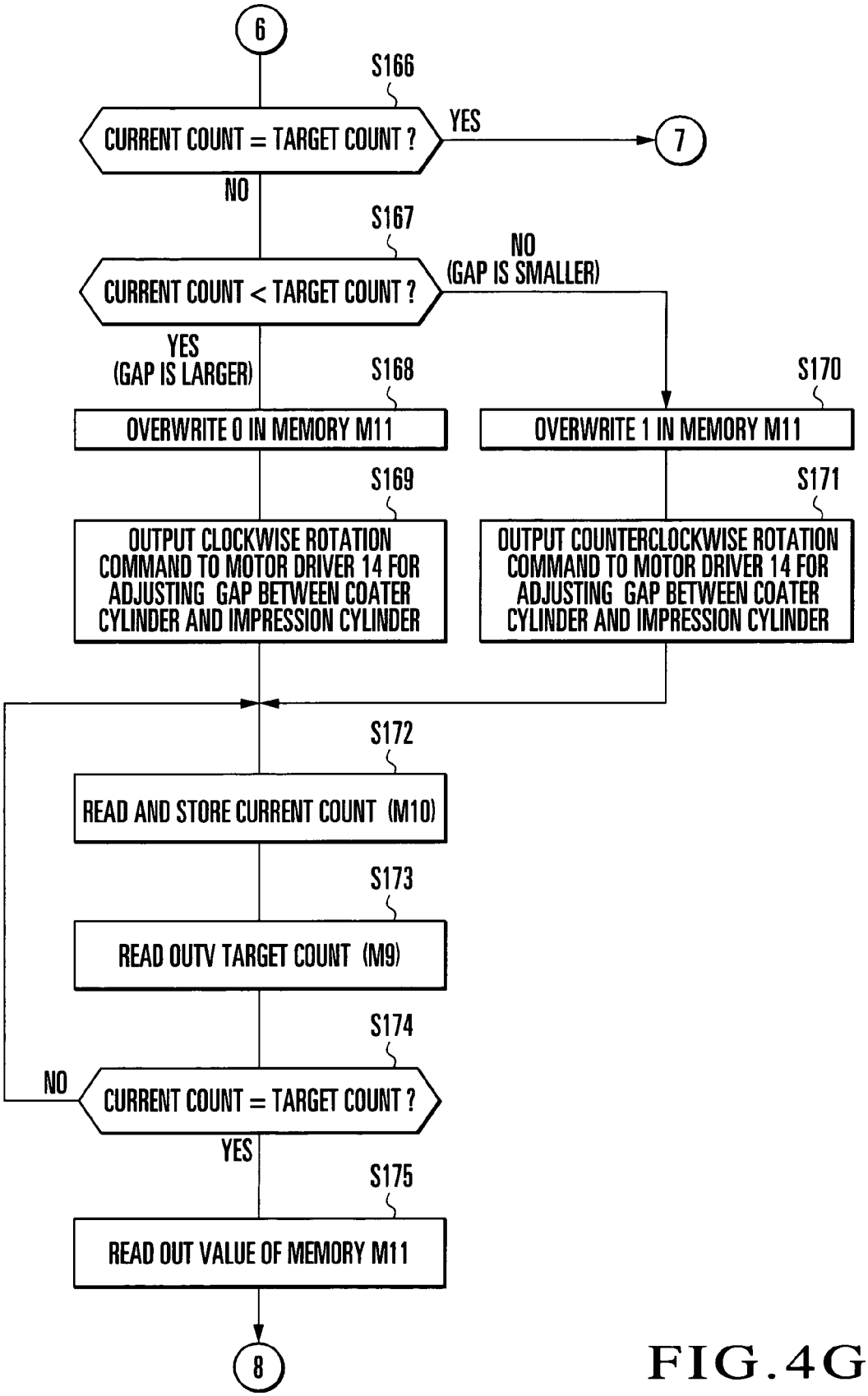
Figure 4H:
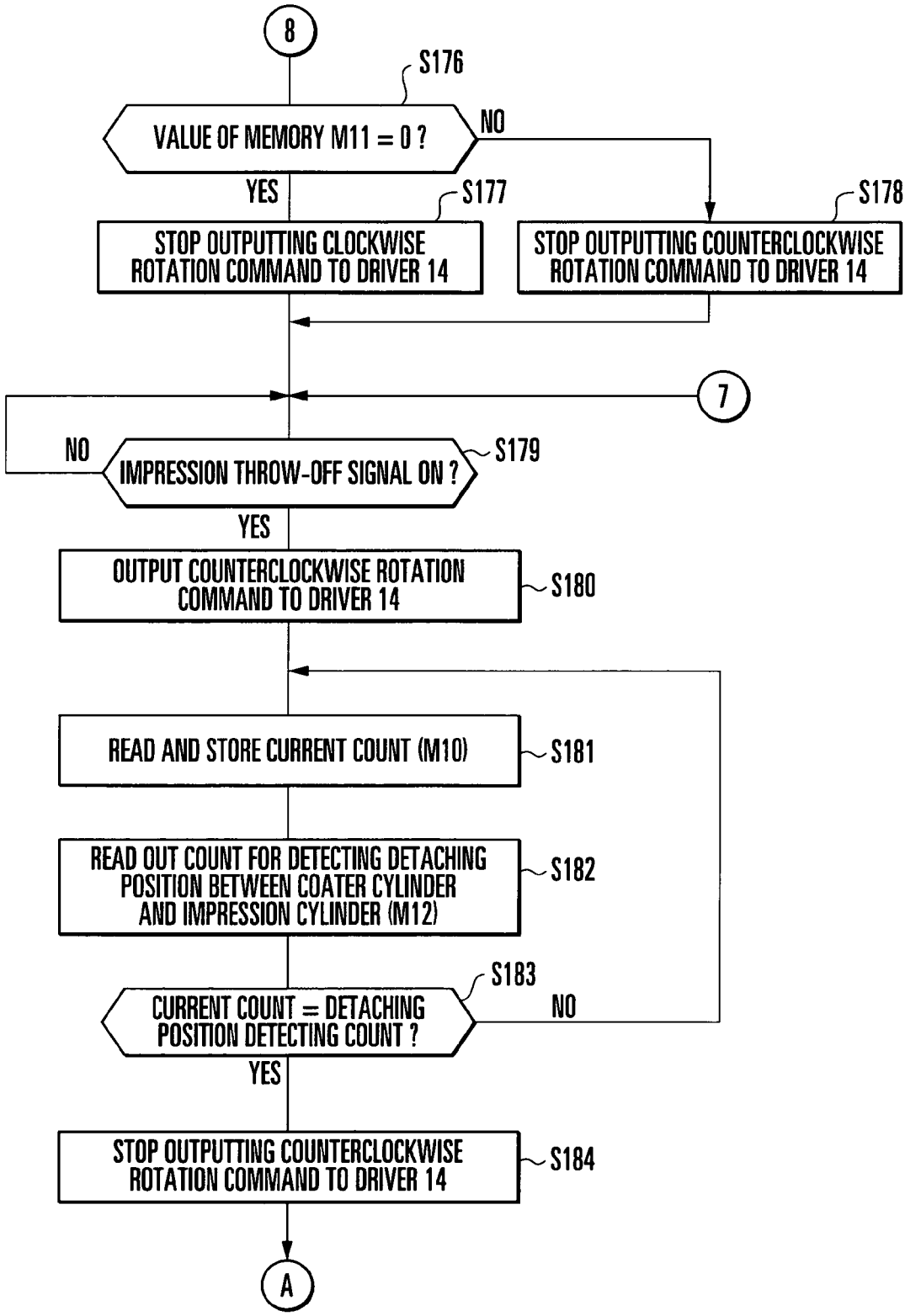

The CPU 1 subtracts the first correction amount $\alpha 1$ of the embossing gap between the coater cylinder and impression cylinder obtained in step S154 and the second correction amount $\alpha 2$ of the embossing gap between the coater cylinder and impression cylinder obtained in step S158 from the reference embossing gap hr between the coater cylinder and impression cylinder obtained in step S150, to obtain the embossing gap he ($he=hr-\alpha 1-\alpha 2$) between the coater cylinder and impression cylinder, and stores the embossing gap in the memory M19 (step S159, FIG. 4F).

The CPU 1 then sends a varnish supply stop signal to the chamber coater control device 300 (step S160) to stop varnish supply to the chamber coater 43. The CPU 1 also outputs a detaching signal to the coater form roller throw-on/throw-off air cylinder valve 18 (step S161) to actuate the coater form roller throw-on/throw-off air cylinder 19, so the coater form roller 42 is detached from the coater cylinder 41.

The CPU 1 also reads out the embossing gap he between the coater cylinder and impression cylinder from the memory M19 (step S162), calculates the target count for detecting the gap between the coater cylinder and impression cylinder from the readout embossing gap he between the coater cylinder and impression cylinder, and stores the target count in the memory M9 (step S163). The CPU 1 reads the current count of counter 16 for detecting the current value of the gap between the coater cylinder and impression cylinder (step S164), reads out from the memory M9 the count for detecting the gap between the coater cylinder and impression cylinder as the target count (step S165), and compares the current count with the target count (step S166 in FIG. 4G).

If the current count is smaller than the target count (YES in step S167), the CPU 1 determines that the current gap h between the coater cylinder and impression cylinder is larger than the target embossing gap he between the coater cylinder and impression cylinder, overwrites "0" in the rotational direction memory M11 (step S168), and sends a clockwise rotation command to the motor driver 14 for adjusting the gap between the coater cylinder and impression cylinder (step S169). Thus, the motor 15 for adjusting the gap between the coater cylinder and impression cylinder rotates clockwise to decrease the gap h between the coater cylinder and impression cylinder.

In contrast to this, if the current count is larger than the target count (NO in step S167), the CPU 1 determines that the current gap h between the coater cylinder and impression cylinder is smaller than the target embossing gap he between the coater cylinder and impression cylinder, overwrites "1" in the rotational direction memory M11 (step S170), and sends a clockwise rotation command to the motor driver 14 for adjusting the gap between the coater cylinder and impression cylinder (step S171). Thus, the motor 15 for adjusting the gap between the coater cylinder and impression cylinder rotates counterclockwise to increase the gap h between the coater cylinder and impression cylinder.

The CPU 1 reads the current count of the counter 16 for detecting the current value of the constantly changing gap between the coater cylinder and impression cylinder (step S172), and compares it with the target count stored in the memory M9 (steps S173 and S174). If the current count is equal to the target count (YES in step S174), the CPU 1 reads out the value of the rotational direction memory M11 (step S175). If the value of the rotational direction memory M11 is "0" (YES in step S176, FIG. 4H), the CPU 1 stops outputting the clockwise rotation command to the motor 15 for adjusting the gap between the coater cylinder and impression cylinder (step S177) to stop rotation of the motor 15 for adjusting the gap between the coater cylinder and impression cylinder. If the value of the rotational direction memory M11 is "1" (NO in step S176), the CPU 1 stops outputting the counterclockwise rotation command to the motor driver 14 for adjusting the gap between the coater cylinder and impression cylinder (step S178) to stop rotation of the motor 15 for adjusting the gap between the coater cylinder and impression cylinder.

Thus, the gap h between the coater cylinder and impression cylinder becomes equal to the target embossing gap he between the coater cylinder and impression cylinder.

The CPU 1 checks the presence/absence of an input of the impression throw-off signal from the printing press control device 200 (step S179). During this checking, the impression cylinder 40 and coater cylinder 41 continue rotation. Thus, the embossing plate 45 as the die embosses the paper (printed paper) passing between the coater cylinder 41 and impression cylinder 40. In step S166, if the current count coincides with the target count, the process does not advance to step S167 but directly advances to step S179.

[Embossing Operation End]

When printing and embossing are ended and an impression throw-off signal is supplied from the printing press control device 200 (YES in step S179), the CPU 1 sends a counterclockwise rotation command to the motor driver 14 for adjusting the gap between the coater cylinder and impression cylinder (step S180) to rotate counterclockwise the motor 15 for adjusting the gap between the coater cylinder and impression cylinder, thereby increasing the gap h between the coater cylinder and impression cylinder.

During the counterclockwise rotation of the motor 15 for adjusting the gap between the coater cylinder and impression cylinder, the CPU 1 reads the current count of the counter 16 for detecting the current value of the gap between the coater cylinder and impression cylinder (step S181), and compares the current value with the count for detecting the detaching position between the coater cylinder and impression cylinder which is read out from the memory M12 (steps S182 and S183). If the current count is equal to the count for detecting the detaching position (YES in step S183), the CPU 1 stops outputting the counterclockwise rotation command to the motor driver 14 for adjusting the gap between the coater cylinder and impression cylinder (step S184) to stop rotation of the motor 15 for adjusting the gap between the coater cylinder and impression cylinder.

Thus, the coater cylinder 41 is detached from the impression cylinder 40, and the embossing operation for the printed paper using the coater is ended.

[Second Embodiment]

Another exemplary coater which also serves as an embossing apparatus will be described as the second embodiment of the switch-over processing apparatus of the present invention.

Figure 5A:
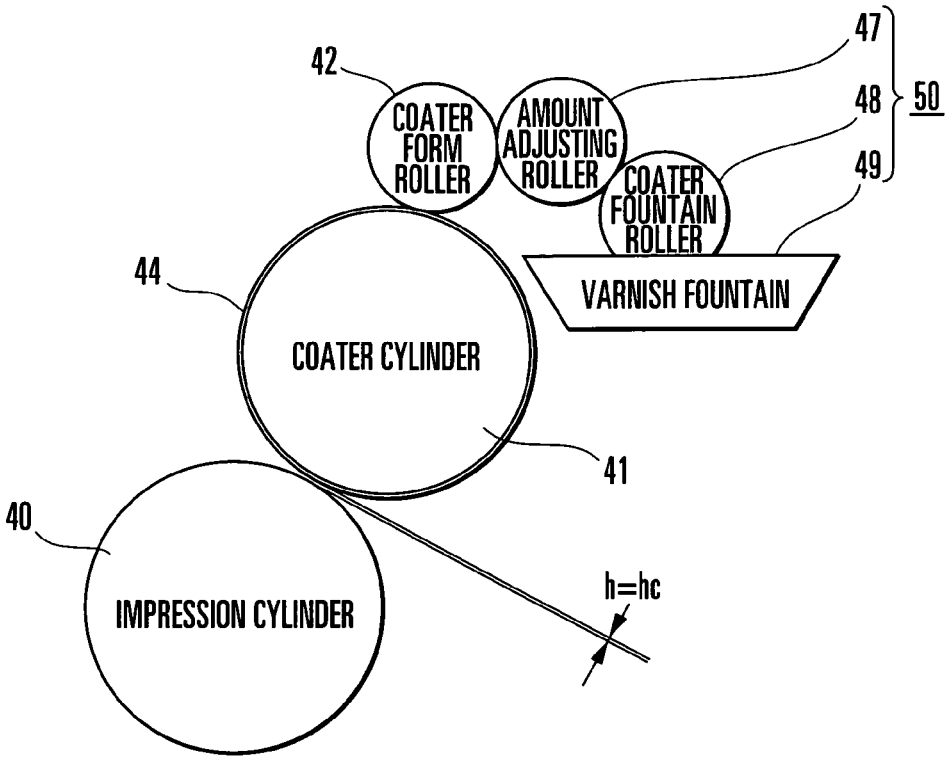
FIG. 5A is a view showing a state in which a coating plate is mounted on a coating cylinder in a coater as the second embodiment of the switch-over processing apparatus of the present invention which also serves as an embossing apparatus.

The coater according to this embodiment is arranged behind, e.g., the last printing unit of a web offset printing press, and comprises an impression cylinder 40, coater cylinder 41, coater form roller 42, a varnish supply unit 50 using a varnish fountain for supplying varnish to the coater form roller 42, and the like, as shown in FIG. 5A. The arrangement of the coater is described in, e.g., reference 3 (Japanese Patent Laid-Open No. 59-142149) and reference 4 (Japanese Utility Model Laid-Open No. 59-153228).

The coater cylinder 41 opposes the impression cylinder 40, and the coater form roller 42 opposes the coater cylinder 41. The varnish supply unit 50 comprises a varnish fountain 49, a coater fountain roller 48 the outer surface of which is dipped in varnish reserved in the varnish fountain 49, a coater amount adjusting roller 47 located between the coater form roller 42 and coater fountain roller 48, and the like. A coating plate 44 is mounted on the coater cylinder 41 as a coating transfer body. When performing entire-surface coating, in place of the coating plate 44, a mere blanket may be used as the coating transfer body.

In this coater, when performing coating (to be described later), as shown in FIG. 5A, the coater cylinder 41 is set in an impression thrown-on state with respect to the impression cylinder 40, and a gap h between the coater cylinder 41 and impression cylinder 40 is set to a coating gap hc. The coater form roller 42 is in contact with the coater cylinder 41, the varnish fountain 49 is in contact with the coater fountain roller 48, and the coater amount adjusting roller 47 is in contact with the coater form roller 42 and coater fountain roller 48.

Figure 5B:
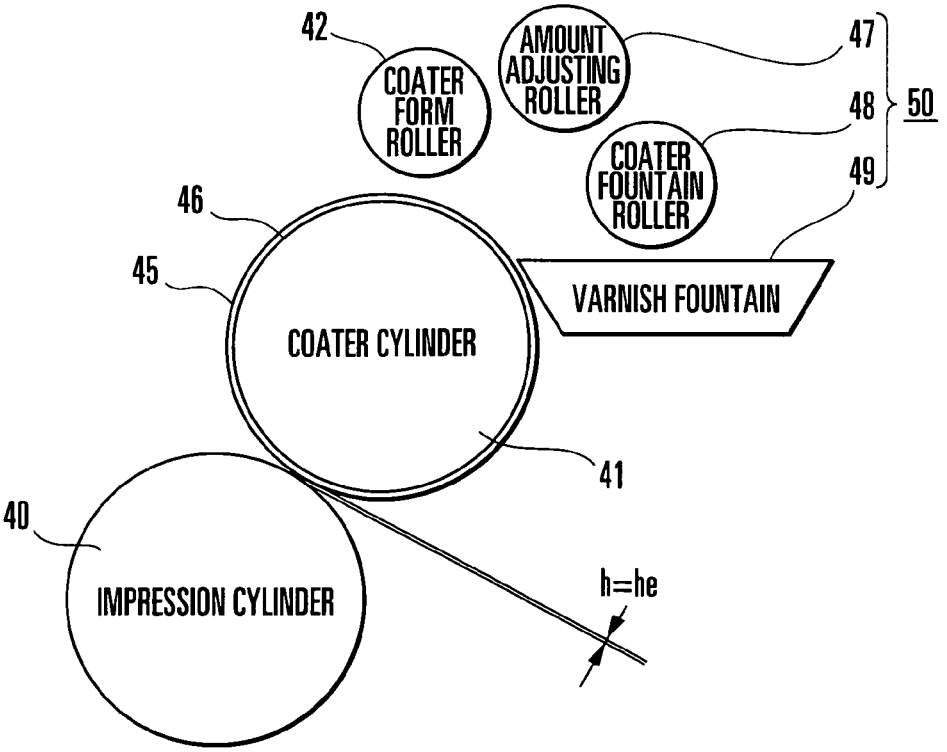
FIG. 5B is a view showing a state in which an embossing plate is mounted on the coating cylinder in the coater as the second embodiment.
Figure 6:
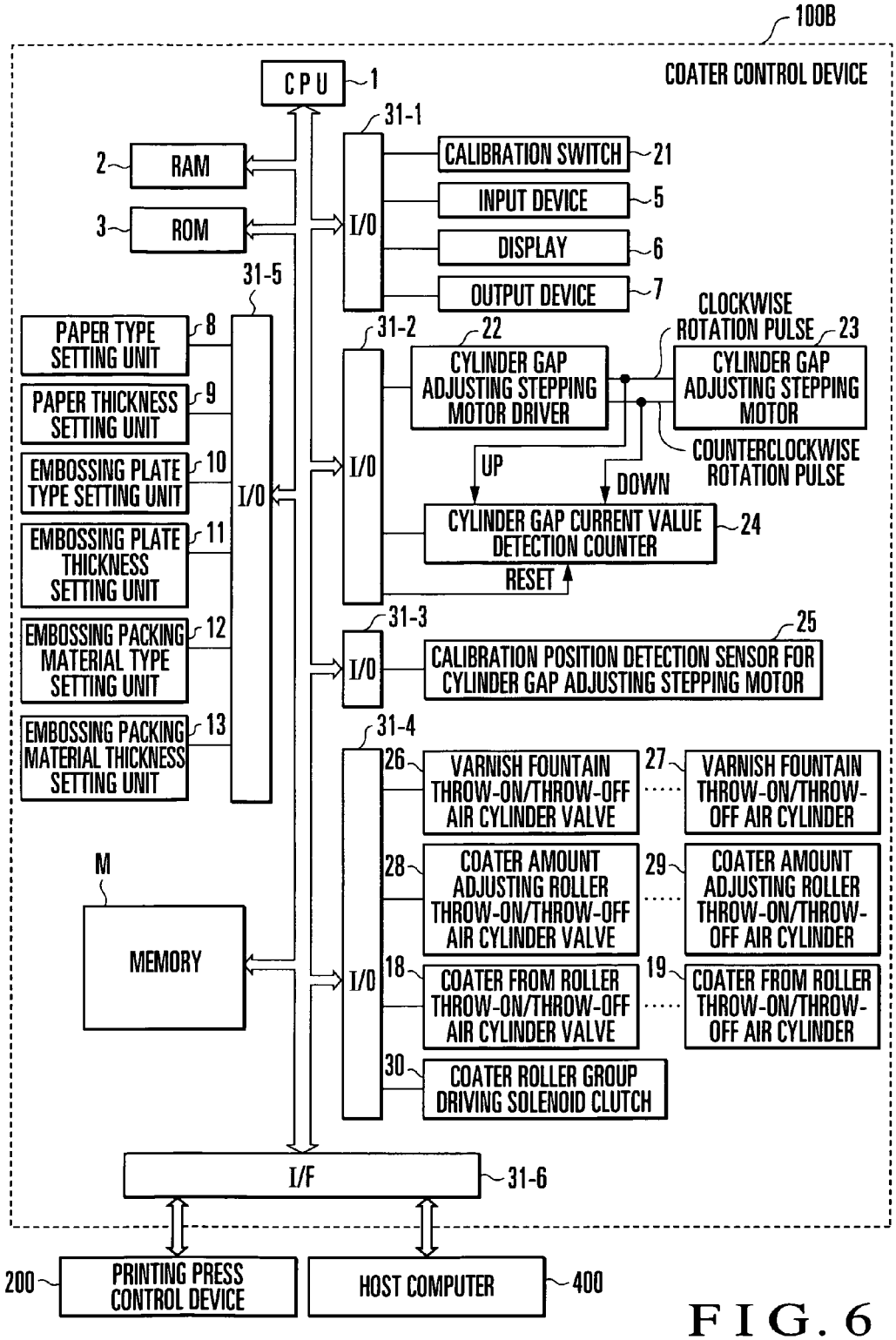
FIG. 6 is a block diagram showing the controller of the coater as the second embodiment.

When performing embossing (to be described later), as shown in FIG. 5B, the coater cylinder 41 is set in the impression through-on state with respect to the impression cylinder 40, and the gap h between the coater cylinder 41 and impression cylinder 40 is set to an embossing gap he. The coater form roller 42 is detached from the coater cylinder 41, the varnish fountain 49 is detached from the coater fountain roller 48, and the coater amount adjusting roller 47 is detached from the coater form roller 42 and coater fountain roller 48.

When performing embossing, the operator mounts an embossing plate 45 on the coater cylinder 41 in place of the coating plate 44. As the embossing plate 45 is thin, an embossing packing material 46 is interposed between the embossing plate 45 and coater cylinder 41.

A coater control device 100B comprises a CPU 1, a RAM 2, a ROM 3, a calibration switch 21, an input device 5, a display 6, an output device 7, a paper type setting unit 8, a paper thickness setting unit 9, an embossing plate type setting unit 10, an embossing plate thickness setting unit 11, an embossing packing material type setting unit 12, an embossing packing material thickness setting unit 13, a stepping motor driver 22 for adjusting the gap between the coater cylinder and impression cylinder, a stepping motor 23 for adjusting the gap between the coater cylinder and impression cylinder, a counter (UP/DOWN counter) 24 for detecting the current value of the gap between the coater cylinder and impression cylinder, a calibration position detection sensor 25 for the stepping motor for adjusting the gap between the coater cylinder and impression cylinder, a varnish fountain throw-on/throw-off air cylinder valve 26, a varnish fountain throw-on/throw-off air cylinder 27, a coater amount adjusting roller throw-on/throw-off air cylinder valve 28, a coater amount adjusting roller throw-on/throw-off air cylinder 29, a coater form roller throw-on/throw-off air cylinder valve 18, a coater form roller throw-on/throw-off air cylinder 19, a coater roller group (the coater form roller 42, coater amount adjusting roller 47, and coater fountain roller 48), a driving solenoid clutch 30, input/output interfaces 30-1 to 30-6, and a memory M. The output device 7 includes an FD driver, printer, and the like.

Figure 7:
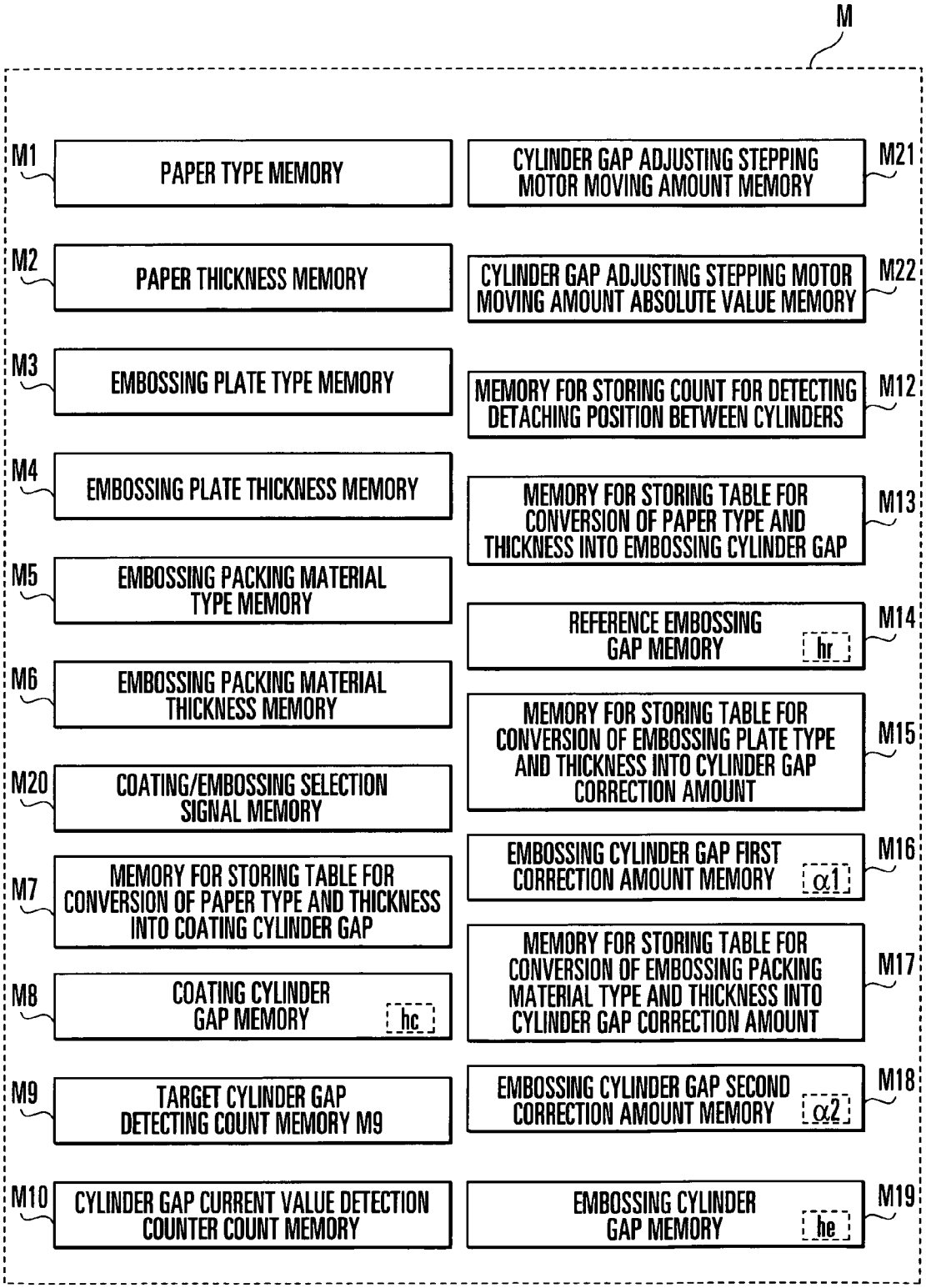
FIG. 7 is a block diagram showing the arrangement of a memory in a coater control device.

As shown in FIG. 7, the memory M comprises a paper type memory M1, a paper thickness memory M2, an embossing plate type memory M3, an embossing plate thickness memory M4, an embossing packing material type memory M5, an embossing packing material thickness memory M6, a coating/embossing selection signal memory M20, a memory M7 for storing a table for conversion of a paper type and thickness into a coating gap between the coater cylinder and impression cylinder, a memory M8 for storing the coating gap between the coater cylinder and impression cylinder, a target count memory M9 for detecting the gap between the coater cylinder and impression cylinder, a count memory M10 for the counter for detecting the current value of the gap between the coater cylinder and impression cylinder, a memory M21 for storing the moving amount of the stepping motor for adjusting the gap between the coater cylinder and impression cylinder, a memory M22 for storing the absolute value of the moving amount of the stepping motor for adjusting the gap between the coating cylinder and impression cylinder, a count memory M12 for detecting the detaching position between the coater cylinder and impression cylinder, a memory M13 for storing a table for conversion of a paper type and thickness into the embossing gap between the coater cylinder and impression cylinder, a memory M14 for storing the reference embossing gap between the coater cylinder and impression cylinder, a memory M15 for storing a table for conversion of an embossing plate type and thickness into a correction amount of the gap between the coater cylinder and impression cylinder, a memory M16 for storing the first correction amount of the embossing gap between the coater cylinder and impression cylinder, a memory M17 for storing a table for conversion of an embossing packing material type and thickness into the correction amount of the gap between the coater cylinder and impression cylinder, a memory M18 for storing the second correction amount of the embossing gap between the coater cylinder and impression cylinder, and a memory M19 for storing the embossing gap between the coater cylinder and impression cylinder. The functions of the respective memories in the memory M will be described later.

The counter 24 for detecting the current position of the gap between the coater cylinder and impression cylinder is an UP/DOWN counter. The counter 24 increments by one every time one clockwise rotation pulse is output to the stepping motor 23 for adjusting the gap between the coater cylinder and impression cylinder, and decrements by one every time one counterclockwise rotation pulse is output to the stepping motor 23. The calibration position detection sensor 25 for the stepping motor for adjusting the gap between the coater cylinder and impression cylinder is fixed to a frame (not shown), and directly detects the fact that the gap between the coater cylinder and impression cylinder reaches a predetermined gap larger than the normal moving range.

Upon obtaining various types of input information through the input/output interfaces 30-1 to 30-5, the CPU 1 operates in accordance with a program stored in the ROM 3 while accessing the RAM 2 and memory M. The ROM 3 stores, as the program specific to this embodiment, a coating/embossing selector program which controls switching between coating and embossing. This program can be provided in the form of a computer-readable storage medium such as an optical disk or magnetic disk.

Processing operation performed by the CPU 1 of the coater control device 100B using the coating/embossing selector program will be described in accordance with the flowcharts divided into FIGS. 8A to 8H.

To make a coater also serve as an embossing apparatus, the operator inputs the type and thickness (paper thickness) of paper (printed paper) to be subjected to coating and embossing, the type and thickness (plate thickness) of an embossing plate to be used, and the type and thickness (packing material thickness) of an embossing packing material to be used from the setting units 8 to 13.

When the paper type is input from the paper type setting unit 8 (YES in step S201, FIG. 8A), the CPU 1 stores it in the memory M1 (step S202). When the paper thickness is input from the setting unit 9 (YES in step S203), the CPU 1 stores it in the memory M2 (YES in step S204). When the embossing plate type is input from the setting unit 10 (YES in step S205), the CPU 1 stores it in the memory M3 (step S206). When the embossing plate thickness is input from the setting unit 11 (YES in step S207), the CPU 1 stores it in the memory M4 (step S208). When the embossing packing material type is input from the setting unit 12 (YES in step S209), the CPU 1 stores it in the memory M5 (step S210). When the embossing packing material thickness is input from the setting unit 13 (YES in step S211), the CPU 1 stores it in the memory M6 (step S212).

When a coating/embossing selection signal (a signal for instructing whether coating operation or embossing operation is to be performed) is transmitted from a host computer 400 (YES in step S213), the CPU 1 stores operation information (classification of coating or embossing) designated by the coating/embossing selection signal in the memory M20 (step S214). In step S215, the CPU 1 also checks the presence/absence of an input of an impression throw-on signal from a printing press control device 200.

[Coating]

When performing coating, the operator mounts the coating plate 44 on the coater cylinder 41 (see FIG. 5A). In this case, the host computer 400 transmits a coating/embossing selection signal which designates coating operation to the CPU 1.

Figure 8A:
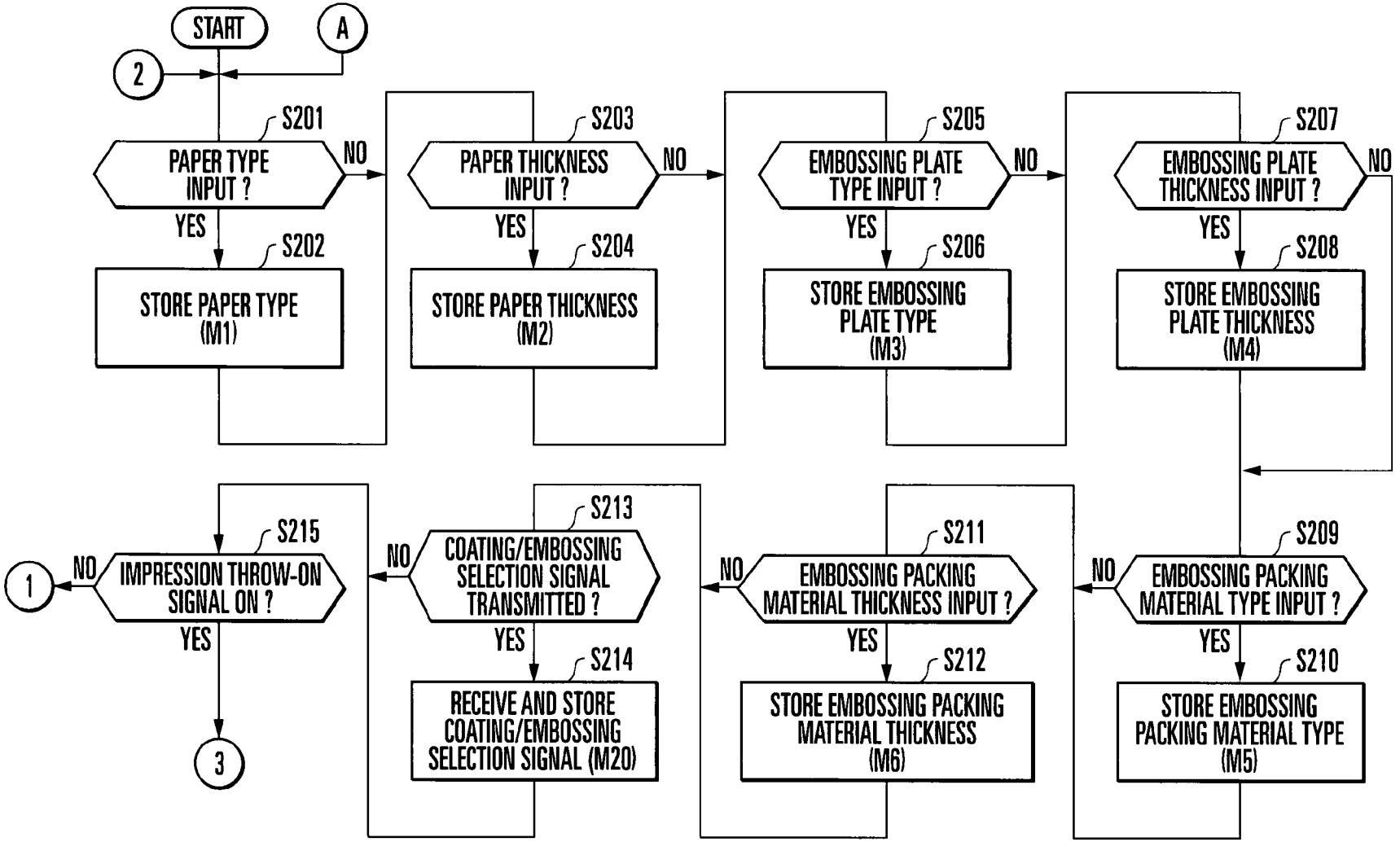
FIGS. 8A to 8I are flowcharts showing processing operation performed by the CPU of the coater control device.
Figure 8B:
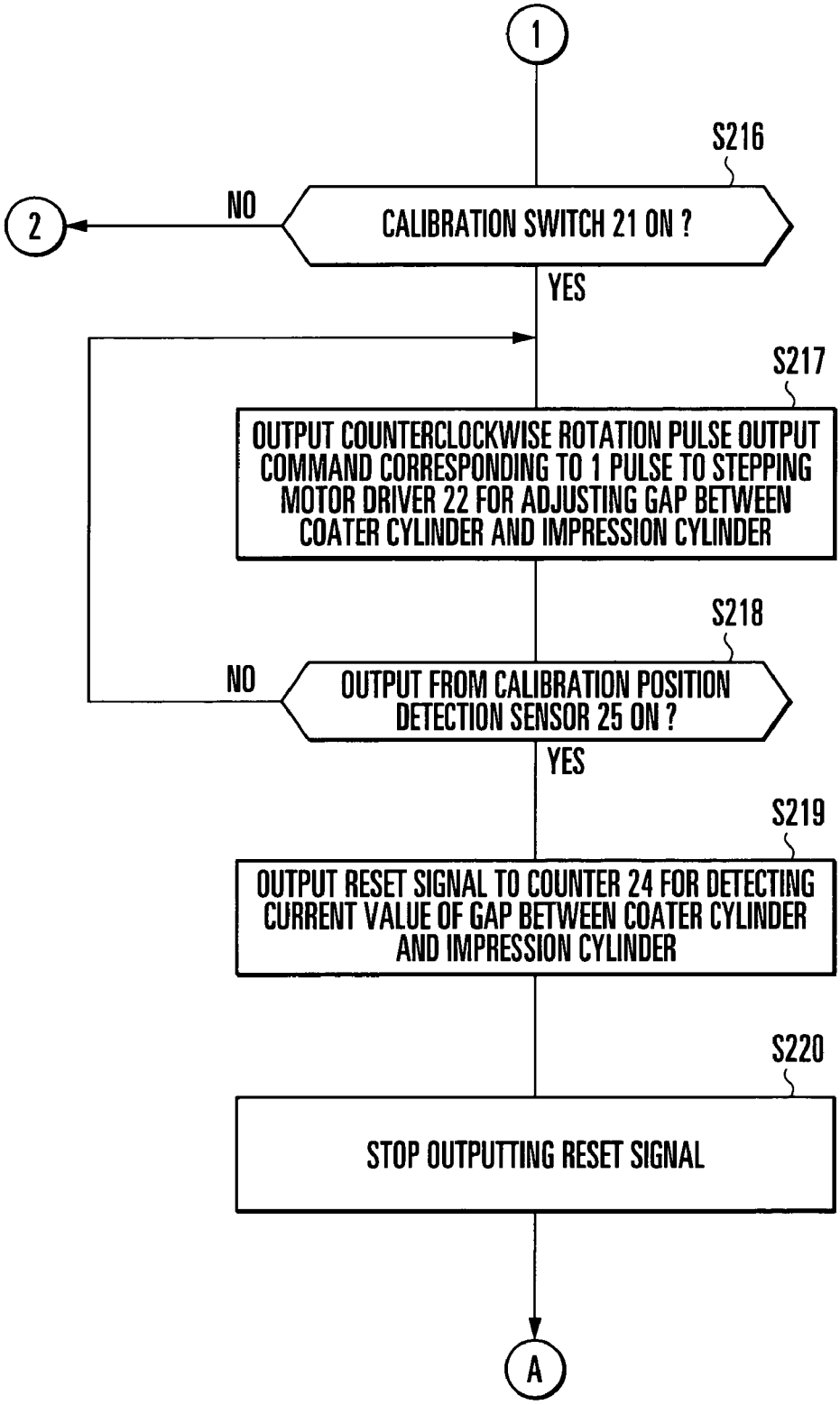
Figure 8C:
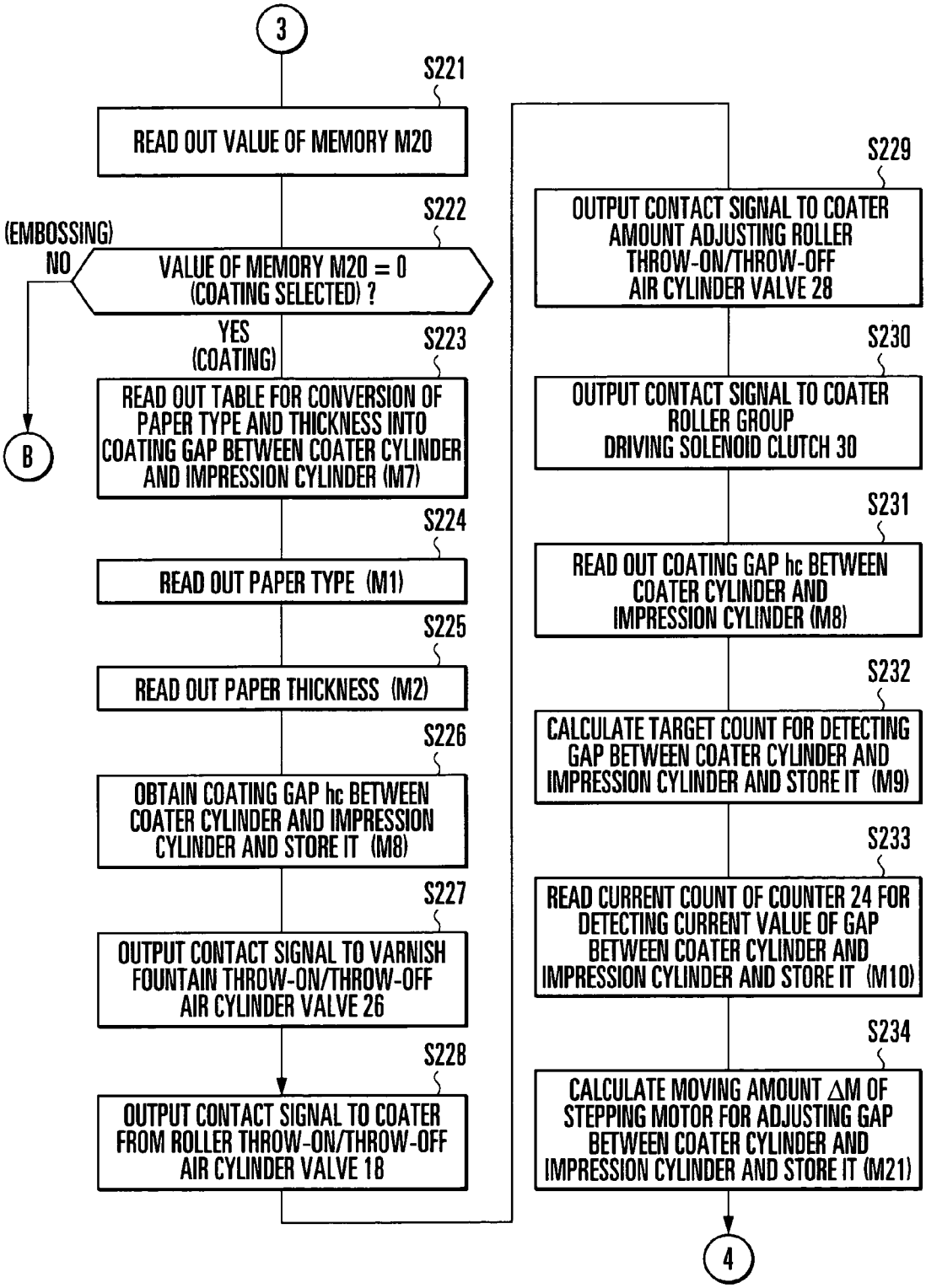
Figure 8D:
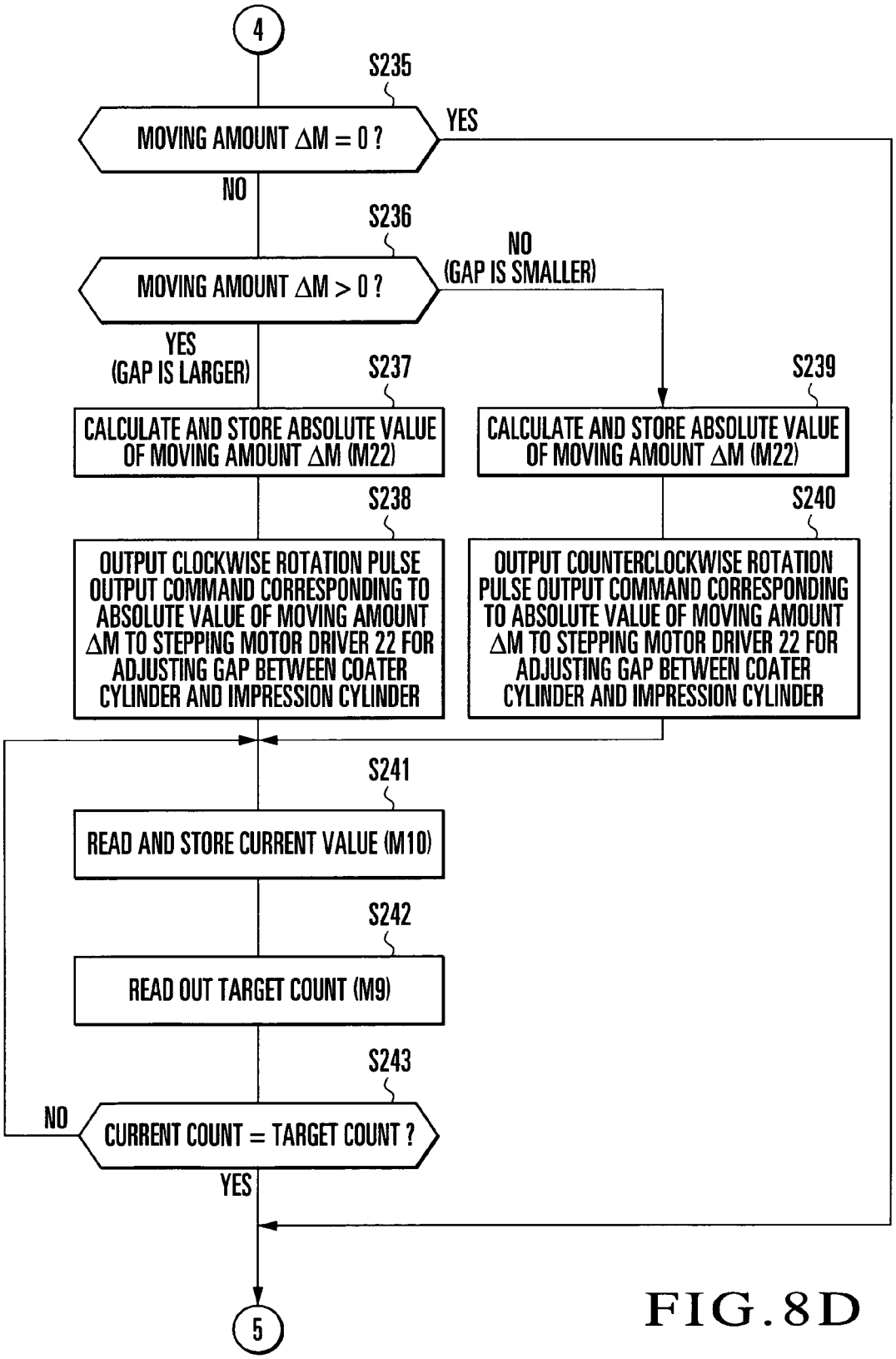

In this state, when an impression throw-on signal is input from the printing press control device 200 to the coater control device 100B (YES in step S215), the CPU 1 reads out the operation information stored in the memory M20 (step S221, FIG. 8C). The CPU 1 confirms that the coating operation is designated from the operation information (YES in step S222), and reads out the table for conversion of the paper type and thickness into the coating gap between the coater cylinder and impression cylinder (step S223).

The CPU 1 reads out the paper type from the memory M1 (step S224) and the paper thickness from the memory M2 (step S225). Using the table for conversion of the paper type and thickness into the coating gap between the coater cylinder and impression cylinder which is read out in step S223, the CPU 1 obtains the coating gap hc between the coater cylinder and impression cylinder from the paper type and thickness read out in steps S224 and S225, and stores the obtained gap hc in the memory M8 (step S226).

The CPU 1 then outputs a contact signal to the varnish fountain throw-on/throw-off air cylinder valve 26 (step S227) to actuate the varnish fountain throw-on/throw-off air cylinder 27, so the varnish fountain 49 is brought into contact with the coater fountain roller 48. Also, the CPU 1 outputs a contact signal to the coater form roller throw-on/throw-off air cylinder valve 18 (step S228) to actuate the coater form roller throw-on/throw-off air cylinder 19, so the coater form roller 42 is brought into contact with the coater cylinder 41. The CPU 1 also sends a contact signal to the coater amount adjusting roller throw-on/throw-off air cylinder valve 28 (step S229) to actuate the coater amount adjusting roller throw-on/throw-off air cylinder 29, so the coater amount adjusting roller 47 is brought into contact with the coater form roller 42 and coater fountain roller 48. Also, the CPU 1 sends a contact signal to the coater roller group driving solenoid clutch 30 (step S230) to start rotating the coater form roller 42, coater amount adjusting roller 47, and coater fountain roller 48.

The CPU 1 reads out the coating gap hc between the coater cylinder and impression cylinder from the memory M8 (step S231), calculates the target count for detecting the gap between the coater cylinder and impression cylinder from the readout coating gap hc between the coater cylinder and impression cylinder, and stores the calculated count in the memory M9 (step S232). The CPU 1 reads the current count of the counter 24 for detecting the current value of the gap between the coater cylinder and impression cylinder (step S233), subtracts the current count from the target count of the gap between the coater cylinder and impression cylinder to obtain a moving amount ΔM of the stepping motor for adjusting the gap between the coater cylinder and impression cylinder, and stores the moving amount ΔM in the memory M21 (step S234).

If the moving amount ΔM of the stepping motor for adjusting the gap between the coater cylinder and impression cylinder satisfies ΔM>0 (YES in step S236, FIG. 8D), it is determined that the current gap h between the coater cylinder and impression cylinder is larger than the target coating gap hc between the coater cylinder and impression cylinder. The CPU 1 then obtains the absolute value of the moving amount ΔM from the moving amount ΔM and stores it in the memory M22 (step S237), and sends a clockwise rotation pulse output command corresponding to the absolute value of the moving amount ΔM to the stepping motor driver 22 for adjusting the gap between the coater cylinder and impression cylinder (step S238). Thus, the stepping motor 23 for adjusting the gap between the coater cylinder and impression cylinder rotates clockwise, so the gap h between the coater cylinder and impression cylinder decreases.

In contrast to this, if the moving amount ΔM of the stepping motor for adjusting the gap between the coater cylinder and impression cylinder satisfies ΔM<0 (NO in step S236), it is determined that the current gap h between the coater cylinder and impression cylinder is smaller than the target coating gap hc between the coater cylinder and impression cylinder. The CPU 1 then obtains the absolute value of the moving amount ΔM from the moving amount ΔM and stores it in the memory M22 (step S239), and sends a counterclockwise rotation pulse output command corresponding to the absolute value of the moving amount ΔM to the stepping motor driver 22 for adjusting the gap between the coater cylinder and impression cylinder (step S240). Thus, the stepping motor 23 for adjusting the gap between the coater cylinder and impression cylinder rotates counterclockwise, and the gap h between the coater cylinder and impression cylinder increases.

Figure 8E:
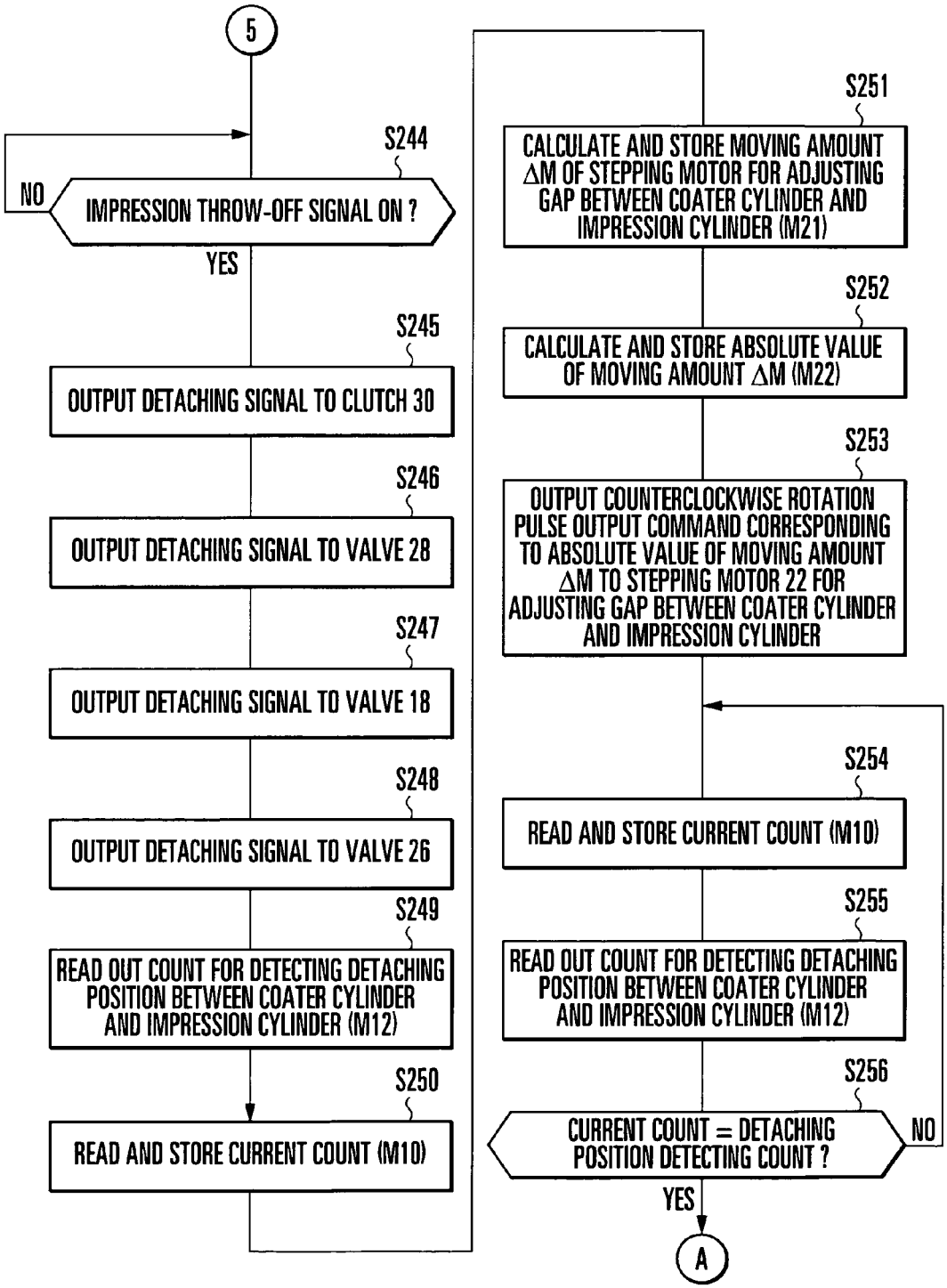
Figure 8F:
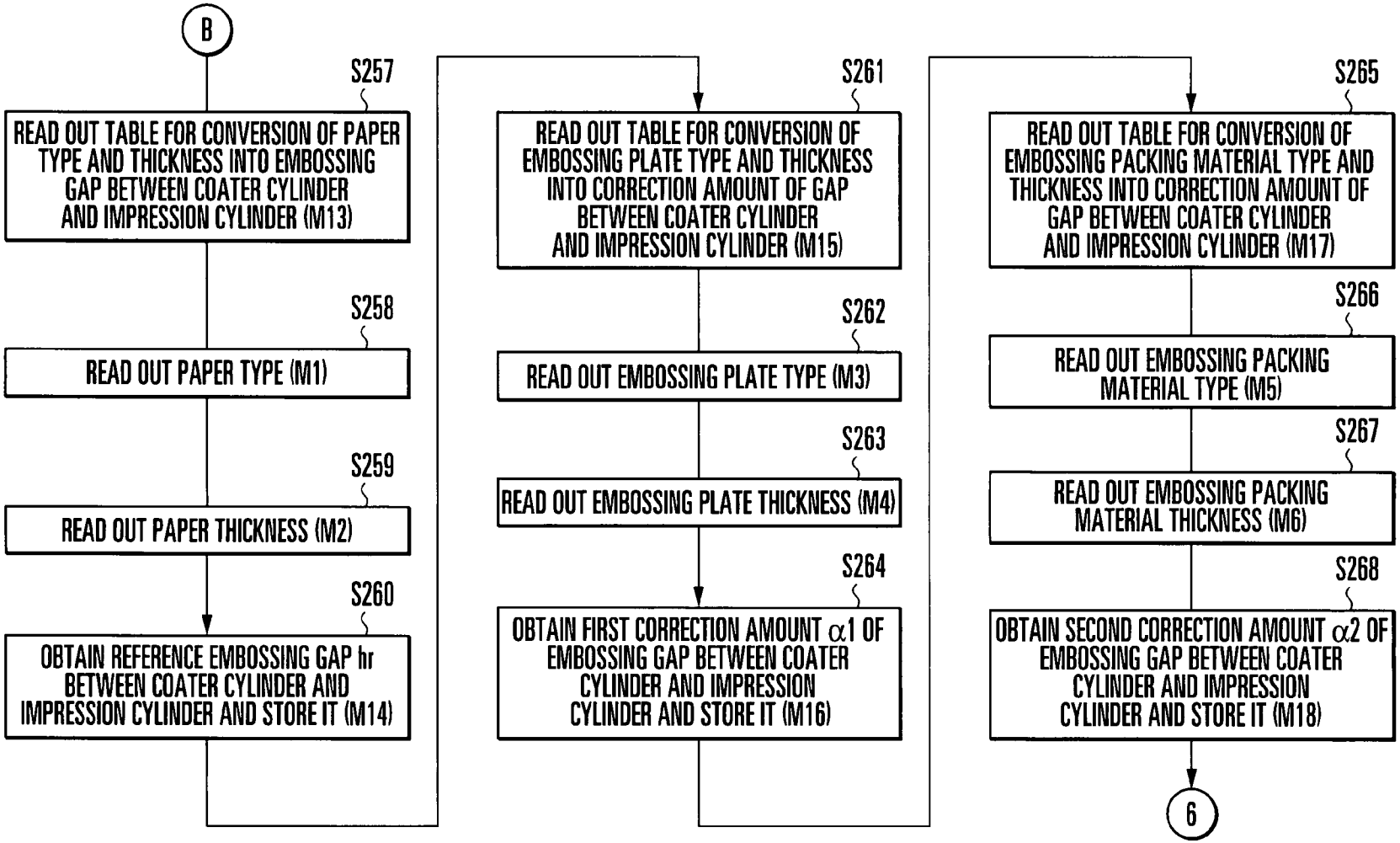

The CPU 1 reads the count (current count) of the counter 24 for detecting the constantly changing current value of the gap between the coater cylinder and impression cylinder (step S241) and compares it with the target count stored in the memory M9 (steps S242 and S243). Upon confirming the fact that the current count is equal to the target count (YES in step S234), the process advances to step S244 (FIG. 8E). Hence, the gap between the coater cylinder and impression cylinder becomes equal to the target coating gap hc between the coater cylinder and impression cylinder. In step S235, if the moving amount ΔM of the stepping motor for adjusting the gap h between the coater cylinder and impression cylinder is zero, the process does not advance to step S236 but directly advances to step S244.

In step S244, the CPU 1 checks the presence/absence of an input of an impression throw-off signal from the printing press control device 200. During this checking, the impression cylinder 40, coater cylinder 41, coater form roller 42, coater amount adjusting roller 47, and coater fountain roller 48 continue rotation. Hence, varnish from the varnish fountain 49 which is supplied to the coating plate 44 is applied to the paper (printed paper) passing between the coater cylinder 41 and impression cylinder 40.

[End of Coating Operation]

When printing and coating are ended and an impression throw-off signal is supplied from the printing press control device 200 (YES in step S244), the CPU 1 sends a detaching signal to the coater roller group driving solenoid clutch 30 (step S245) to stop rotation of the coater form roller 42, coater amount adjusting roller 47, and coater fountain roller 48. The CPU 1 also sends a detaching signal to the coater amount adjusting roller throw-on/throw-off air cylinder valve 28 (step S246) to detach the coater amount adjusting roller 47 from the coater form roller 42 and coater fountain roller 48. The CPU 1 also sends a detaching signal to the coater form roller throw-on/throw-off air cylinder valve 18 (step S247) to detach the coater form roller 42 from the coater cylinder 41. The CPU 1 also sends a detaching signal to the varnish fountain throw-on/throw-off air cylinder valve 26 (step S248) to detach the varnish fountain 49 from the coater fountain roller 48.

The CPU 1 then reads out the count for detecting the detaching position between the coater cylinder and impression cylinder from the memory M12 (step S249), reads the current count of the counter 24 for detecting the current value of the gap between the coater cylinder and impression cylinder (step S250), subtracts the current count from the detaching position detecting count to obtain the moving amount ΔM of the stepping motor for adjusting the gap between the coater cylinder and impression cylinder, and stores the moving amount ΔM in the memory M21 (step S251). The CPU 1 also obtains the absolute value of the moving amount ΔM and stores it in the memory M22 (step S252), and sends a counterclockwise rotation pulse output command corresponding to the absolute value of the moving amount ΔM to the stepping motor driver 22 for adjusting the gap between the coater cylinder and impression cylinder (step S253).

Thus, the stepping motor 23 for adjusting the gap between the coater cylinder and impression cylinder rotates counterclockwise, and the gap h between the coater cylinder and impression cylinder increases. During the counterclockwise rotation of the stepping motor 23 for adjusting the gap between the coater cylinder and impression cylinder, the CPU 1 reads the current count of the counter 24 for detecting the current value of the gap between the coater cylinder and impression cylinder (step S254), compares the current count with the count for detecting the detaching position between the coater cylinder and impression cylinder which is read out from the memory M12 (steps S255 and S256), and confirms that the current count is equal to the count for detecting the detaching position (YES in step S256). Then, the process returns to step S201 (FIG. 8A).

Thus, the coater cylinder 41 is detached from the impression cylinder 40, and the operation of coating the printed paper using the coater is ended.

[Embossing]

When performing embossing operation, the operator mounts the embossing plate 45 on the coater cylinder 41 in place of the coating plate 44 (see FIG. 5B). The embossing packing material 46 is interposed between the embossing plate 45 and coater cylinder 41. In this case, the host computer 400 transmits a coating/embossing selection signal which designates embossing operation.

In this state, when an impression throw-on signal is input from the printing press control device 200 to the coater control device 100B (YES in step S215, FIG. 8A), the CPU 1 reads out operation information stored in the memory M20 (step S221, FIG. 8C). The CPU 1 confirms that the embossing operation is designated from the operation information (NO in step S222), and reads out from the memory M13 the table for conversion of the paper type and thickness into the embossing gap between the coater cylinder and impression cylinder (step S257, FIG. 8F).

The CPU 1 then reads out the paper type from the memory M1 (step S258) and the paper thickness from the memory M2 (step S259). Using the table for conversion of the paper type and thickness into the coating gap between the coater cylinder and impression cylinder which is read out in step S257, the CPU 1 obtains the reference embossing gap hr between the coater cylinder and impression cylinder from the paper type and thickness read out in steps S258 and S259, and stores it in the memory M14 (step S260).

The CPU 1 then reads out the table for conversion of the embossing plate type and thickness into the correction amount of the gap between the coater cylinder and impression cylinder from the memory M15 (step S261), the embossing plate type from the memory M3 (step S262), and the embossing plate thickness from the memory M4 (step S263). Using the table for conversion of the embossing plate type and thickness into the correction amount of the gap between the coater cylinder and impression cylinder which is read out in step S261, the CPU 1 obtains a first correction amount $\alpha 1$ of the embossing gap between the coater cylinder and impression cylinder from the embossing plate type and thickness read out in steps S262 and S263, and stores it in the memory M16 (step S264).

The CPU 1 also reads out the table for conversion of the embossing packing material type and thickness into the correction amount of the gap between the coater cylinder and impression cylinder from the memory M17 (step S265), the embossing packing material type from the memory M5 (step S266), and the embossing packing material thickness from the memory M6 (step S267). Using the table for conversion of the embossing packing material type and thickness into the correction amount of the gap between the coater cylinder and impression cylinder which is read out in step S265, the CPU 1 obtains a second correction amount $\alpha 2$ of the embossing gap between the coater cylinder and impression cylinder from the embossing packing material type and thickness read out in steps S266 and S267, and stores it in the memory M18 (step S268).

Figure 8G:
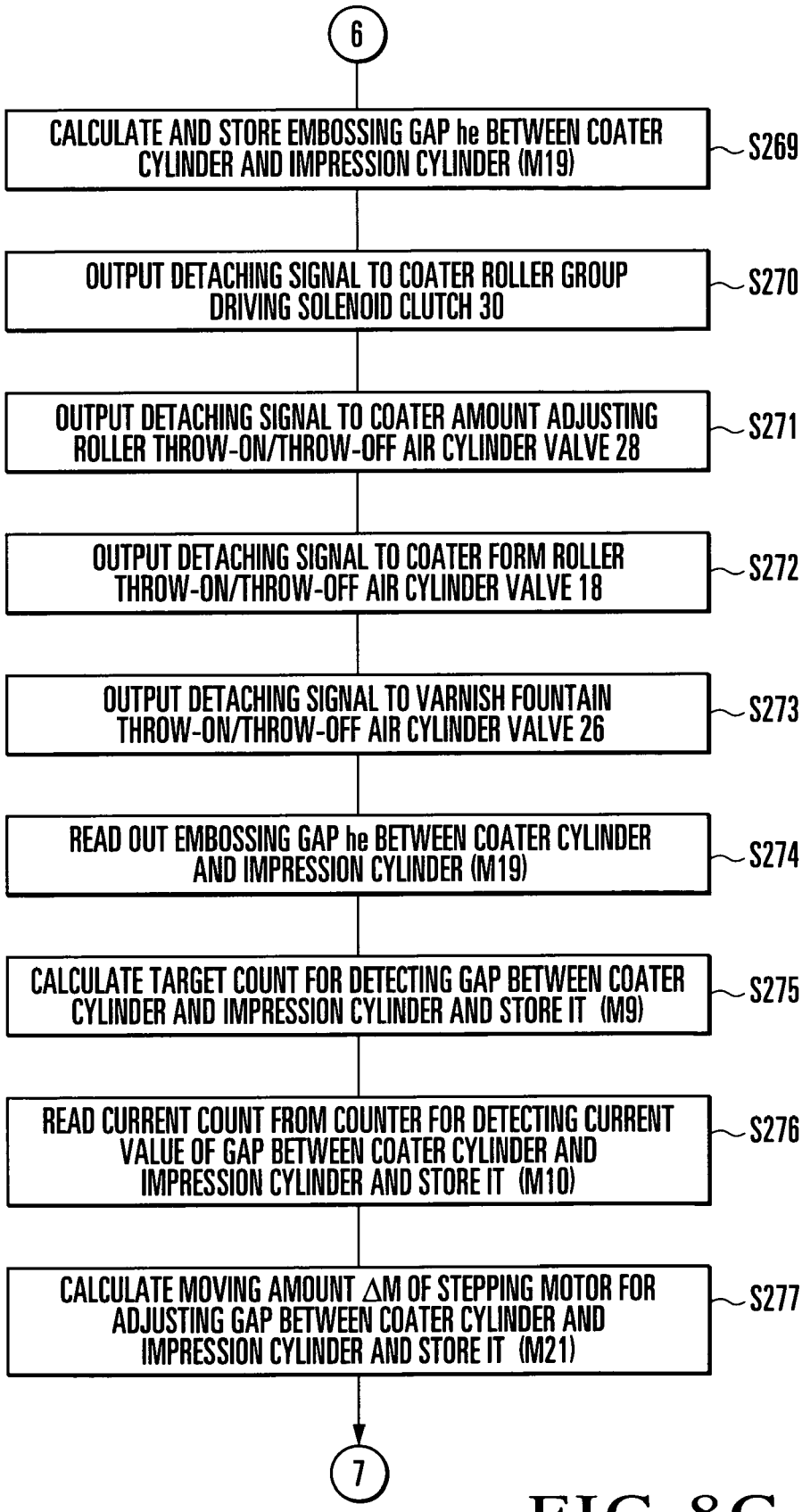
Figure 8H:
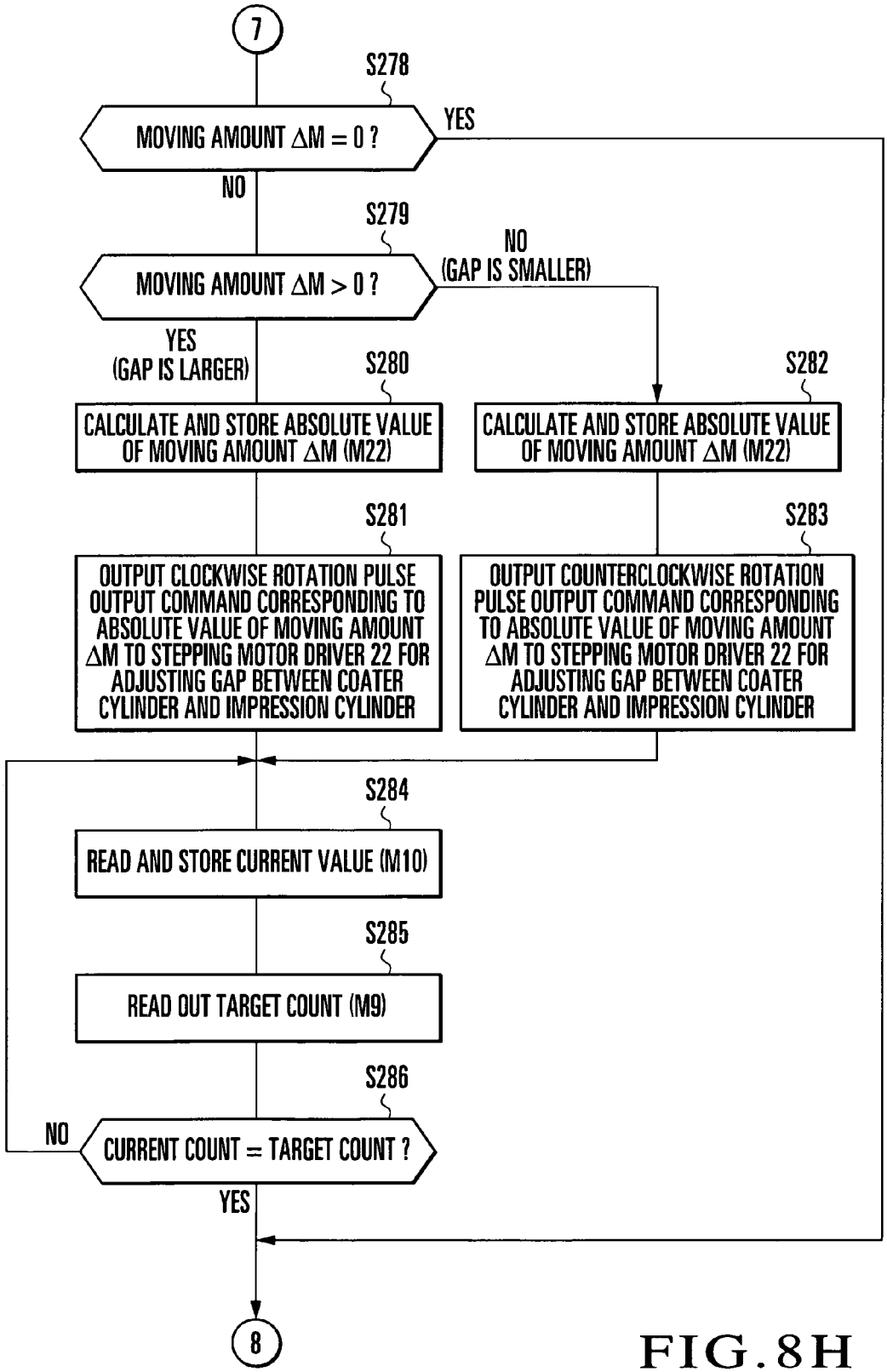

The CPU 1 subtracts the first correction amount $\alpha 2$ of the embossing gap between the coater cylinder and impression cylinder obtained in step S264 and the second correction amount $\alpha 2$ of the embossing gap between the coater cylinder and impression cylinder obtained in step S268 from a reference embossing gap hr between the coater cylinder and impression cylinder obtained in step S1260, to obtain the embossing gap he ($he=hr-\alpha 1-\alpha 2$) between the coater cylinder and impression cylinder, and stores the embossing gap he in the memory M19 (step S269, FIG. 8G).

The CPU 1 then sends a detaching signal to the coater roller group driving solenoid clutch 30 (step S270) to stop rotation of the coater form roller 42, coater amount adjusting roller 47, and coater fountain roller 48. The CPU 1 also sends a detaching signal to the coater amount adjusting roller throw-on/throw-off air cylinder valve 28 (step S271) to detach the coater amount adjusting roller 47 from the coater form roller 42 and coater fountain roller 48. The CPU 1 also sends a detaching signal to the coater form roller throw-on/throw-off air cylinder valve 18 (step S272) to detach the coater form roller 42 from the coater cylinder 41. The CPU 1 also sends a detaching signal to the varnish fountain throw-on/throw-off air cylinder valve 26 (step S273) to detach the varnish fountain 49 from the coater fountain roller 48.

The CPU 1 also reads out the embossing gap he between the coater cylinder and impression cylinder from the memory M19 (step S274), calculates the target count for detecting the gap between the coater and impression cylinder from the readout embossing gap he between the coater cylinder and impression cylinder, and stores the embossing gap he in the memory M9 (step S275). The CPU 1 reads the current count of the counter 24 for detecting the current value of the gap between the coater cylinder and impression cylinder (step S276), subtracts the current count from the target count for detecting the gap between the coater cylinder and impression cylinder to obtain the moving amount $\Delta M$ of the stepping motor for adjusting the gap between the coater cylinder and impression cylinder, and stores the moving amount $\Delta M$ in the memory M21 (step S277).

If the moving amount $\Delta M$ of the stepping motor for adjusting the gap between the coater cylinder and impression cylinder satisfies $\Delta M>0$ (YES in step S279, FIG. 8H), the CPU 1 determines that the current gap h between the coater cylinder and impression cylinder is larger than the target embossing gap he between the coater cylinder and impression cylinder, obtains the absolute value of the moving amount $\Delta M$ from the moving amount $\Delta M$ and stores it in the memory M22 (step S280), and sends a clockwise rotation pulse output command corresponding to the absolute value of the moving amount $\Delta M$ to the motor driver 22 for adjusting the gap between the coater cylinder and impression cylinder (step S281). Thus, the stepping motor 23 for adjusting the gap between the coater cylinder and impression cylinder rotates clockwise to decrease the gap h between the coater cylinder and impression cylinder.

In contrast to this, if the moving amount $\Delta M$ of the stepping motor for adjusting the gap between the coater cylinder and impression cylinder satisfies $\Delta M<0$ (NO in step S279, FIG. 8H), the CPU 1 determines that the current gap h between the coater cylinder and impression cylinder is smaller than the target embossing gap he between the coater cylinder and impression cylinder, obtains the absolute value of the moving amount $\Delta M$ from the moving amount $\Delta M$ and stores it in the memory M22 (step S282), and sends a counterclockwise rotation pulse output command corresponding to the absolute value of the moving amount $\Delta M$ to the motor driver 22 for adjusting the gap between the coater cylinder and impression cylinder (step S283). Thus, the stepping motor 23 for adjusting the gap between the coater cylinder and impression cylinder rotates counterclockwise to increase the gap h between the coater cylinder and impression cylinder.

Figure 8I:
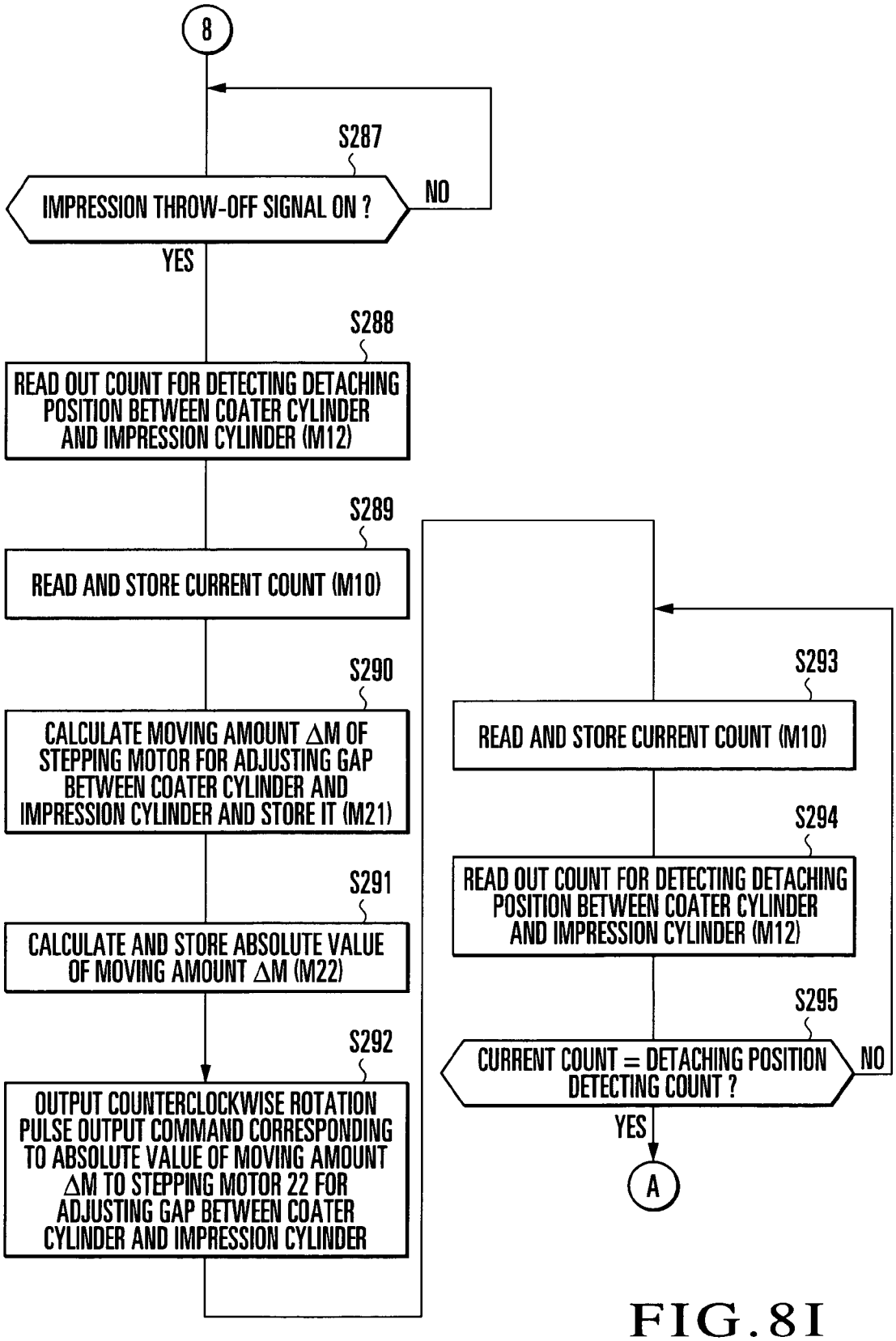

The CPU 1 reads the current count of the counter 24 for detecting the current value of the constantly changing gap between the coater cylinder and impression cylinder (step S284), and compares it with the target count stored in the memory M9 (steps S285 and S286). Upon confirming the fact that the current count is equal to the target count (YES in step S286), the process advances to step S287 (FIG. 8I). Thus, the gap h between the coater cylinder and impression cylinder becomes equal to the target embossing gap he between the coater cylinder and impression cylinder. In step S278, if the moving amount $\Delta M$ of the stepping motor for adjusting the gap between the coater cylinder and impression cylinder is zero, the process does not advance to step S279 but directly advances to step S287.

In step S287, the CPU 1 checks the presence/absence of an input of the impression throw-off signal from the printing press control device 200. During this checking, the impression cylinder 40 and coater cylinder 41 continue rotation. Thus, the embossing plate 45 as the die embosses the paper (printed paper) passing between the coater cylinder 41 and impression cylinder 40.

[End of Embossing Operation]

When printing and embossing are ended and an impression throw-off signal is supplied from the printing press control device 200 (YES in step S287), the CPU 1 reads out a count for detecting the detaching position between the coater cylinder and impression cylinder from the memory M12 (step S288), reads the current count of the counter 24 for detecting the current value of the gap between the coater cylinder and impression cylinder (S289), subtracts the current count from the detaching position detecting count to obtain the moving amount $\Delta M$ of the stepping motor for adjusting the gap between the coater cylinder and impression cylinder, and stores the moving amount $\Delta M$ in the memory M21 (step S29-0). Furthermore, the CPU 1 obtains the absolute value of the moving amount ΔM and stores it in the memory M22 (step S291), and sends a counterclockwise rotation pulse output command corresponding to the absolute value of the moving amount ΔM to the stepping motor driver 22 for adjusting the gap between the coater cylinder and impression cylinder (step S292). Thus, the stepping motor 23 for adjusting the gap between the coater cylinder and impression cylinder rotates counterclockwise, so the gap h between the coater cylinder and impression cylinder increases.

During the counterclockwise rotation of the stepping motor 23 for adjusting the gap between the coater cylinder and impression cylinder, the CPU 1 reads the current count of the counter 24 for detecting the current value of the gap between the coater cylinder and impression cylinder (step S293), and compares it with the count for detecting the detaching position between the coater cylinder and impression cylinder which is read out from the memory M12 (steps S294 and S295). Upon confirming the fact that the current count is equal to the count for detecting the detaching position (YES in step S295), the process returns to step S201 (FIG. 8A).

Thus, the coater cylinder 41 is detached from the impression cylinder 40, and the operation of embossing the printed paper using the coater is ended.

[Calibration]

According to this embodiment, the gap h between the coater cylinder and impression cylinder is adjusted by the stepping motor 23. The stepping motor 23 may cause step out. To prevent this, this embodiment is provided with the calibration switch 21. The stepping motor 23 can be calibrated as needed by turning on the calibration switch 21. For example, on the first business day of a new year, the operator turns on the calibration switch 21 to perform calibration.

When the calibration switch 21 is turned on (YES in step S216, FIG. 8B), the CPU 1 sends a counterclockwise rotation pulse output command corresponding to 1 pulse to the stepping motor driver 22 for adjusting the gap between the coater cylinder and impression cylinder (step S217) and checks the state of the calibration position detection sensor 25 of the stepping motor 23 for adjusting the gap between the coater cylinder and impression cylinder (step S218).

After repeating this operation, when the calibration position detection sensor 25 is turned on (YES in step S218), a reset signal is output to the counter 24 for detecting the current value of the gap between the coater cylinder and impression cylinder (step S219) to set the count of the current value detection counter 24 to zero. Output of the reset signal to the current value detection counter 24 is stopped (step S220), and the counting operation starting from zero of the current value detection counter 24 is resumed.

[Third Embodiment]

Another exemplary coater which also serves as an embossing apparatus will be described as the third embodiment of the switch-over processing apparatus of the present invention.

Figure 9:
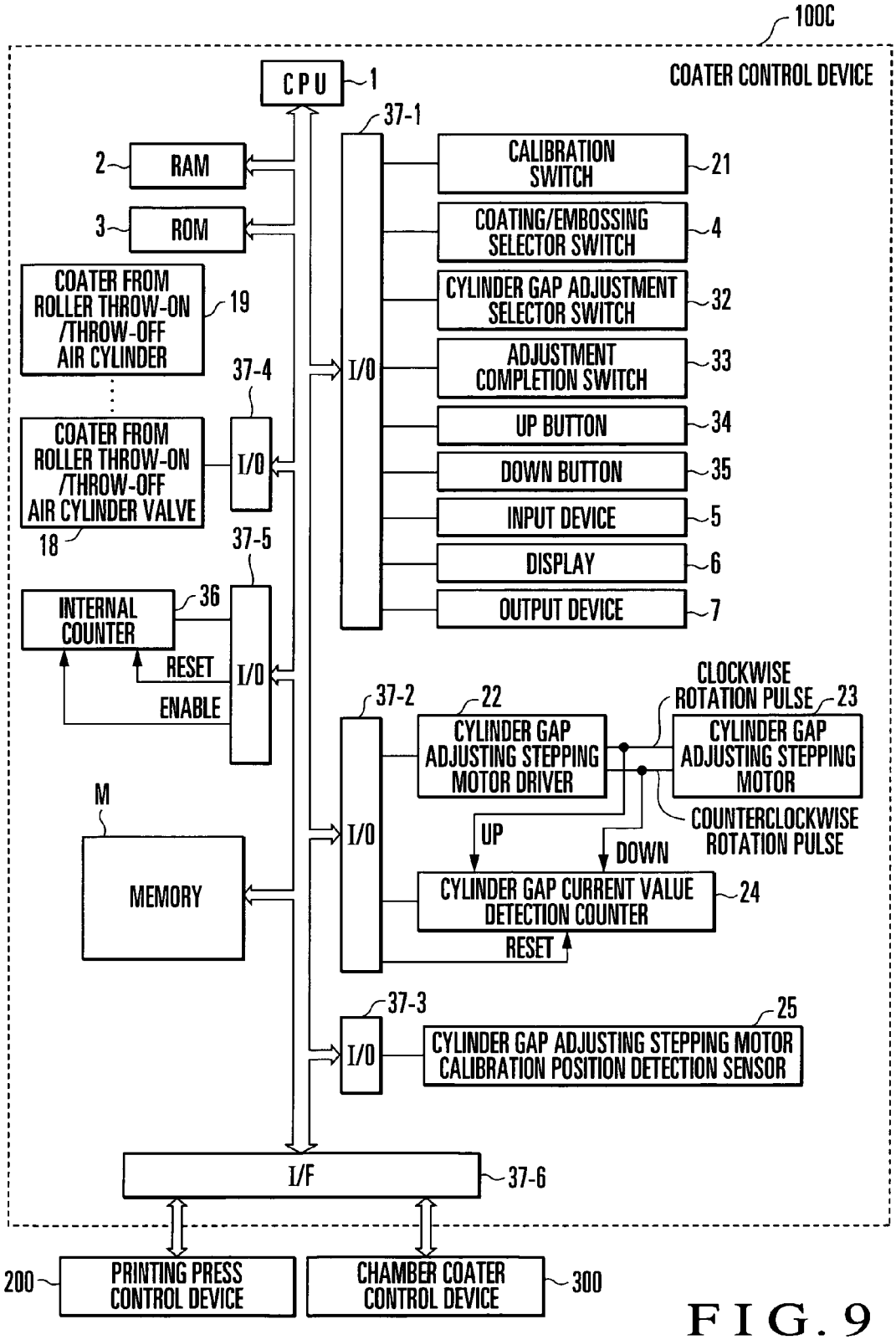
FIG. 9 is a block diagram showing the controller of a coater as the third embodiment of the switch-over processing apparatus of the present invention which also serves as an embossing apparatus.

According to this embodiment, after setting a coating gap hc and embossing gap he at predetermined initial values, the operator adjusts them to appropriate values by teaching. For this purpose, as shown in FIG. 9, a coater control device 100C is provided with an adjustment selector switch 32 for the gap between the coater cylinder and impression cylinder, adjustment completion switch 33, UP button 34, DOWN button 35, and internal counter 36. The internal counter 36 counts clock pulses for operating a CPU 1, thereby measuring the time that has elapsed since the start of operation in the operation state.

Figure 10:
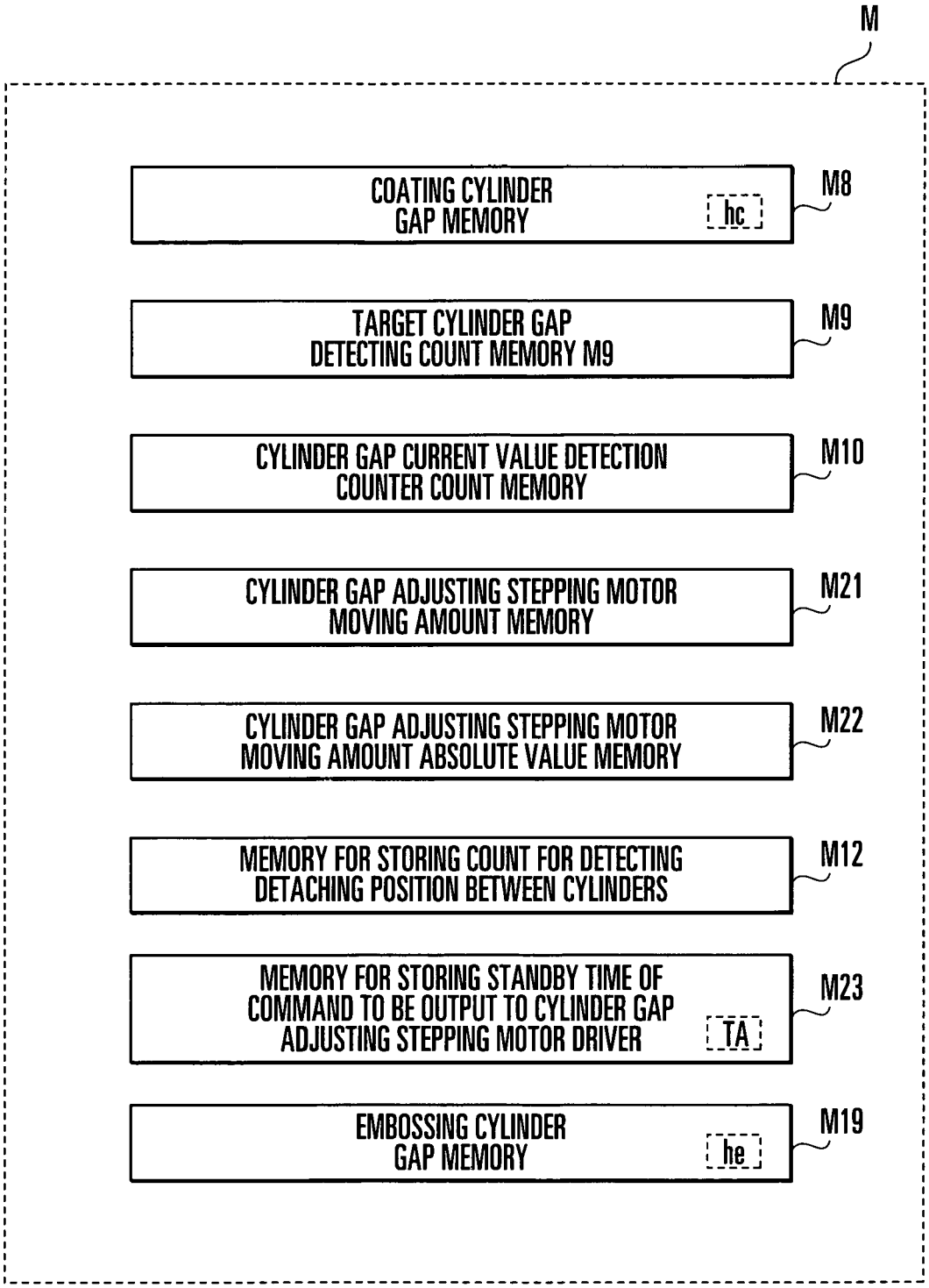
FIG. 10 is a block diagram showing the arrangement of a memory in a coater control device.

As shown in FIG. 10, a memory M comprises a memory M8 for storing the coating gap between the coater cylinder and impression cylinder, a target count memory M9 for detecting the gap between the coater cylinder and impression cylinder, a count memory M10 for a counter for detecting the current value of the gap between the coater cylinder and impression cylinder, a memory M21 for storing the moving amount of a stepping motor for adjusting the gap between the coater cylinder and impression cylinder, a memory M22 for storing the absolute value of the moving amount of the stepping motor for adjusting the gap between the coating cylinder and impression cylinder, a count memory M12 for detecting the detaching position between the coater cylinder and impression cylinder, a memory M23 for storing the standby time of a command to be output to a stepping motor driver for adjusting the gap between the coater cylinder and impression cylinder, and a memory M19 for storing the embossing gap between the coater cylinder and impression cylinder. The memory M8 stores the initial value of an embossing gap hc between the coater cylinder and impression cylinder in advance. The memory M19 stores the initial value of an embossing gap he between the coater cylinder and impression cylinder in advance. The memory M23 stores a standby time TA of the command to be output to the stepping motor driver for adjusting the gap between the coater cylinder and impression cylinder in advance.

According to this embodiment, the coater comprises an impression cylinder 40, coater cylinder 41, coater form roller 42, chamber coater 43, and the like in the same manner as in the arrangement shown in FIG. 1A of the first embodiment. According to this embodiment, a stepping motor 23 adjusts a gap h between the coater cylinder 41 and impression cylinder 40 in the same manner as in the second embodiment.

Processing operation performed by the CPU 1 of the coater control device 100C will be described in accordance with the flowcharts divided into FIGS. 11A to 11H.

[Coating]

When performing coating, the operator mounts a coating plate 44 on the coater cylinder 41 (see FIG. 1A) The operator also switches a coating/embossing selector switch 4 to the coating side.

In this state, when an impression throw-on signal is input from a printing press control device 200 to the coater control device 100C (YES in step S306, FIG. 11A), the CPU 1 reads the preset state of the coating/embossing selector switch 4 (step S307). Upon confirming the fact that the coating/embossing selector switch 4 has been switched to the coating side (YES in step S308), the CPU 1 outputs a contact signal to a coater form roller throw-on/throw-off air cylinder valve 18 (step S309) so that the coater form roller 42 is brought into contact with the coater cylinder 41. Also, the CPU 1 sends a varnish supply start signal to a chamber coater control device 300 (step S310) to start varnish supply to the chamber coater 43.

The CPU 1 reads out the initial value of the coating gap hc between the coater cylinder and impression cylinder from the memory M8 (step S311), calculates the target count for detecting the gap between the coater cylinder and impression cylinder from the readout coating gap hc between the coater cylinder and impression cylinder, and stores the calculated count in the memory M9 (step S312). The CPU 1 reads the current count of a counter 24 for detecting the current value of the gap between the coater cylinder and impression cylinder (step S313), subtracts the current count from the target count for detecting the gap between the coater cylinder and impression cylinder to obtain a moving amount ΔM of the stepping motor for adjusting the gap between the coater cylinder and impression cylinder, and stores the moving amount ΔM in the memory M21 (step S314 in FIG. 11B).

If the moving amount ΔM of the stepping motor for adjusting the gap between the coater cylinder and impression cylinder satisfies ΔM>0 (YES in step S316), it is determined that the current gap h between the coater cylinder and impression cylinder is larger than the target coating gap hc between the coater cylinder and impression cylinder. The CPU 1 then obtains the absolute value of the moving amount ΔM from the moving amount ΔM and stores it in the memory M22 (step S317), and sends a clockwise rotation pulse output command corresponding to the absolute value of the moving amount ΔM to a stepping motor driver 22 for adjusting the gap between the coater cylinder and impression cylinder (step S318). Thus, the stepping motor 23 for adjusting the gap between the coater cylinder and impression cylinder rotates clockwise, so the gap h between the coater cylinder and impression cylinder decreases.

In contrast to this, if the moving amount ΔM of the stepping motor for adjusting the gap between the coater cylinder and impression cylinder is not zero (NO in step S315) but satisfies ΔM<0 (NO in step S316), it is determined that the current gap h between the coater cylinder and impression cylinder is smaller than the target coating gap hc between the coater cylinder and impression cylinder. The CPU 1 then obtains the absolute value of the moving amount ΔM from the moving amount ΔM and stores it in the memory M22 (step S319), and sends a counterclockwise rotation pulse output command corresponding to the absolute value of the moving amount ΔM to the stepping motor driver 22 for adjusting the gap between the coater cylinder and impression cylinder (step S320). Thus, the stepping motor 23 for adjusting the gap between the coater cylinder and impression cylinder rotates counterclockwise, and the gap h between the coater cylinder and impression cylinder increases.

Figure 11A:
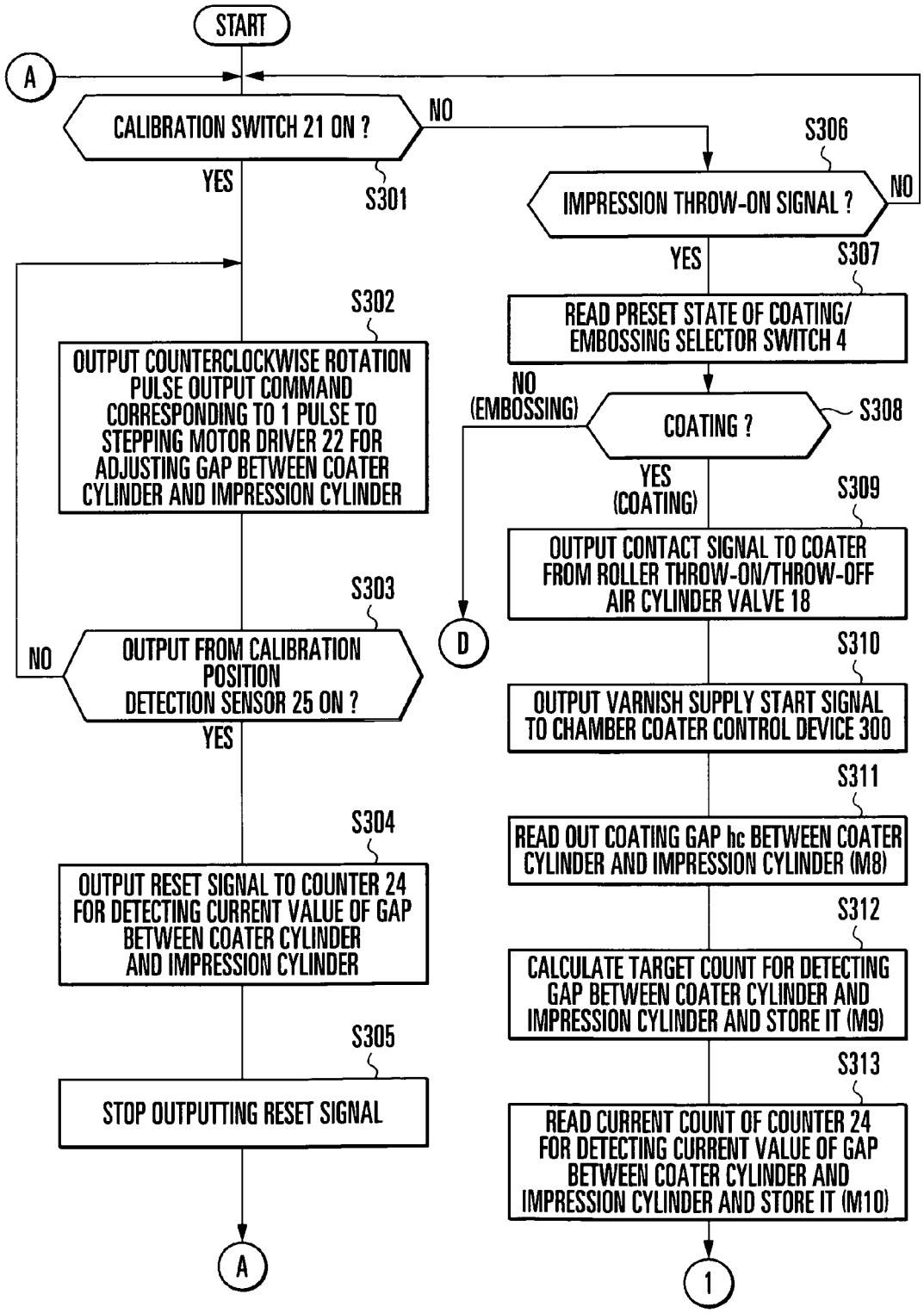
FIGS. 11A to 11H are flowcharts showing processing operation performed by the CPU of the coater control device.
Figure 11B:
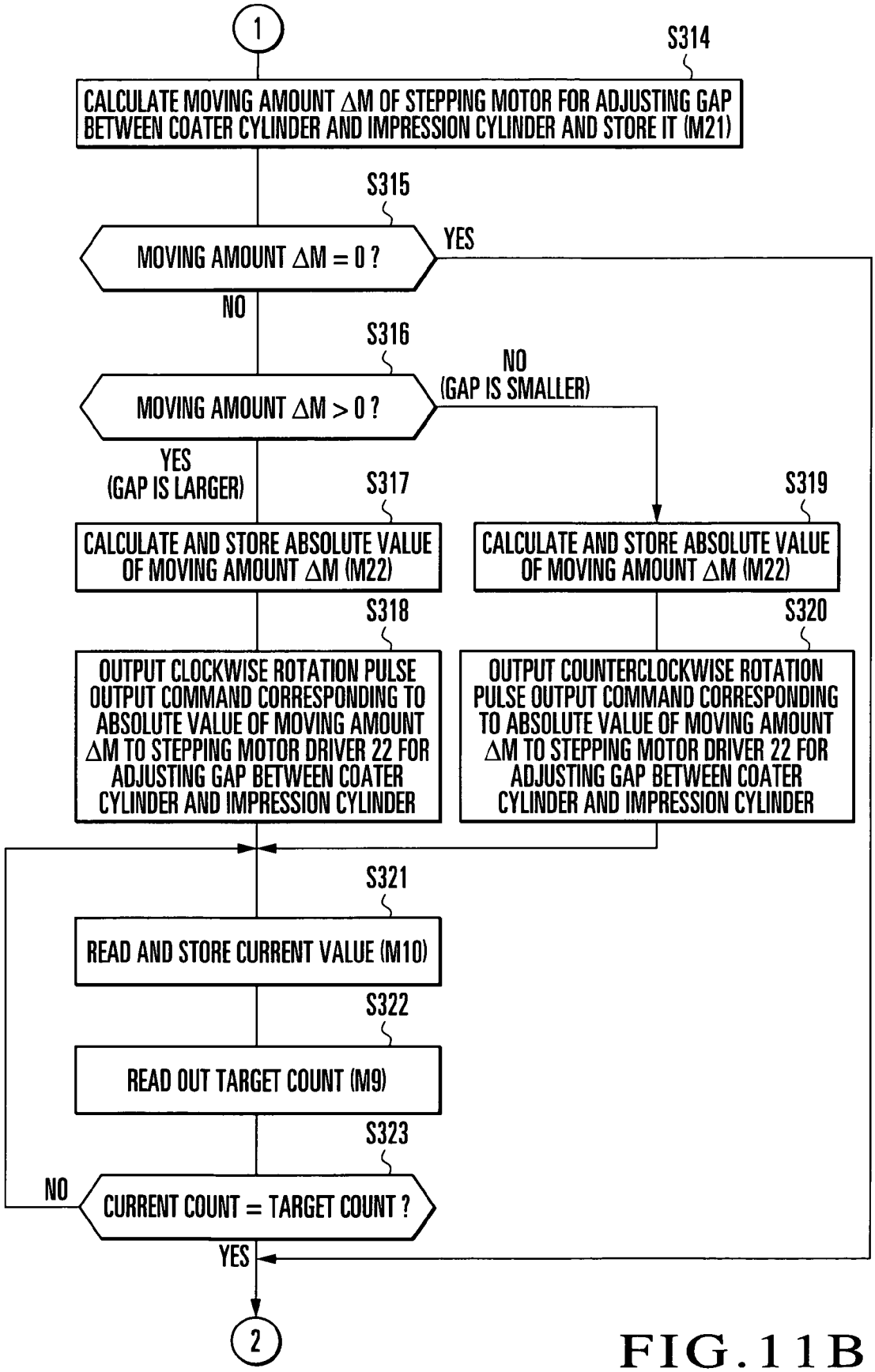
Figure 11C:
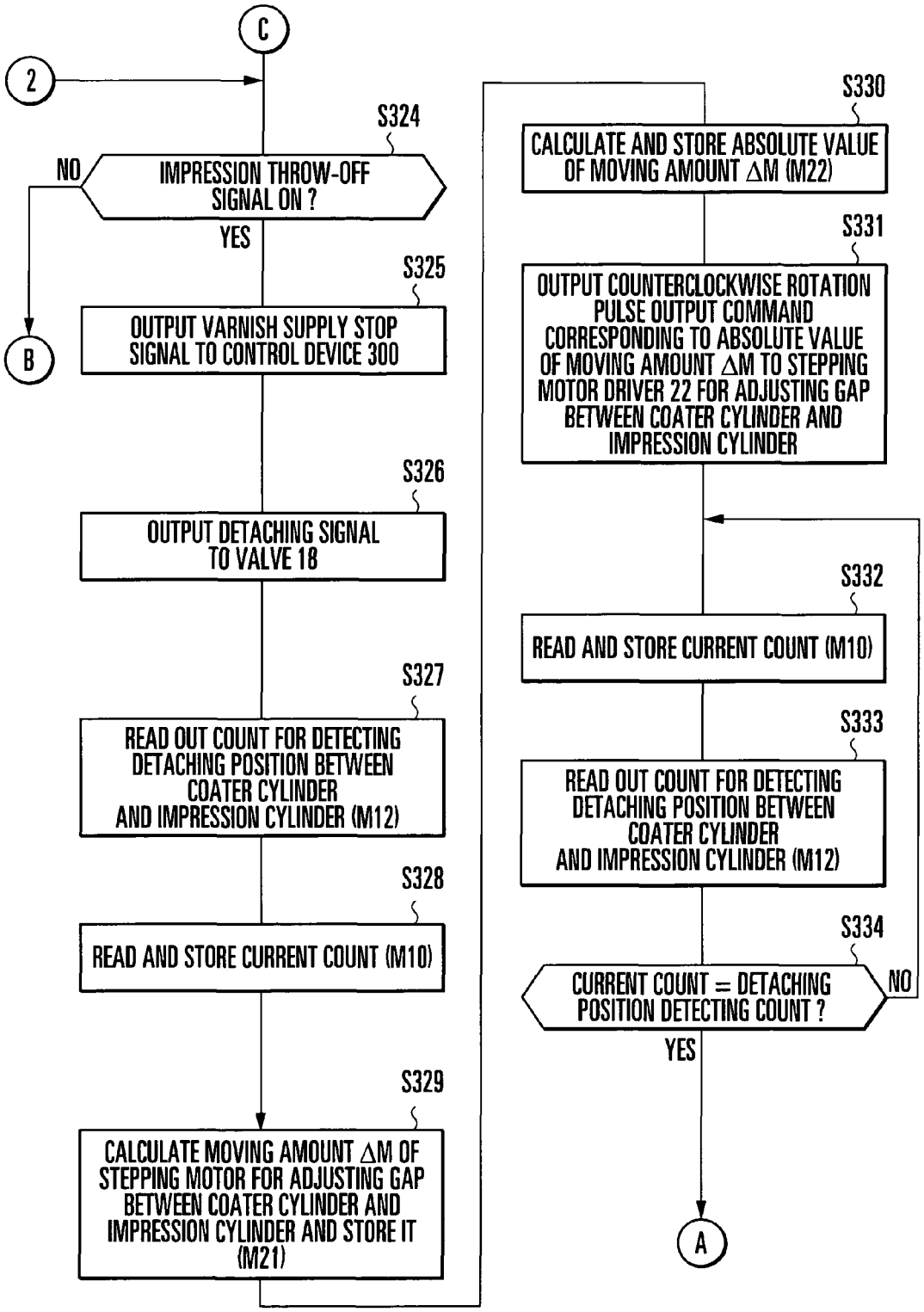
Figure 11D:
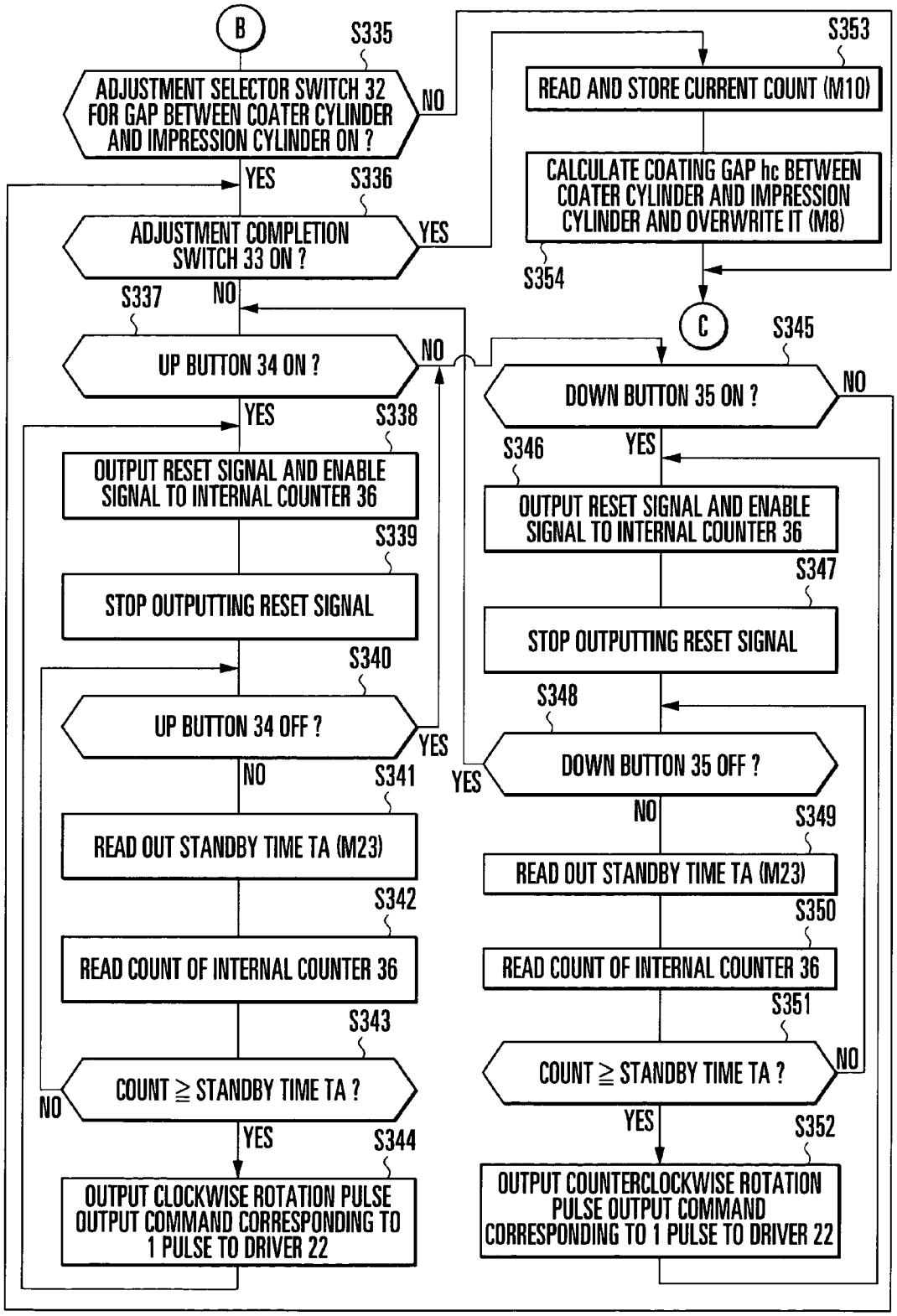
Figure 11E:
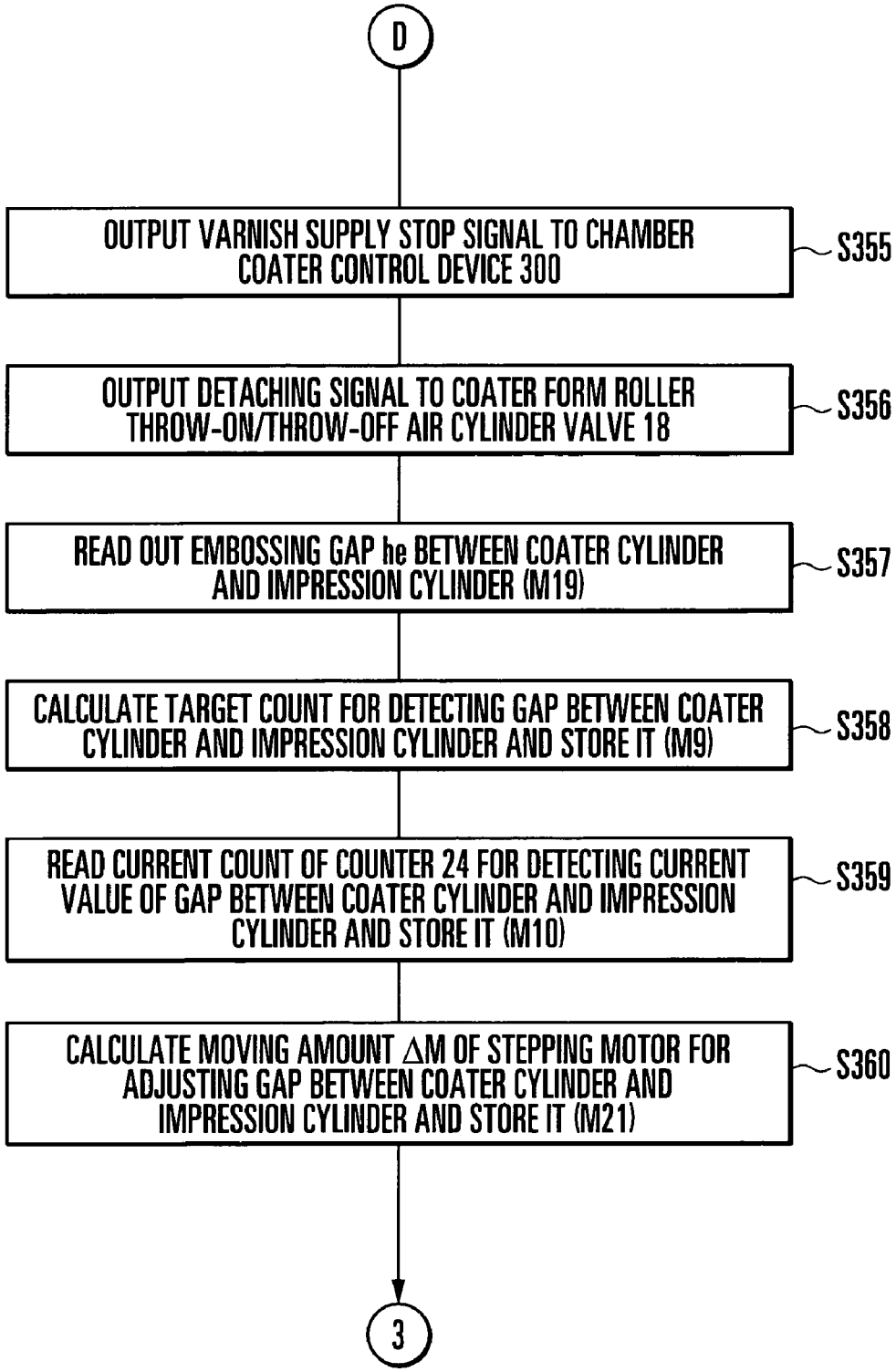
Figure 11F:
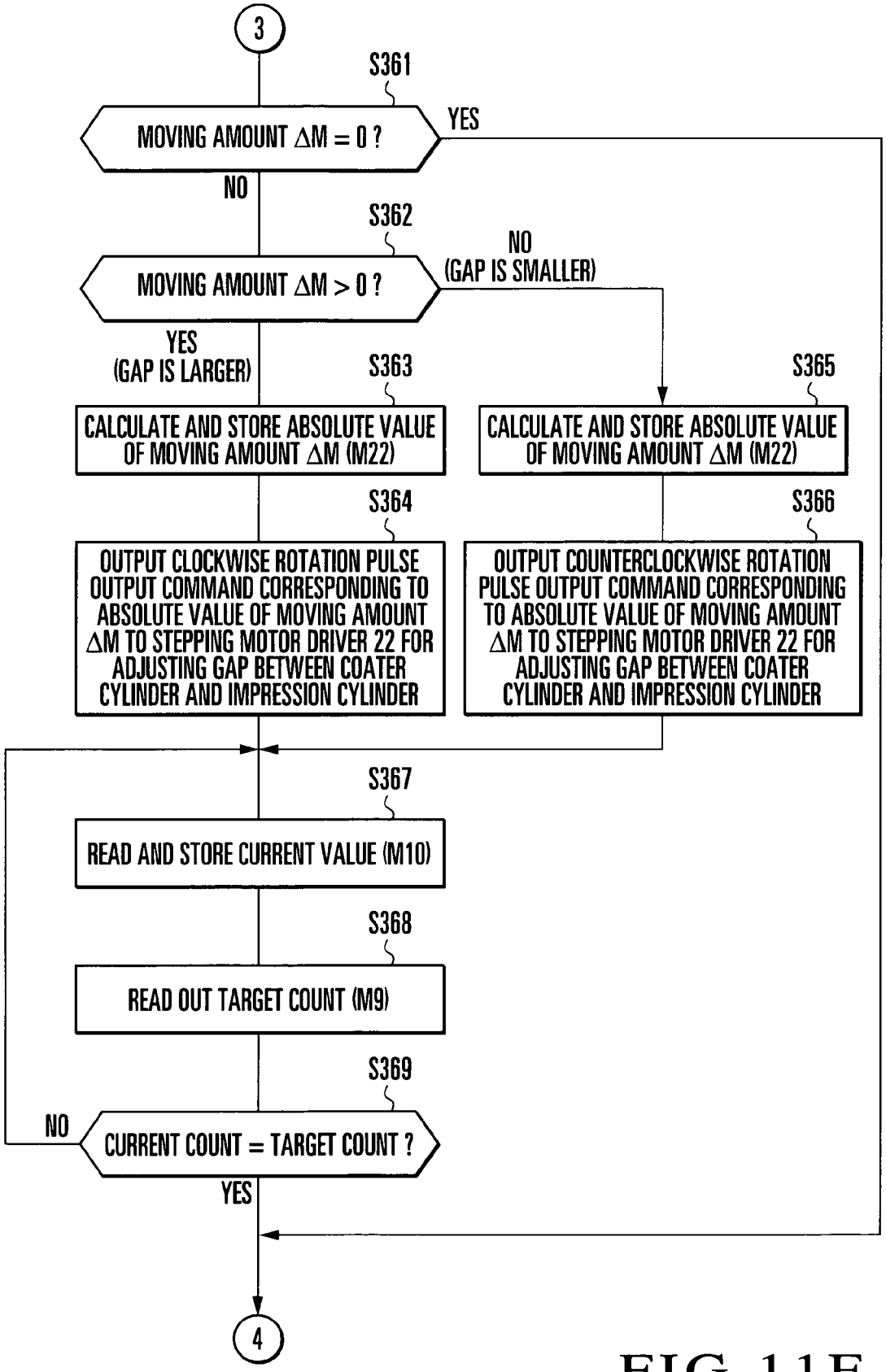

The CPU 1 reads the current count of the counter 24 for detecting the constantly changing current value of the gap between the coater cylinder and impression cylinder (step S321) and compares it with the target count stored in the memory M9 (steps S322 and S323). Upon confirming the fact that the current count is equal to the target count (YES in step S323), the process advances to step S324 (FIG. 11C). Hence, the gap h between the coater cylinder and impression cylinder becomes equal to the target coating gap hc between the coater cylinder and impression cylinder.

The CPU 1 checks the presence/absence of an input of an impression throw-off signal from the printing press control device 200 (step S324). Also, in step S335 (FIG. 11D), the CPU 1 checks the state of the gap adjustment selector switch 32 for adjusting the gap between the coater cylinder and impression cylinder. During this checking, the impression cylinder 40, coater cylinder 41, and coater form roller 42 continue rotation. Thus, varnish from the chamber coater 43 which is supplied to the coating plate 44 is applied to the paper (printed paper) passing between the coater cylinder 41 and impression cylinder 40 and, the paper is sent to the following paper delivery device. In step S315, if the moving amount ΔM of the stepping motor for adjusting the gap between the coater cylinder and impression cylinder is zero, the process does not advance to step S316 but directly advances to step S324.

[Teaching of Coating Gap hc Between Coater Cylinder and Impression Cylinder]

The operator extracts the paper coated with the varnish and checks the varnish coating state. From this checking, if the operator determines that the current gap hc between the coater cylinder and impression cylinder should be adjusted, he turns on the gap adjustment selector switch 32 for adjusting the gap between the coater cylinder and impression cylinder and operates the UP button 34 or DOWN button 35.

While the gap adjustment selector switch 32 for adjusting the gap between the coater cylinder and impression cylinder is ON and the adjustment completion switch 33 is OFF (YES in step S335 and NO in step S336), if the UP button 34 is turned on (YES in step S337), the CPU 1 outputs a reset signal and enable signal to the internal counter 36 (step S338) and then stops outputting the reset signal (step S339). Thus, the internal counter 36 starts counting from zero so the ON time of the UP button 34 is measured as the count of the internal counter 36. When the UP button 34 is turned off (YES in step S340), upon confirming the fact that the DOWN button 35 is OFF (NO in step S345), the process returns to step S336 to prepare for the turn-on operations of the adjustment completion switch 33, UP button 34, and DOWN button 35.

While measuring the ON time of the UP button 34, the CPU 1 reads out the standby time TA of the output command from the memory M23 (step S341) and reads the count of the internal counter 36 (step S342). When the count of the internal counter 36 exceeds the standby time TA (YES in step S343), the CPU 1 outputs a clockwise rotation pulse output command corresponding to 1 pulse to the stepping motor driver 22 for adjusting the gap between the coater cylinder and impression cylinder (step S344). Thus, the stepping motor 23 for adjusting the gap between the coater cylinder and impression cylinder rotates clockwise by an amount corresponding to 1 pulse, and the gap h between the coater cylinder and impression cylinder decreases by an amount corresponding to 1 pulse.

After the CPU 1 outputs the clockwise rotation pulse output command corresponding to 1 pulse to the stepping motor driver 22 for adjusting the gap between the coater cylinder and impression cylinder, the process returns to step S338, so the CPU 1 sends a reset signal and enable signal to the internal counter to restart the internal counter 36 to count from zero (step S339). Thus, while the UP button 34 is ON, each time the standby time TA elapses, a clockwise rotation pulse output command corresponding to 1 pulse is output to the stepping motor driver 22 for adjusting the gap between the coater cylinder and impression cylinder, so the stepping motor 23 for adjusting the gap between the coater cylinder and impression cylinder rotates clockwise by an amount corresponding to 1 pulse, thereby decreasing the gap h between the coater cylinder and impression cylinder by an amount corresponding to 1 pulse.

While the gap adjustment selector switch 32 for adjusting the gap between the coater cylinder and impression cylinder is ON (YES in step S335), when the DOWN button 35 is turned on (YES in step S345), the CPU 1 outputs a reset signal and enable signal to the internal counter 36 (step S346) and then stops outputting the reset signal (step S347). Thus, the internal counter 36 starts counting from zero, and the ON time of the DOWN button 35 is measured as the count of the internal counter 36. When the DOWN button 35 is turned off (YES in step S348), upon confirming the fact that the UP button 34 and DOWN button 35 are OFF (NO in steps S337 and S345), the process returns to step S336 to prepare for the turn-on operations of the adjustment completion switch 33, UP button 34, and DOWN button 35.

While measuring the ON time of the DOWN button 35, the CPU 1 reads out the standby time TA of the output command from the memory M23 (step S349) and reads the count of the internal counter 36 (step S350). When the count of the internal counter 36 exceeds the standby time TA (YES in step S351), the CPU 1 outputs a counterclockwise rotation pulse output command corresponding to 1 pulse to the stepping motor driver 22 for adjusting the gap between the coater cylinder and impression cylinder (step S352). Thus, the stepping motor 23 for adjusting the gap between the coater cylinder and impression cylinder rotates counterclockwise by an amount corresponding to 1 pulse, and the gap h between the coater cylinder and impression cylinder increases by an amount corresponding to 1 pulse.

After the CPU 1 outputs the counterclockwise rotation pulse output command corresponding to 1 pulse to the stepping motor driver 22 for adjusting the gap between the coater cylinder and impression cylinder, the process returns to step S346, so the CPU 1 sends a reset signal and enable signal to the internal counter (step S346) to restart the internal counter 36 to count from zero (step S347). Thus, while the DOWN button 35 is ON, each time the standby time TA elapses, a counterclockwise rotation pulse output command corresponding to 1 pulse is output to the stepping motor driver 22 for adjusting the gap between the coater cylinder and impression cylinder, so the stepping motor 23 for adjusting the gap between the coater cylinder and impression cylinder rotates counterclockwise by an amount corresponding to 1 pulse, thereby increasing the gap h between the coater cylinder and impression cylinder by an amount corresponding to 1 pulse.

After manually adjusting the gap hc between the coater cylinder and impression cylinder in this manner, the operator turns on the adjustment completion switch 33. Then, the CPU 1 checks that the adjustment completion switch 33 is ON (YES in step S336), reads the count of the counter 24 for detecting the current value of the gap between the coater cylinder and impression cylinder at this time (step S353), obtains the adjusted gap hc between the coater cylinder and impression cylinder from the count of the counter 24 for detecting the current value of the gap between the coater cylinder and impression cylinder, and overwrites it in the memory M8 as the teaching value of the coating gap hc between the coater cylinder and impression cylinder (step S354). Then, the process returns to step S324 (FIG. 1C).

[End of Coating Operation]

When printing and coating are ended and an impression throw-off signal is supplied from the printing press control device 200 (YES in step S324, FIG. 11C), the CPU 1 sends a varnish supply stop signal to the chamber coater control device 300 (step S325) to stop varnish supply to the chamber coater 43. The CPU 1 also sends a detaching signal to the coater form roller throw-on/throw-off air cylinder valve 18 (step S326) to detach the coater form roller 42 from the coater cylinder 41.

The CPU 1 then reads out the count for detecting the detaching position between the coater cylinder and impression cylinder from the memory M12 (step S327), reads the current count of the counter 24 for detecting the current value of the gap between the coater cylinder and impression cylinder (step S328), subtracts the current count from the detaching position detecting count to obtain the moving amount ΔM of the stepping motor for adjusting the gap between the coater cylinder and impression cylinder, and stores the moving amount ΔM in the memory M21 (step S329). The CPU 1 also obtains the absolute value of the moving amount ΔM from the moving amount ΔM and stores it in the memory M22 (step S330), and sends a counterclockwise rotation pulse output command corresponding to the absolute value of the moving amount ΔM to the stepping motor driver 22 for adjusting the gap between the coater cylinder and impression cylinder (step S331). Thus, the stepping motor 23 for adjusting the gap between the coater cylinder and impression cylinder rotates counterclockwise to increase the gap h between the coater cylinder and impression cylinder.

The CPU 1 reads the current count of the counter 24 for detecting the current value of the instantaneously changing gap between the coater cylinder and impression cylinder (step S332), and compares it with the count for detecting the detaching position between the coater cylinder and impression cylinder which is stored in the memory M12 (steps S333 and S334). Upon confirming the fact that the current count is equal to the count for detecting the detaching position between the coater cylinder and impression cylinder (YES in step S334), the process returns to step S301 (FIG. 11A). Thus, the coater cylinder 41 is detached from the impression cylinder 40, and the operation of coating the printed paper using the coater is ended.

[Embossing]

When performing embossing operation, the operator mounts an embossing plate 45 on the coater cylinder 41 in place of the coating plate 44 (see FIG. 1B). An embossing packing material 46 is interposed between the embossing plate 45 and coater cylinder 41. Also, the operator switches the coating/embossing selector switch 4 to the embossing side.

In this case, when an impression throw-on signal is input from the printing press control device 200 to the coater control device 100C (YES in step S306, FIG. 11A), the CPU 1 reads the preset state of the coating/embossing selector switch 4 (step S307). Upon confirming the fact that the coating/embossing selector switch 4 is switched to the embossing side (NO in step S308), the CPU 1 sends a varnish supply stop signal to the chamber coater control device 300 (step S355, FIG. 11E) to stop varnish supply to the chamber coater 43. The CPU 1 also outputs a detaching signal to the coater form roller throw-on/throw-off air cylinder valve 18 (step S356) to detach the coater form roller 42 from the coater cylinder 41.

The CPU 1 also reads out the initial value of the embossing gap he between the coater cylinder and impression cylinder from the memory M19 (step S357), calculates the target count for detecting the gap between the coater and impression cylinder from the readout embossing gap he between the coater cylinder and impression cylinder, and stores the target count in the memory M9 (step S358). The CPU 1 reads the current count of the counter 24 for detecting the current value of the gap between the coater cylinder and impression cylinder (step S359), subtracts the current count from the target count for detecting the gap between the coater cylinder and impression cylinder to obtain the moving amount ΔM of the stepping motor for adjusting the gap between the coater cylinder and impression cylinder, and stores the moving amount ΔM in the memory M21 (step S360).

If the moving amount ΔM of the stepping motor for adjusting the gap between the coater cylinder and impression cylinder satisfies ΔM>0 (YES in step S362, FIG. 11F), the CPU 1 determines that the current gap h between the coater cylinder and impression cylinder is larger than the target embossing gap he between the coater cylinder and impression cylinder, obtains the absolute value of the moving amount ΔM from the moving amount ΔM and stores it in the memory M22 (step S363), and sends a clockwise rotation pulse output command corresponding to the absolute value of the moving amount ΔM to the motor driver 22 for adjusting the gap between the coater cylinder and impression cylinder (step S364). Thus, the stepping motor 23 for adjusting the gap between the coater cylinder and impression cylinder rotates clockwise to decrease the gap h between the coater cylinder and impression cylinder.

In contrast to this, if the moving amount ΔM of the stepping motor for adjusting the gap between the coater cylinder and impression cylinder satisfies ΔM<0 (NO in step S362), the CPU 1 determines that the current gap h between the coater cylinder and impression cylinder is smaller than the target embossing gap he between the coater cylinder and impression cylinder, obtains the absolute value of the moving amount ΔM from the moving amount ΔM and stores the absolute value in the memory M22 (step S365), and sends a counterclockwise rotation pulse output command corresponding to the absolute value of the moving amount ΔM to the motor driver 22 for adjusting the gap between the coater cylinder and impression cylinder (step S366). Thus, the stepping motor 23 for adjusting the gap between the coater cylinder and impression cylinder rotates counterclockwise to increase the gap h between the coater cylinder and impression cylinder.

Figure 11G:
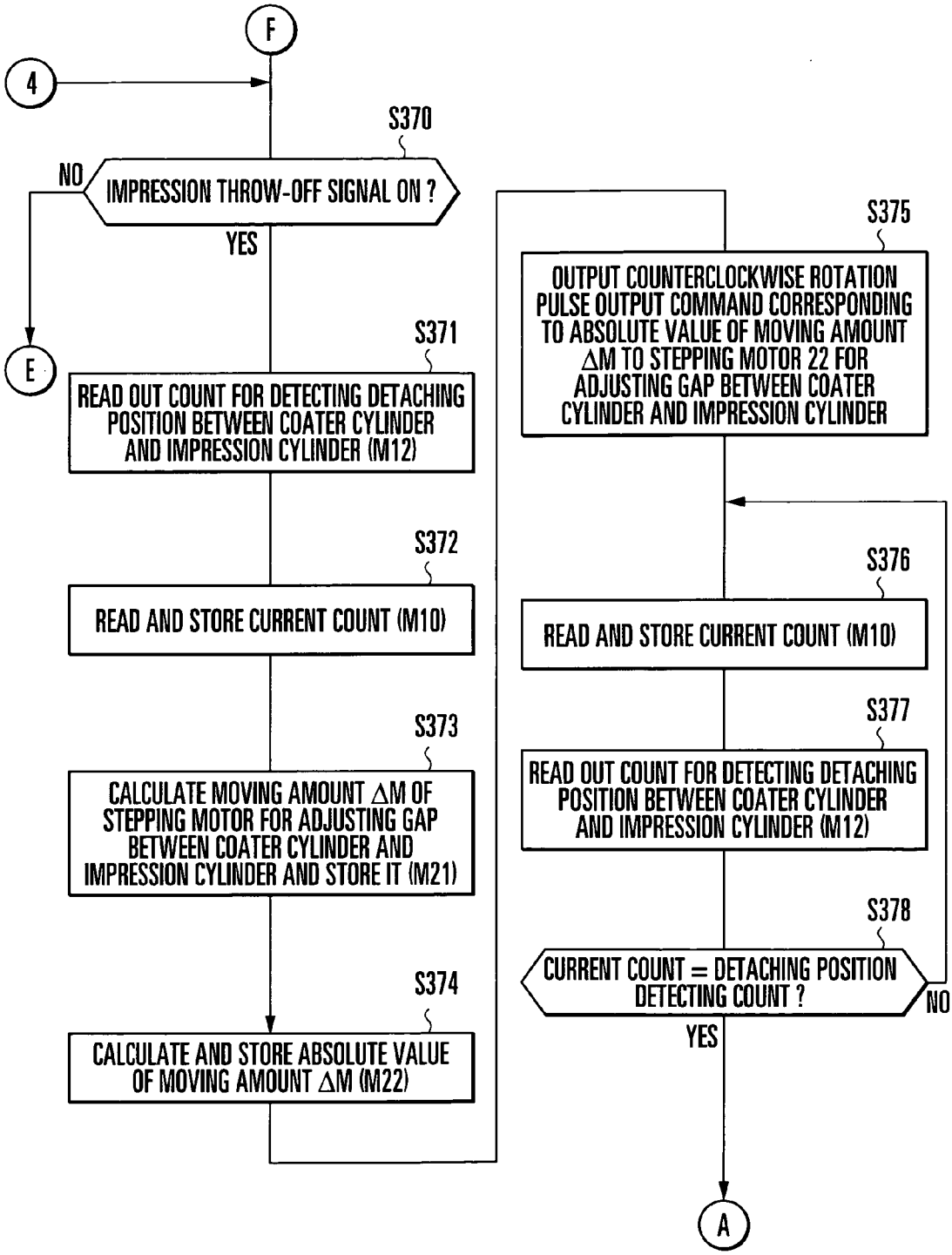

The CPU 1 reads the current count of the counter 24 for detecting the current value of the constantly changing gap between the coater cylinder and impression cylinder (step S367), and compares it with the target count stored in the memory M9 (steps S368 and S369). Upon confirming the fact that the current count is equal to the target count (YES in step S369), the process advances to step S370 (FIG. 11G). Thus, the gap h between the coater cylinder and impression cylinder becomes equal to the target embossing gap he between the coater cylinder and impression cylinder.

Figure 11H:
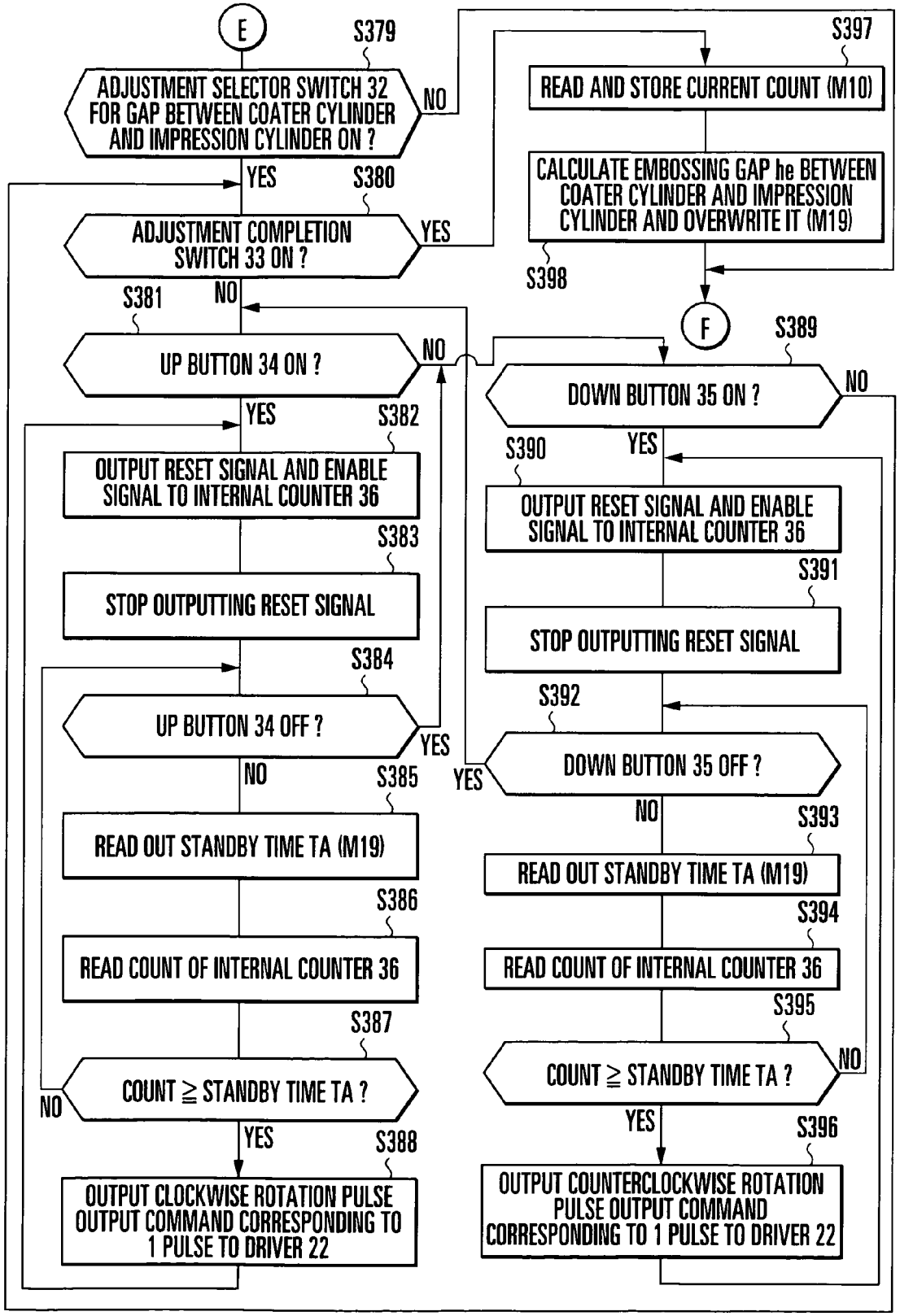

The CPU 1 checks the presence/absence of an input of the impression throw-off signal from the printing press control device 200 (step S370), and checks the state of the gap adjustment selector switch 32 for the gap between the coater cylinder and impression cylinder in step S379 (FIG. 11H). During this checking, the impression cylinder 40 and coater cylinder 41 continue rotation. Thus, the embossing plate 45 as the die embosses the paper (printed paper) passing between the coater cylinder 41 and impression cylinder 40. In step S361, if the moving amount ΔM of the stepping motor for adjusting the gap between the coater cylinder and impression cylinder is zero, the process does not advance to step S362 but directly advances to step S370.

[Teaching of Embossing Gap hc Between Coater Cylinder and Impression Cylinder]

The operator extracts the embossed paper and checks the embossing state. From this checking, if the operator determines that the gap he between the coater cylinder and impression cylinder should be adjusted, he turns on the gap adjustment selector switch 32 for adjusting the gap between the coater cylinder and impression cylinder and operates the UP button 34 or DOWN button 35.

While the gap adjustment selector switch 32 for adjusting the gap between the coater cylinder and impression cylinder is ON (YES in step S379, FIG. 11H), if the UP button 34 is turned on (YES in step S381), the CPU 1 outputs a reset signal and enable signal to the internal counter 36 (step S382) and then stops outputting the reset signal (step S383). Thus, the internal counter 36 starts counting from zero so the ON time of the UP button 34 is measured as the count of the internal counter 36. When the UP button 34 is turned off (YES in step S384), upon confirming the fact that the DOWN button 35 is OFF (NO in step S389), the process returns to step S380 to prepare for the turn-on operations of the adjustment completion switch 33, UP button 34, and DOWN button 35.

While measuring the ON time of the UP button 34, the CPU 1 reads out the standby time TA of the output command from the memory M23 (step S385) and reads the count of the internal counter 36 (step S386). When the count of the internal counter 36 exceeds the standby time TA (YES in step S387), the CPU 1 outputs a clockwise rotation pulse output command corresponding to 1 pulse to the stepping motor driver 22 for adjusting the gap between the coater cylinder and impression cylinder (step S388). Thus, the stepping motor 23 for adjusting the gap between the coater cylinder and impression cylinder rotates clockwise by an amount corresponding to 1 pulse, and the gap h between the coater cylinder and impression cylinder decreases by an amount corresponding to 1 pulse.

After the CPU 1 outputs the clockwise rotation pulse output command corresponding to 1 pulse to the stepping motor driver 22 for adjusting the gap between the coater cylinder and impression cylinder, the process returns to step S382, so the CPU 1 sends a reset signal and enable signal to the internal counter to restart the internal counter 36 to count from zero (step S383). Thus, while the UP button 34 is ON, each time the standby time TA elapses, a clockwise rotation pulse output command corresponding to 1 pulse is output to the stepping motor driver 22 for adjusting the gap between the coater cylinder and impression cylinder, so the stepping motor 23 for adjusting the gap between the coater cylinder and impression cylinder rotates clockwise by an amount corresponding to 1 pulse, thereby decreasing the gap h between the coater cylinder and impression cylinder by an amount corresponding to 1 pulse.

While the gap adjustment selector switch 32 for adjusting the gap between the coater cylinder and impression cylinder is ON (YES in step S379), when the DOWN button 35 is turned on (YES in step S389), the CPU 1 outputs a reset signal and enable signal to the internal counter 36 (step S390) and successively stops outputting the reset signal (step S391). Thus, the internal counter 36 starts counting from zero, and the ON time of the DOWN button 35 is measured as the count of the internal counter 36. When the DOWN button 35 is turned off (YES in step S392), upon confirming the fact that the UP button 34 and DOWN button 35 are OFF (NO in steps S381 and S389), the process returns to step S380 to prepare for the turn-on operations of the adjustment completion switch 33, UP button 34, and DOWN button 35.

While measuring the ON time of the DOWN button 35, the CPU 1 reads out the standby time TA of the output command from the memory M23 (step S393) and reads the count of the internal counter 36 (step S394). When the count of the internal counter 36 exceeds the standby time TA (YES in step S395), the CPU 1 outputs a counterclockwise rotation pulse output command corresponding to 1 pulse to the stepping motor driver 22 for adjusting the gap between the coater cylinder and impression cylinder (step S396). Thus, the stepping motor 23 for adjusting the gap between the coater cylinder and impression cylinder rotates counterclockwise by an amount corresponding to 1 pulse, and the gap h between the coater cylinder and impression cylinder increases by an amount corresponding to 1 pulse.

After the CPU 1 outputs the counterclockwise rotation pulse output command corresponding to 1 pulse to the stepping motor driver 22 for adjusting the gap between the coater cylinder and impression cylinder, the process returns to step S390, so the CPU 1 sends a reset signal and enable signal to the internal counter to restart the internal counter 36 to count from zero (step S391). Thus, while the DOWN button 35 is ON, each time the standby time TA read out from the memory M23 elapses, a counterclockwise rotation pulse output command corresponding to 1 pulse is output to the stepping motor driver 22 for adjusting the gap between the coater cylinder and impression cylinder, so the stepping motor 23 for adjusting the gap between the coater cylinder and impression cylinder rotates counterclockwise by an amount corresponding to 1 pulse, thereby increasing the gap h between the coater cylinder and impression cylinder by an amount corresponding to 1 pulse.

After manually adjusting the gap hc between the coater cylinder and impression cylinder in this manner, the operator turns on the adjustment completion switch 33. Then, the CPU 1 checks that the adjustment completion switch 33 is ON (YES in step S380), reads the count of the counter 24 for detecting the current value of the gap between the coater cylinder and impression cylinder at this time (step S397), obtains the adjusted gap he between the coater cylinder and impression cylinder from the count of the counter 24 for detecting the current value of the gap between the coater cylinder and impression cylinder, and overwrites the adjusted gap he on the memory M19 as the teaching value of the embossing gap he between the coater cylinder and impression cylinder (step S398). Then, the process returns to step S370 (FIG. 11G).

[End of Embossing Operation]

When printing and embossing are ended and an impression throw-off signal is supplied from the printing press control device 200 (YES in step S370, FIG. 11G), the CPU 1 reads out the count for detecting the detaching position between the coater cylinder and impression cylinder from the memory M12 (step S371), reads the current count of the counter 24 for detecting the current value of the gap between the coater cylinder and impression cylinder (step S372), subtracts the current count from the detaching position detecting count to obtain the moving amount ΔM of the stepping motor for adjusting the gap between the coater cylinder and impression cylinder, and stores the moving amount ΔM in the memory M21 (step S373). The CPU 1 also obtains the absolute value of the moving amount ΔM from the moving amount ΔM and stores it in the memory M22 (step S374), and sends a counterclockwise rotation pulse output command corresponding to the absolute value of the moving amount ΔM to the stepping motor driver 22 for adjusting the gap between the coater cylinder and impression cylinder (step S375). Thus, the stepping motor 23 for adjusting the gap between the coater cylinder and impression cylinder rotates counterclockwise to increase the gap h between the coater cylinder and impression cylinder.

The CPU 1 reads the current count of the counter 24 for detecting the current value of the constantly changing gap between the coater cylinder and impression cylinder (step S376), and compares it with the count for detecting the detaching position between the coater cylinder and impression cylinder which is stored in the memory M12 (steps S377 and S378). Upon confirming the fact that the current count is equal to the count for detecting the detaching position between the coater cylinder and impression cylinder (YES in step S378), the process returns to step S301 (FIG. 11A). Thus, the coater cylinder 41 is detached from the impression cylinder 40, and the operation of embossing the printed paper using the coater is ended.

[Calibration]

When the calibration switch 21 is turned on (YES in step S301, FIG. 11A), the CPU 1 sends a counterclockwise rotation pulse output command corresponding to 1 pulse to the stepping motor driver 22 for adjusting the gap between the coater cylinder and impression cylinder (step S302) and checks the state of the calibration position detection sensor 25 of the stepping motor 23 for adjusting the gap between the coater cylinder and impression cylinder (step S303).

After repeating this operation, when the calibration position detection sensor 25 is turned on (YES in step S303), a reset signal is output to the counter 24 for detecting the current value of the gap between the coater cylinder and impression cylinder (step S304) to set the count of the current value detection counter 24 to zero. Output of the reset signal to the current value detection counter 24 is stopped (step S305), and the counting operation starting from zero of the current value detection counter 24 is resumed.

[Fourth Embodiment]

An exemplary web offset printing press which also serves as an embossing apparatus will be described as the fourth embodiment of the switch-over processing apparatus of the present invention.

Figure 12A:
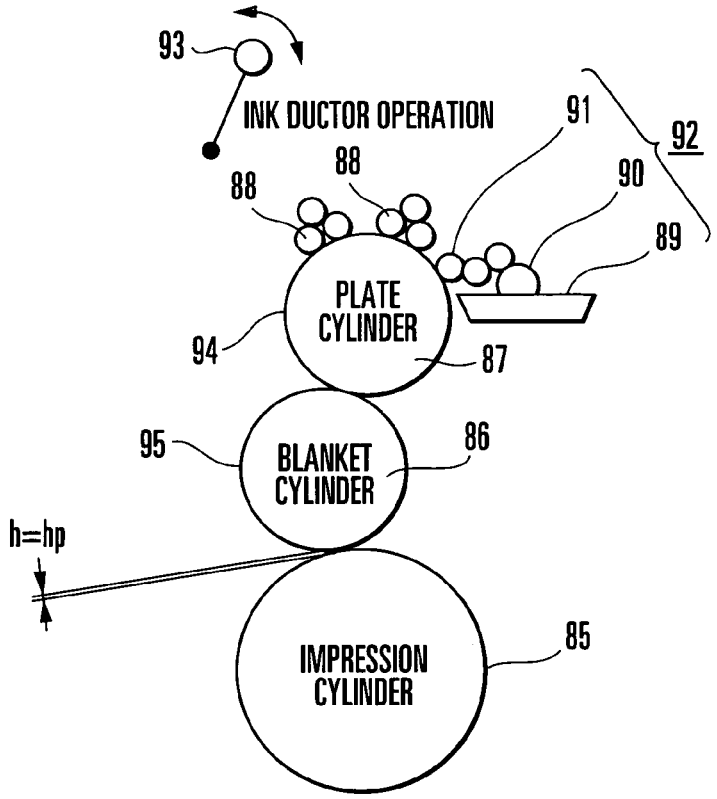
FIG. 12A is a view showing a state in which a printing plate is mounted on a blanket cylinder in the printing unit of a web offset printing press as the fourth embodiment of the switch-over processing apparatus of the present invention which also serves as an embossing apparatus.

The web offset printing press according to this embodiment comprises a plurality of printing units, and each printing unit comprises an impression cylinder 85, a blanket cylinder 86, a plate cylinder 87, ink form rollers 88, a dampening unit 92 using a fountain pan, an ink ductor roller 93, and the like, as shown in FIG. 12A. This arrangement is described in, e.g., reference 5 (Japanese Patent Laid-Open No. 7-299897), reference 6 (Japanese Patent Laid-Open No. 5-147200), reference 7 (Japanese Patent Laid-Open No. 3-207653), and reference 8 (Japanese Patent Laid-Open No. 3-205152). The blanket cylinder 86 opposes the impression cylinder 85, the plate cylinder 87 opposes the blanket cylinder 86, and the ink form rollers 88 oppose the plate cylinder 87.

The dampening unit 92 comprises a fountain pan 89, a water fountain roller 90 the outer surface of which is dipped in water reserved in the fountain pan 89, water form rollers 91 located between the water fountain roller 90 and plate cylinder 87, and the like. The ink ductor roller 93 supplies ink reserved in an ink fountain (not shown) to the ink form rollers 88 through an ink roller group by ink ductor operation. A plate 94 is mounted on the plate cylinder 87, and a blanket 95 is mounted on the blanket cylinder 86.

In the following description, "a mechanism for adjusting the gap between the blanket cylinder and impression cylinder" is disclosed in reference 5, "a mechanism for stopping the ductor operation of the ink ductor roller" is described in reference 6, "a mechanism for throwing on/off the ink form roller" is described in reference 7, and "a mechanism for throwing on/off the water form roller and a mechanism for driving the water fountain roller" are described in reference 8, and will not be described in detail.

In this printing unit, when performing printing, as shown in FIG. 12A, the blanket cylinder 86 is set in an impression thrown-on state with respect to the impression cylinder 85 and plate cylinder 87, and a gap h between the blanket cylinder 86 and impression cylinder 85 is set to a printing gap hp. The ink form rollers 88 are in contact with the plate cylinder 87, the water form rollers 91 are in contact with the plate cylinder 87 and water fountain roller 90, and the ink ductor roller 93 is set in the ductor operation state.

Figure 12B:
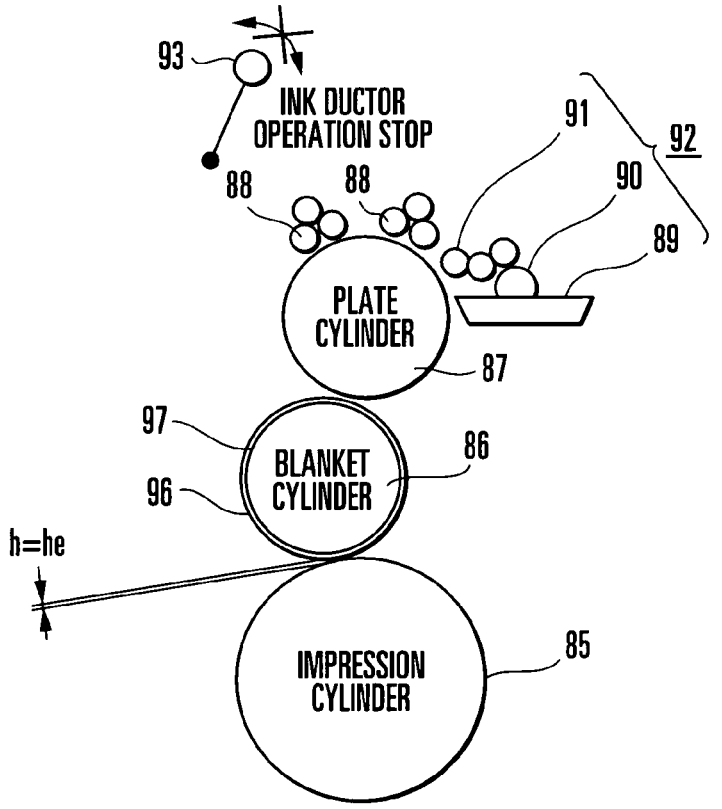
FIG. 12B is a view showing a state in which an embossing plate is mounted on the blanket cylinder in the printing unit of the web offset printing press as the fourth embodiment.

When performing embossing, as shown in FIG. 12B, the blanket cylinder 86 is set in the impression through-on state with respect to the impression cylinder 85 and plate cylinder 87, and the gap h between the blanket cylinder 86 and impression cylinder 85 is set to an embossing gap he. The ink form rollers 88 are detached from the plate cylinder 87, the water form rollers 91 are detached from the plate cylinder 87 and water fountain roller 90, and the ductor operation of the ink ductor roller 93 is stopped.

When performing embossing, the operator mounts an embossing plate 96 on the blanket cylinder 86 in place of the blanket 95 mounted on the blanket cylinder 86. As the embossing plate 96 is thin, an embossing packing material 97 is interposed between the embossing plate 96 and blanket cylinder 86. The sum of the thicknesses of the embossing plate 96 and embossing packing material 97 is smaller than the total thickness of the blanket 95, and the plate 94 is removed from the plate cylinder 87. Thus, when the blanket cylinder 86 is set in the impression thrown-on state, the blanket cylinder 86 and plate cylinder 87 are not in contact with each other.

Figure 13:
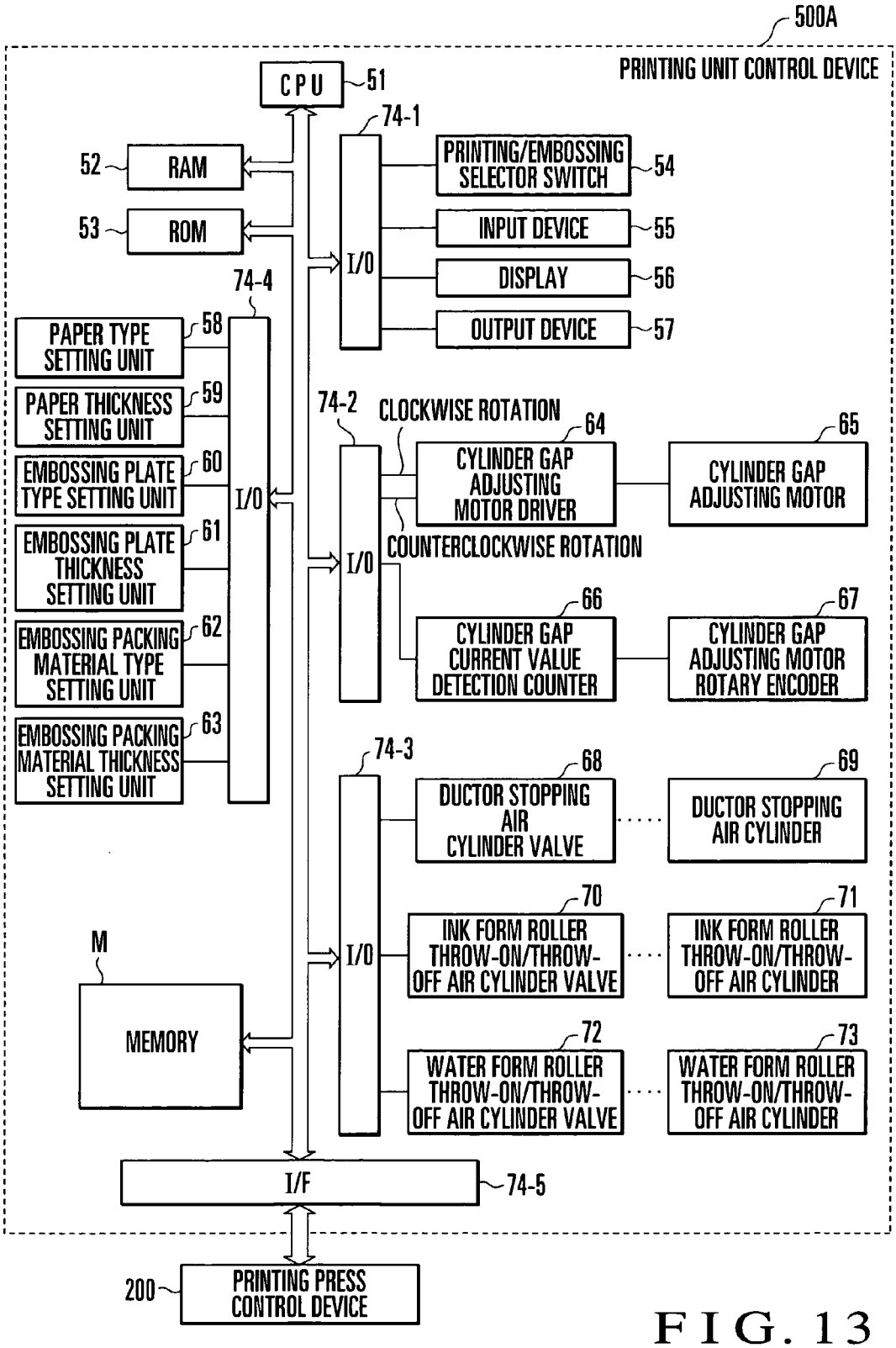
FIG. 13 is a block diagram showing the controller of the web offset printing press as the fourth embodiment.

As shown in FIG. 13, the web offset printing press according to this embodiment comprises a printing press control device 200 and printing unit control device 500A. The printing unit control device 500A comprises a CPU 51, a RAM 52, a ROM 53, a printing/embossing selector switch 54, an input device 55, a display 56, an output device 57, a paper type setting unit 58, a paper thickness setting unit 59, an embossing plate type setting unit 60, an embossing plate thickness setting unit 61, an embossing packing material type setting unit 62, an embossing packing material thickness setting unit 63, a motor driver 64 for adjusting the gap between the blanket cylinder and impression cylinder, a motor 65 for adjusting the gap between the blanket cylinder and impression cylinder, a counter 66 for detecting the current value of the gap between the blanket cylinder and impression cylinder, a rotary encoder 67 for the motor for adjusting the gap between the blanket cylinder and impression cylinder, a ductor stopping air cylinder valve 68, a ductor stopping air cylinder 69, an ink form roller throw-on/throw-off air cylinder valve 70, an ink form roller throw-on/throw-off air cylinder 71, a water form roller throw-on/throw-off air cylinder valve 72, a water form roller throw-on/throw-off air cylinder 73, input/output interfaces 74-1 to 74-5, and a memory M. The output device 57 includes an FD driver, printer, and the like.

Figure 14:
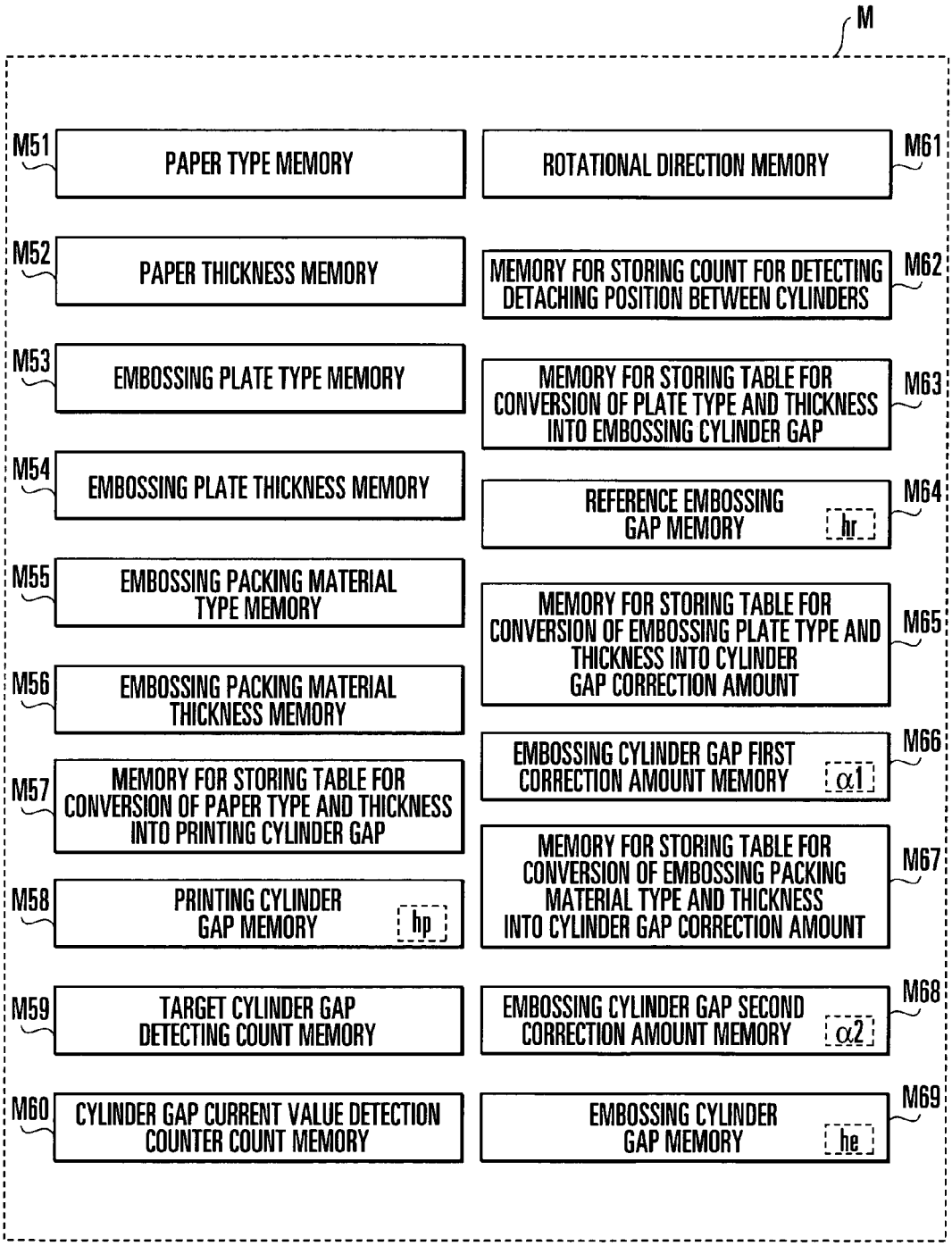
FIG. 14 is a block diagram showing the arrangement of a memory in a printing unit control device.

As shown in FIG. 14, the memory M comprises a paper type memory M51, a paper thickness memory M52, an embossing plate type memory M53, an embossing plate thickness memory M54, an embossing packing material type memory M55, an embossing packing material thickness memory M56, a memory M57 for storing a table for conversion of a paper type and thickness into a printing gap between the blanket cylinder and impression cylinder, a memory M58 for storing the printing gap between the blanket cylinder and impression cylinder, a target count memory M59 for detecting the gap between the blanket cylinder and impression cylinder, a count memory M60 for a counter for detecting the current value of the gap between the blanket cylinder and impression cylinder, a rotational direction memory M61, a count memory M62 for detecting a detaching position between the blanket cylinder and impression cylinder, a memory M63 for storing a table for conversion of a paper type and thickness into an embossing gap between the blanket cylinder and impression cylinder, a memory M64 for storing a reference embossing gap between the blanket cylinder and impression cylinder, a memory M65 for storing a table for conversion of an embossing plate type and thickness into the correction amount of the gap between the blanket cylinder and impression cylinder, a memory M66 for storing the first correction amount of the embossing gap between the blanket cylinder and impression cylinder, a memory M67 for storing a table for conversion of an embossing packing material type and thickness into the correction amount of the gap between the blanket cylinder and impression cylinder, a memory M68 for storing the second correction amount of the embossing gap between the blanket cylinder and impression cylinder, and a memory M69 for storing the embossing gap between the blanket cylinder and impression cylinder. The functions of the respective memories in the memory M will be described later.

Upon obtaining various types of input information through the input/output interfaces 74-1 to 74-5, the CPU 51 operates in accordance with a program stored in the ROM 53 while accessing the RAM 52 and memory M. The ROM 53 stores, as the program specific to this embodiment, a printing/embossing selector program which controls switching between printing and embossing. This program can be provided in the form of a computer-readable storage medium such as an optical disk or magnetic disk.

Processing operation performed by the CPU 51 of the printing unit control device 500A using the printing/embossing selector program will be described in accordance with the flowcharts divided into FIGS. 15A to 15H.

To make a printing press serve also as an embossing apparatus, the operator inputs the type and thickness (paper thickness) of the paper to be subjected to printing and embossing, the type and thickness (plate thickness) of an embossing plate to be used, and the type and thickness (packing material thickness) of an embossing packing material to be used from the setting units 58 to 63. The input paper type and thickness, embossing plate type and thickness, and embossing packing material type and thickness are respectively stored in the memories M51 and M52, M53 and 54, and M55 and M56 (steps S401 to S412, FIG. 15A).

[Printing]

When performing printing, the operator mounts the blanket 95 on the blanket cylinder 86 and the plate 94 on the plate cylinder 87 (see FIG. 12A). The operator also switches the printing/embossing selector switch 54 to the printing side.

Figure 15A:
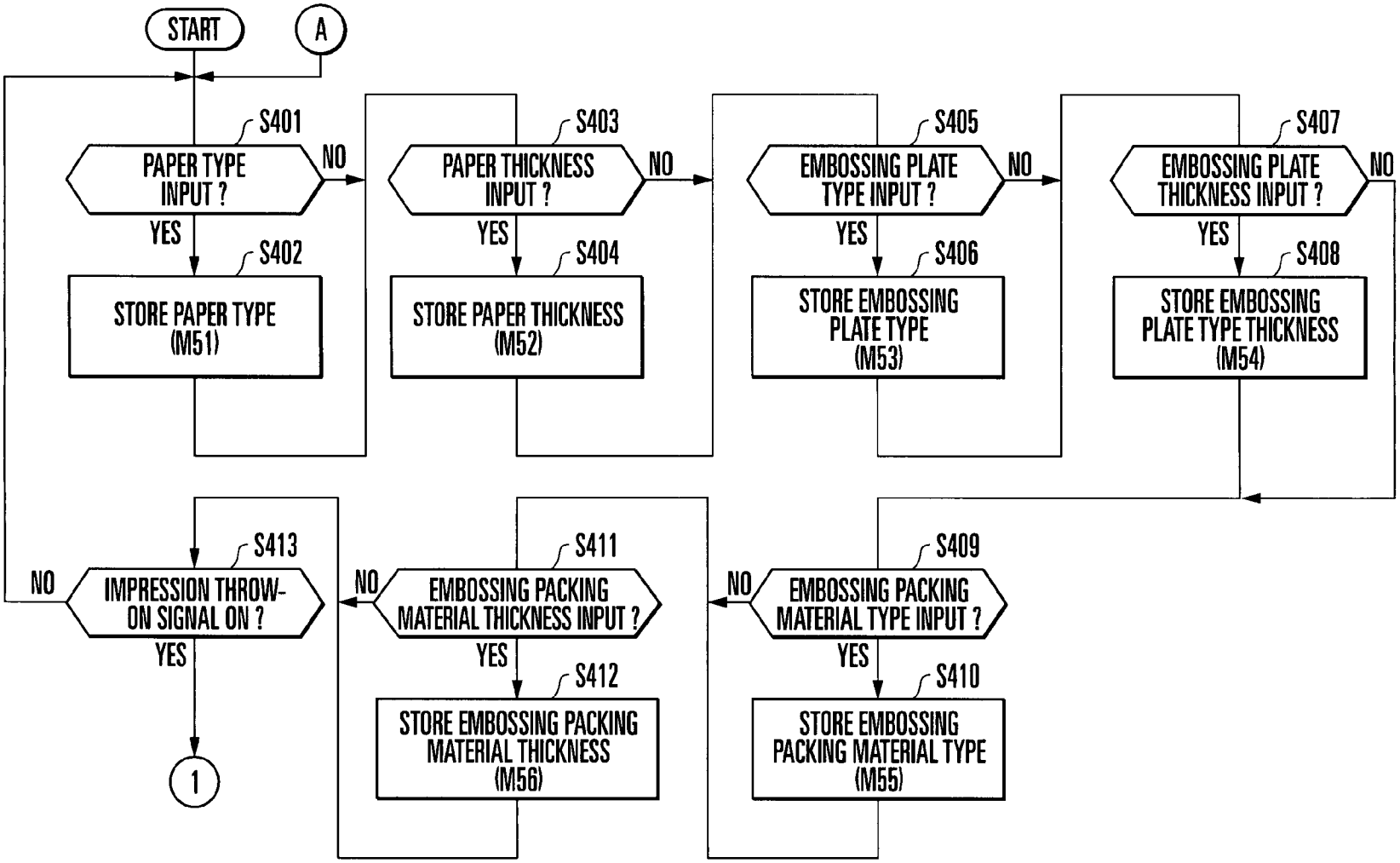
FIGS. 15A to 15H are flowcharts showing processing operation performed by the CPU of the printing unit control device.
Figure 15B:
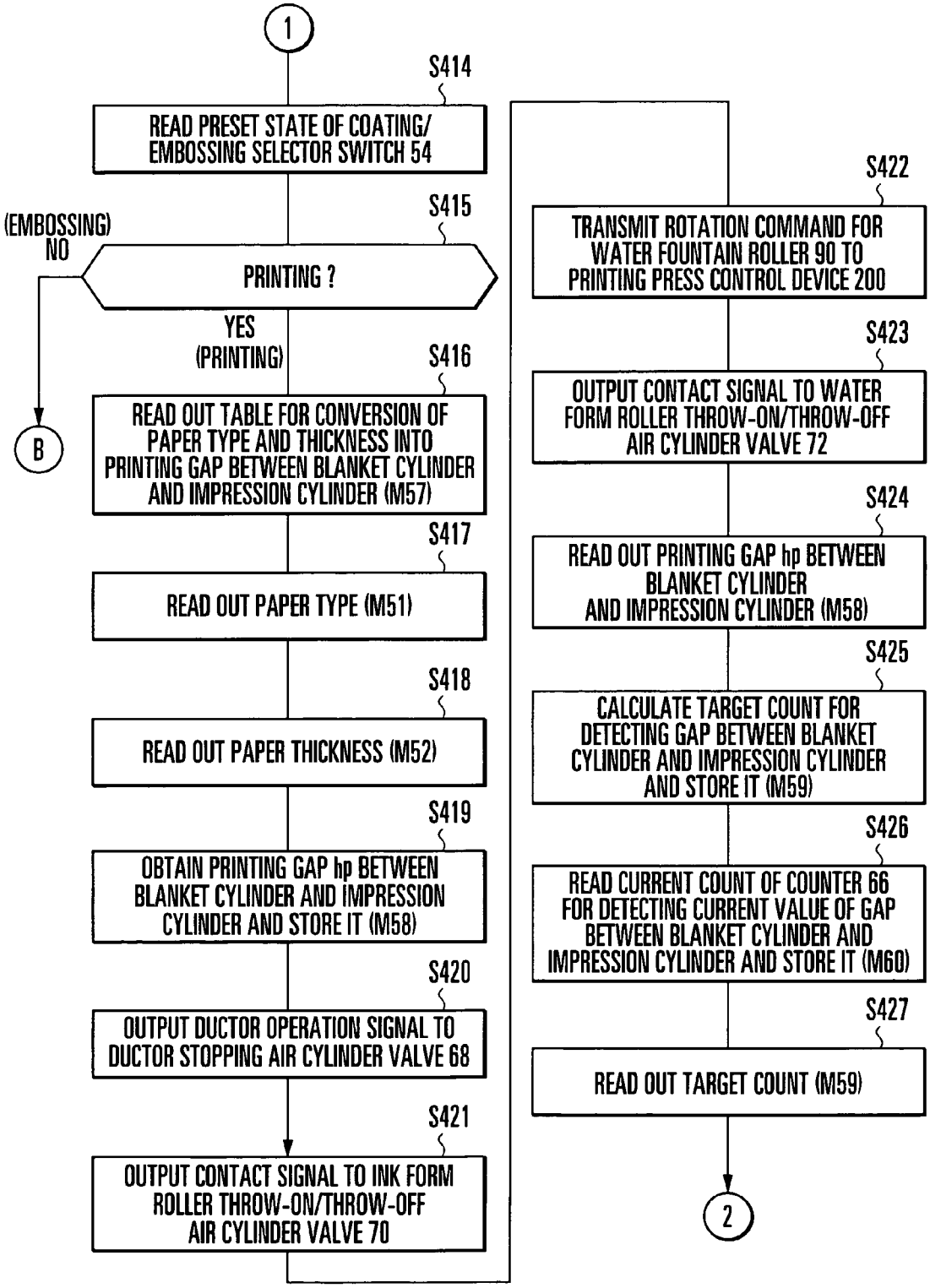
Figure 15C:
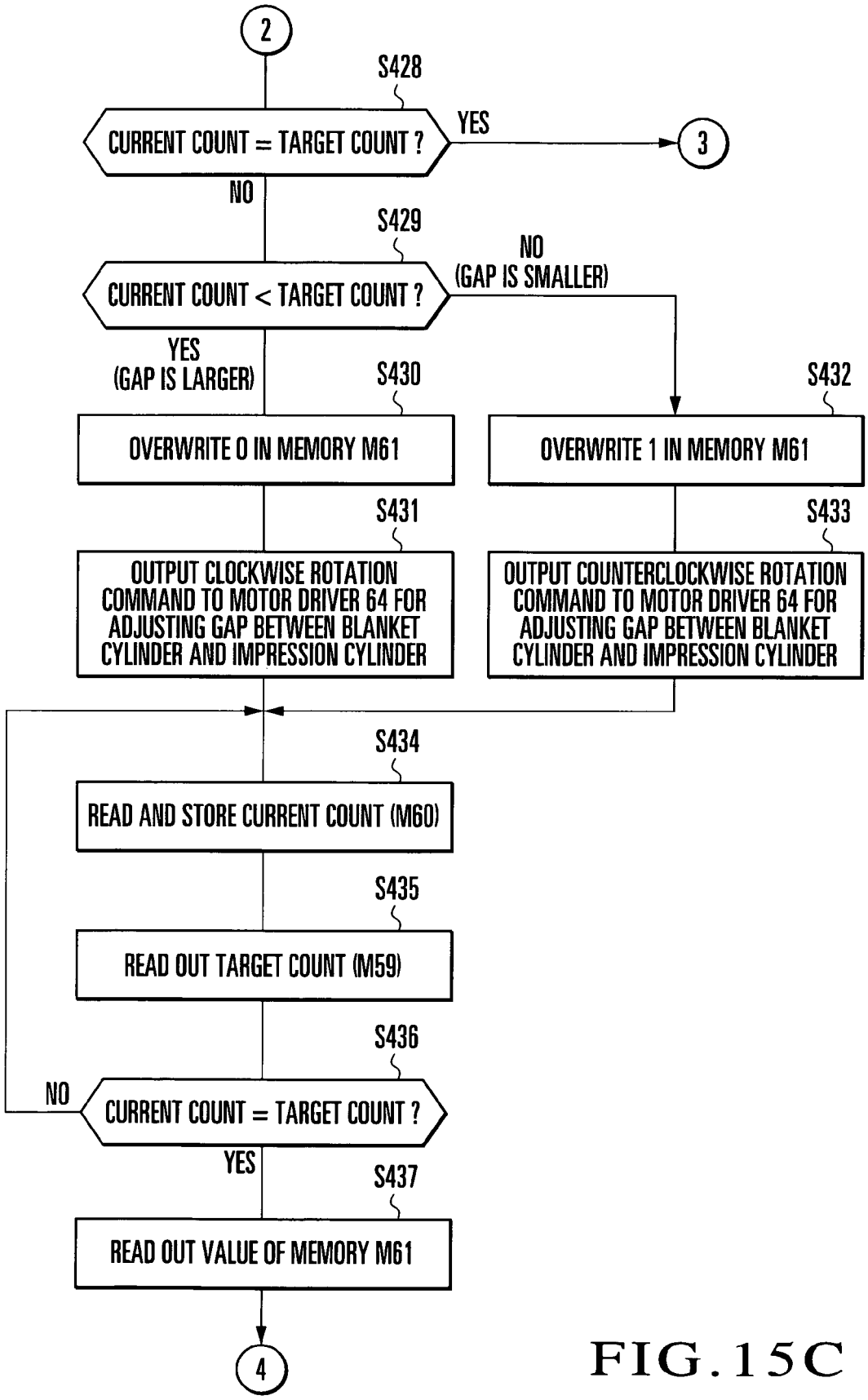
Figure 15D:
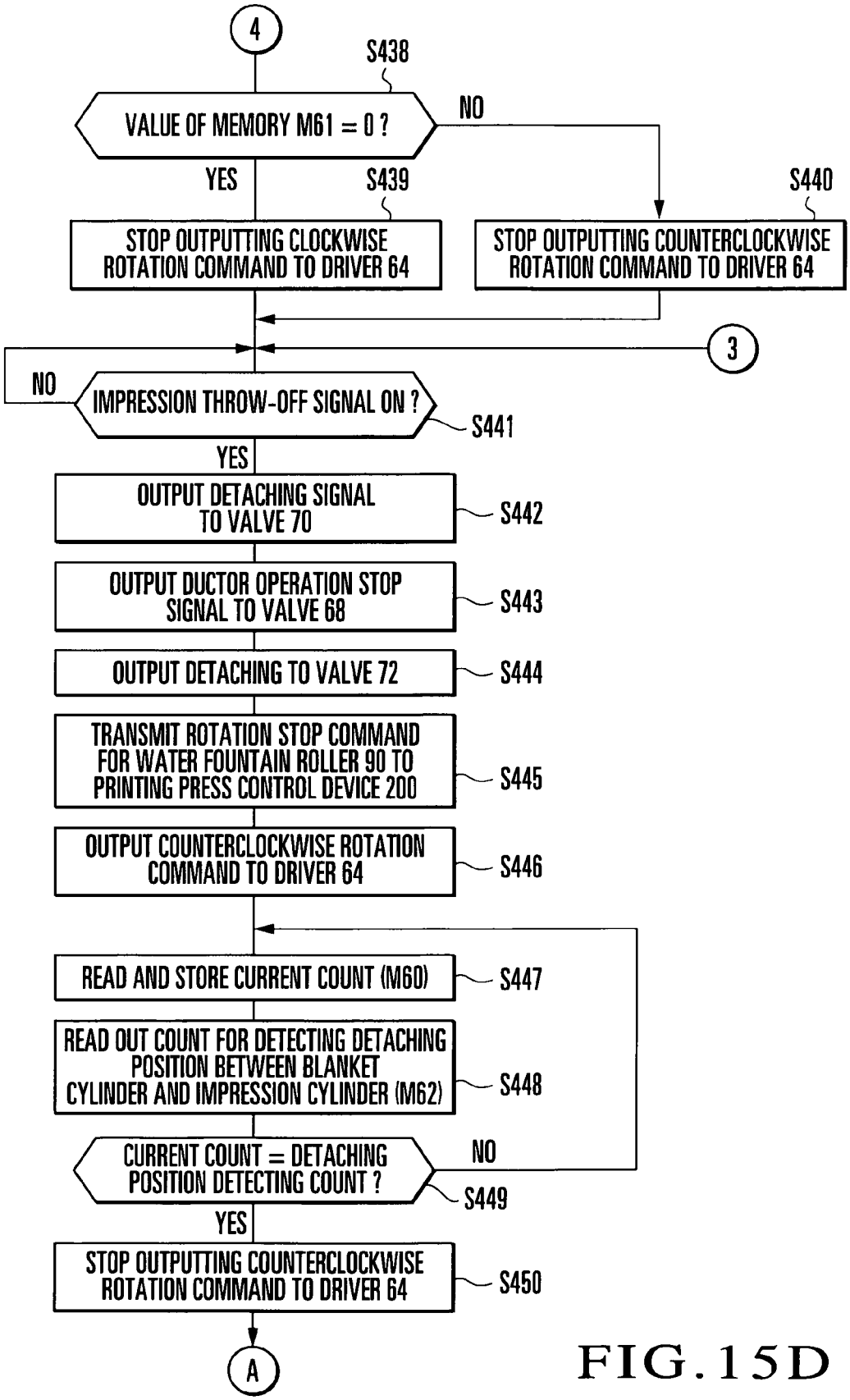
Figure 15E:
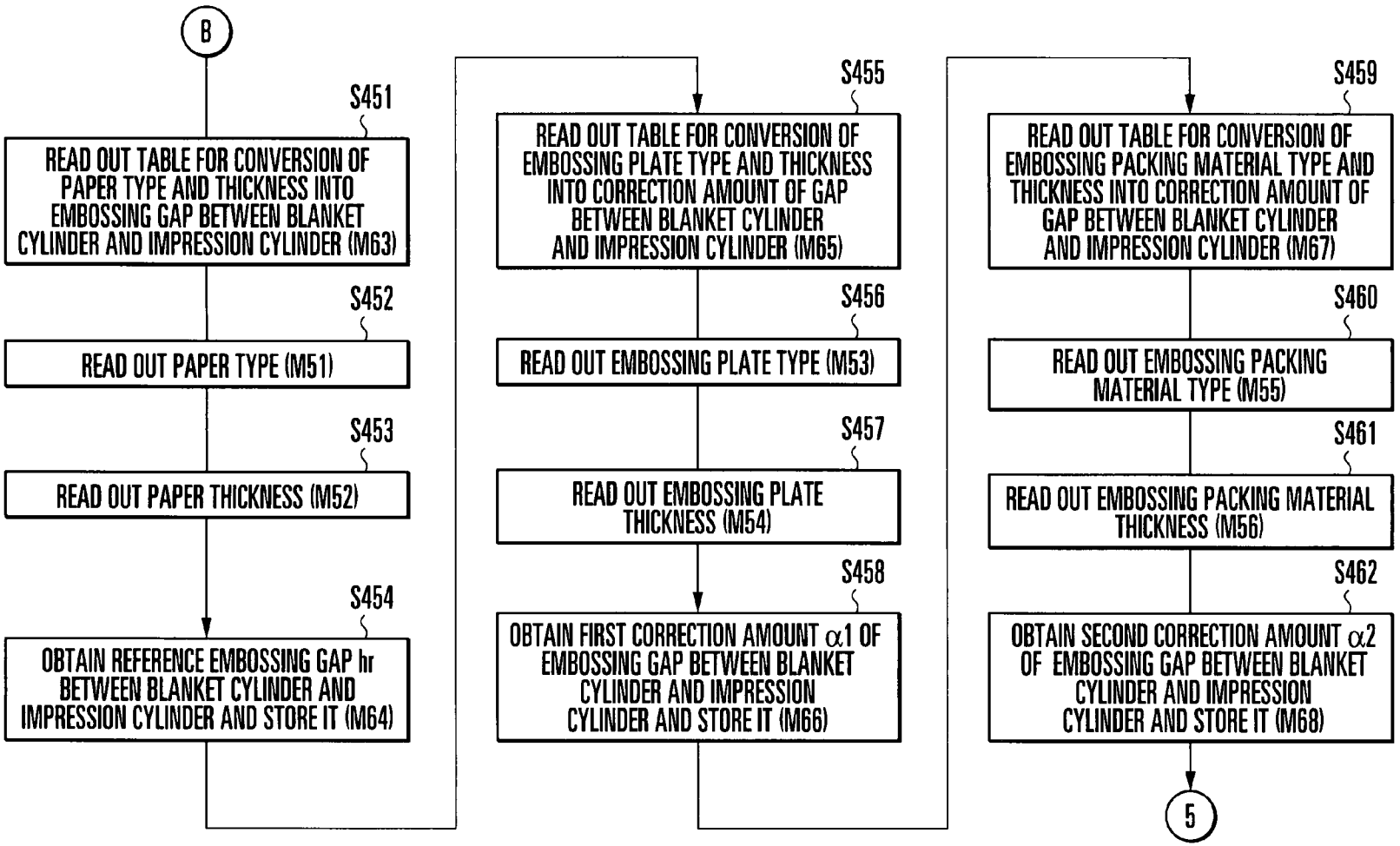
Figure 15F:
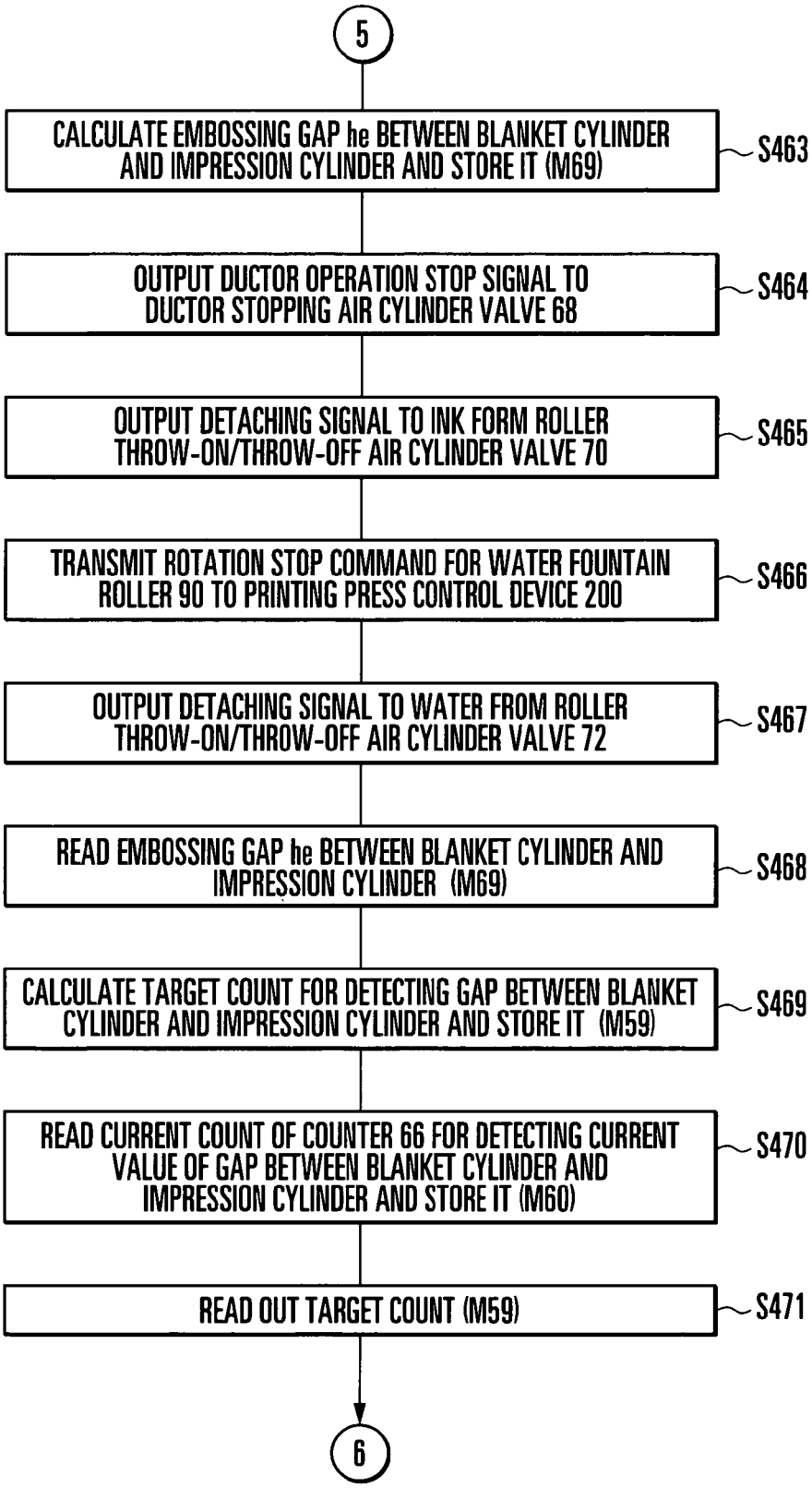
Figure 15G:
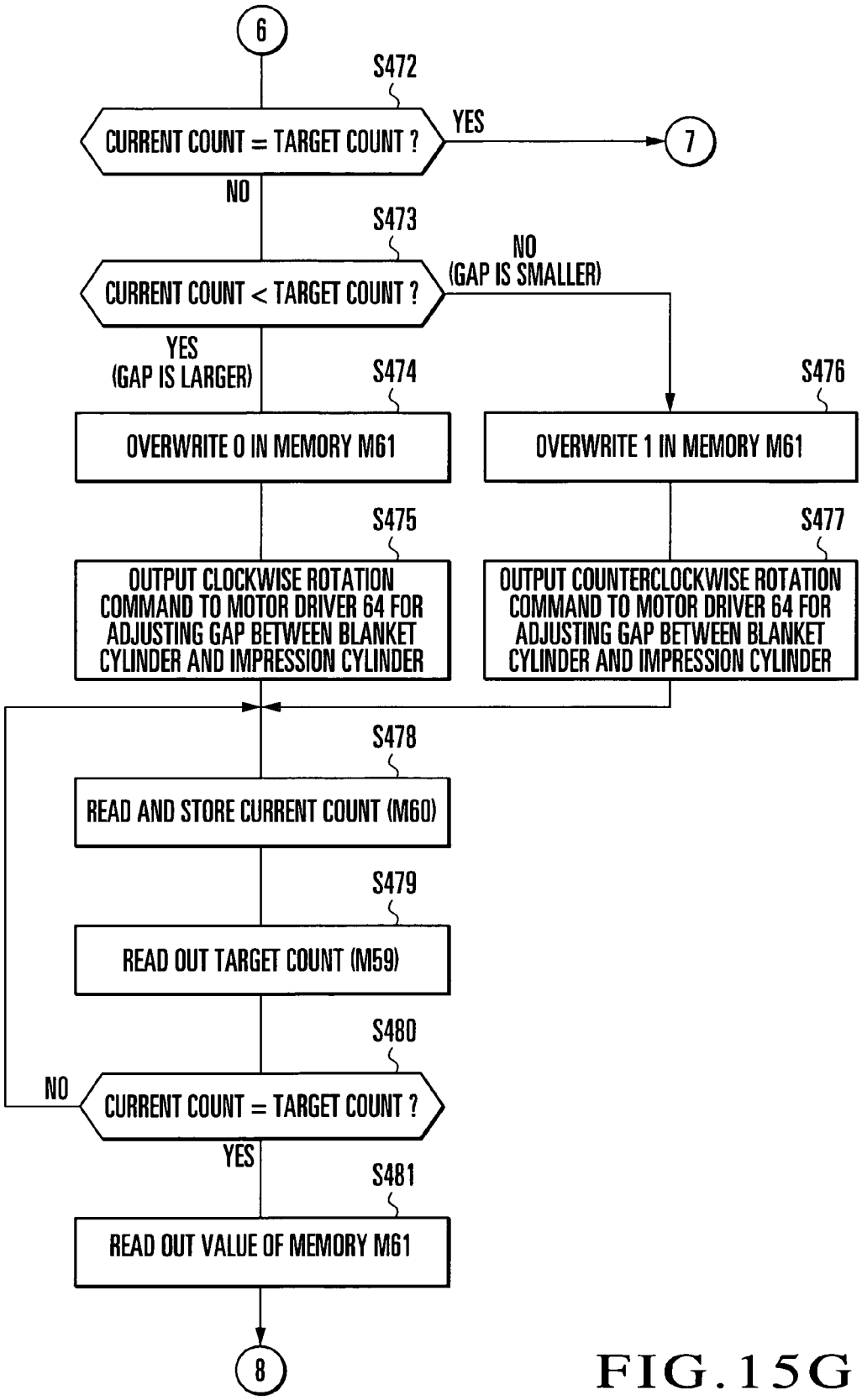
Figure 15H:
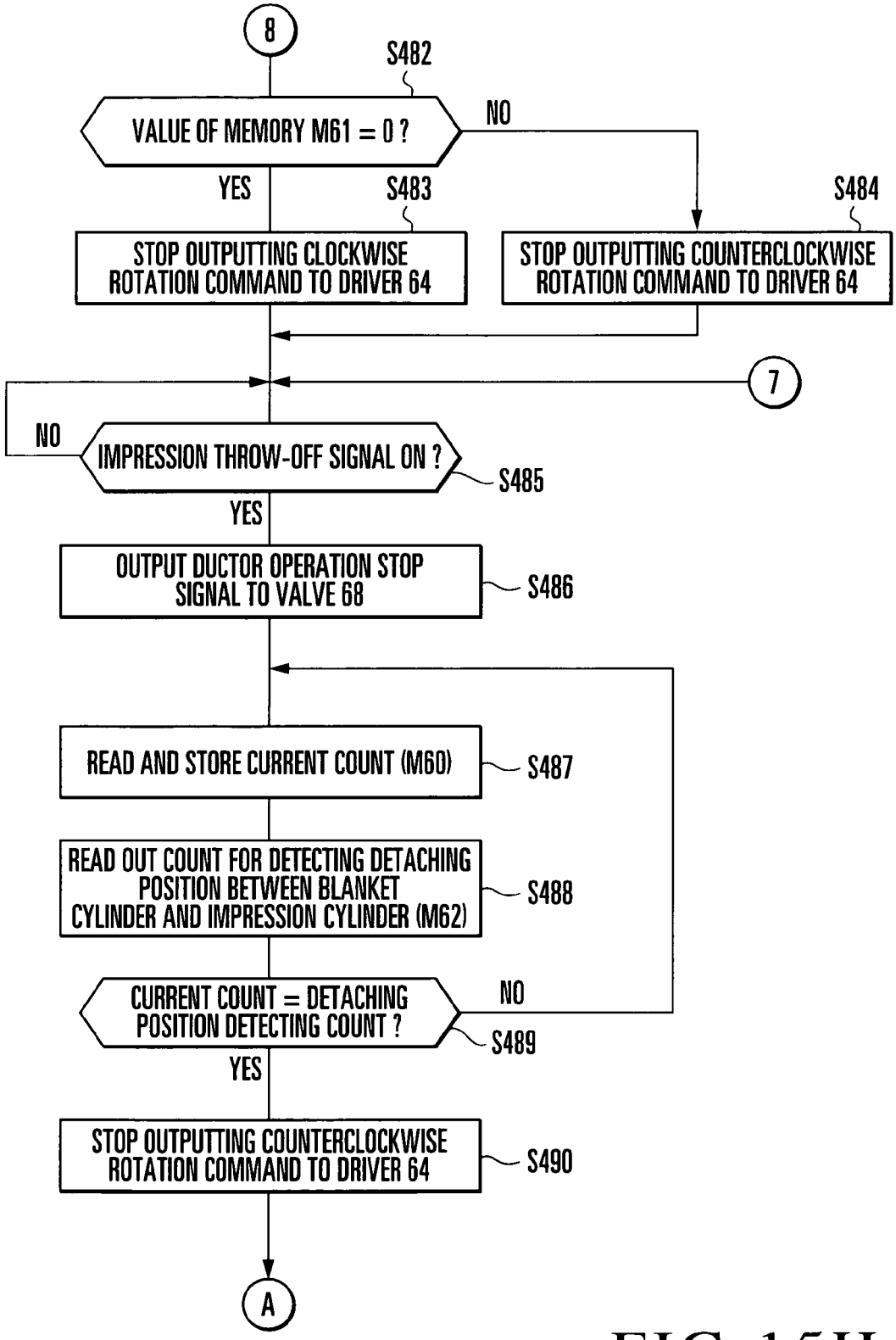

In this state, when an impression throw-on signal is input from the printing press control device 200 to the printing unit control device 500A (YES in step S413), the CPU 51 reads the preset state of the printing/embossing selector switch 54 (step S414, FIG. 15B). The CPU 51 confirms that the printing/embossing selector switch 54 is switched to the printing side (YES in step S415), and reads out from the memory M57 the table for conversion of the paper type and thickness into the printing gap between the blanket cylinder and impression cylinder (step S416).

The CPU 51 reads out the paper type from the memory M51 (step S417) and the paper thickness from the memory M52 (step S418). Using the table for conversion of the paper type and thickness into the printing gap between the blanket cylinder and impression cylinder which is read out in step S416, the CPU 51 obtains the printing gap hp between the blanket cylinder and impression cylinder from the paper type and thickness read out in steps S417 and S418, and stores the obtained gap hp in the memory M58 (step S419).

The CPU 51 then outputs a ductor operation signal to the ductor stopping air cylinder valve 68 (step S420) to actuate the ductor stopping air cylinder 69, so the ink ductor roller 93 is set in the ductor operation state. Also, the CPU 51 outputs a contact signal to the ink form roller throw-on/throw-off air cylinder valve 70 (step S421) to actuate the ink form roller throw-on/throw-off air cylinder 71, so the ink form rollers 88 are brought into contact with the plate cylinder 87. The CPU 51 also sends a water form roller rotation command to the printing press control device 200 (step S422) to start the water fountain roller 90 to rotate. Also, the CPU 51 sends a contact signal to the water form roller throw-on/throw-off air cylinder valve 72 (step S423) to actuate the water form roller throw-on/throw-off air cylinder 73, so the water form rollers 91 are brought into contact with the plate cylinder 87 and water fountain roller 90.

The CPU 51 reads out the printing gap hp between the blanket cylinder and impression cylinder from the memory M58 (step S424), calculates the target count for detecting the gap between the blanket cylinder and impression cylinder from the readout printing gap hp between the blanket cylinder and impression cylinder, and stores the calculated count in the memory M59 (step S425). The CPU 51 reads the current count of the counter 66 for detecting the current value of the gap between the blanket cylinder and impression cylinder (step S426), reads out the count for detecting the gap between the blanket cylinder and impression cylinder which is stored in the memory M59 as the target count (step S427), and compares the current count with the target count (step S428, FIG. 15C).

Then, in the same manner as in the first embodiment (step S126 (FIG. 4C) to step S139 (FIG. 4D)), the motor 65 for adjusting the gap between the blanket cylinder and impression cylinder is rotated such that the current count becomes equal to the target count, thereby matching the gap h between the blanket cylinder and impression cylinder to the target printing gap hp (step S428 (FIG. 15C) to step S441 (FIG. 15D)).

After that, in step S441, the CPU 51 checks the presence/absence of an input of an impression throw-off signal from the printing press control device 200. During this checking, the impression cylinder 85, blanket cylinder 86, plate cylinder 87, ink form rollers 88, water form rollers 91, and water fountain roller 90 continue rotation, and the ink ductor roller 93 continues ductor operation. Hence, printing ink from the plate 94 which is supplied to the blanket 95 is transferred to the paper passing between the blanket cylinder 86 and impression cylinder 85.

[End of Printing Operation]

When printing is ended and an impression throw-off signal is supplied from the printing press control device 200 (YES in step S441), the CPU 51 outputs a detaching signal to the ink form roller throw-on/throw-off air cylinder valve 70 (step S442) to detach the ink form rollers 88 from the plate cylinder 87. The CPU 51 also outputs a ductor operation stop signal to the ductor stopping air cylinder valve 68 (step S443) to stop the ductor operation of the ink ductor roller 93. The CPU 51 also outputs a detaching signal to the water form roller throw-on/throw-off air cylinder valve 72 (step S444) to detach the water form rollers 91 from the plate cylinder 87 and water fountain roller 90. The CPU 51 also sends a water fountain roller rotation stop command to the printing press control device 200 (step S445) to stop rotation of the water fountain roller 90.

Then, in the same manner as in the first embodiment (steps S142 to S146 (FIG. 4D)), the CPU 51 sends a counterclockwise rotation command to the motor driver 64 for adjusting the gap between the blanket cylinder and impression cylinder to detach the blanket cylinder 86 from the impression cylinder 85 and plate cylinder 87 (step S446 to step S450). Thus, the printing operation using the printing unit is ended.

[Embossing]

When performing embossing operation, the operator removes the plate 94 from the plate cylinder 87 and mounts the embossing plate 96 on the blanket cylinder 86 in place of the blanket 95 (see FIG. 12B). The embossing packing material 97 is interposed between the embossing plate 96 and blanket cylinder 86. The printing/embossing selector switch 54 is switched to the embossing side.

In this state, when an impression throw-on signal is input to the printing press control device 200 to the printing unit control device 500A (YES in step S413, FIG. 15A), the CPU 51 reads the preset state of the coating/embossing selector switch 54 (step S414, FIG. 15B). The CPU 51 confirms that the printing/embossing selector switch 54 is switched to the embossing side (NO in step S415), and reads out from the memory M63 the table for conversion of the paper type and thickness into the embossing gap between the blanket cylinder and impression cylinder (step S451, FIG. 15E).

The CPU 51 then reads out the paper type from the memory M51 (step S452) and paper thickness from the memory M52 (step S453). Using the table for conversion of the paper type and thickness into the embossing gap between the blanket cylinder and impression cylinder which is read out in step S451, the CPU 51 obtains a reference embossing gap hr between the blanket cylinder and impression cylinder (step S454), subtracts a first correction amount $\alpha 1$ (obtained in steps S455 to S458) of the embossing gap between the blanket cylinder and impression cylinder and a second correction amount $\alpha 2$ (obtained in steps S459 to S462) of the embossing gap between the blanket cylinder and impression cylinder from the reference gap hr to obtain the embossing gap he between the blanket cylinder and impression cylinder (step S463, FIG. 15F).

The CPU 51 then outputs a ductor operation stop signal to the ductor stopping air cylinder valve 68 (step S464) to stop the ductor operation of the ink ductor roller 93. The CPU 51 also outputs a detaching signal to the ink form roller throw-on/throw-off air cylinder valve 70 (step S465) to detach the ink form rollers 88 from the plate cylinder 87. The CPU 51 also sends a water fountain roller rotation stop command to the printing press control device 200 (step S466) to stop rotation of the water fountain roller 90. The CPU 51 also outputs a detaching signal to the water form roller throw-on/throw-off air cylinder valve 72 (step S467) to detach the water form rollers 91 from the plate cylinder 87 and water fountain roller 90.

The CPU 51 reads out the embossing gap he between the blanket cylinder and impression cylinder from the memory M69 (step S468), calculates the target count for detecting the gap between the blanket cylinder and impression cylinder from the readout embossing gap he between the blanket cylinder and impression cylinder, and stores the target count in the memory M59 (step S469). The CPU 51 reads the current count from the counter 66 for detecting the current value of the gap between the blanket cylinder and impression cylinder (step S470), reads out from the memory M59 the count for detecting the gap between the blanket cylinder and impression cylinder as the target count (step S471), and compares the current count with the target count (step S472 in FIG. 15G).

Then, in the same manner as in the first embodiment (step S166 (FIG. 4G) to step S179 (FIG. 4H)), the motor 65 for adjusting the gap between the blanket cylinder and impression cylinder is rotated such that the current count becomes equal to the target count, thereby matching the gap h between the blanket cylinder and impression cylinder to the target embossing gap he (step S472 (FIG. 15G) to step S485 (FIG. 15H)).

After that, in step S485, the CPU 51 checks the presence/absence of an input of an impression throw-off signal from the printing press control device 200. During this checking, the impression cylinder 85, blanket cylinder 86, and plate cylinder 87 continue rotation. Thus, the embossing plate 96 as a die embosses the paper (printed paper) passing between the blanket cylinder 86 and impression cylinder 85.

[End of Embossing Operation]

When printing and embossing are ended and an impression throw-off signal is supplied from the printing press control device 200 (YES in step S485), the CPU 51 sends a counterclockwise rotation command to the motor driver 64 for adjusting the gap between the blanket cylinder and impression cylinder (step S486) and detaches the blanket cylinder 86 from the impression cylinder 85 and plate cylinder 87 (steps S486 to S490). Thus, the embossing operation for the printed paper using the printing unit is ended.

[Fifth Embodiment]

Another exemplary web offset printing press which also serves as an embossing apparatus will be described as the fifth embodiment of the switch-over processing apparatus of the present invention.

Figure 16:
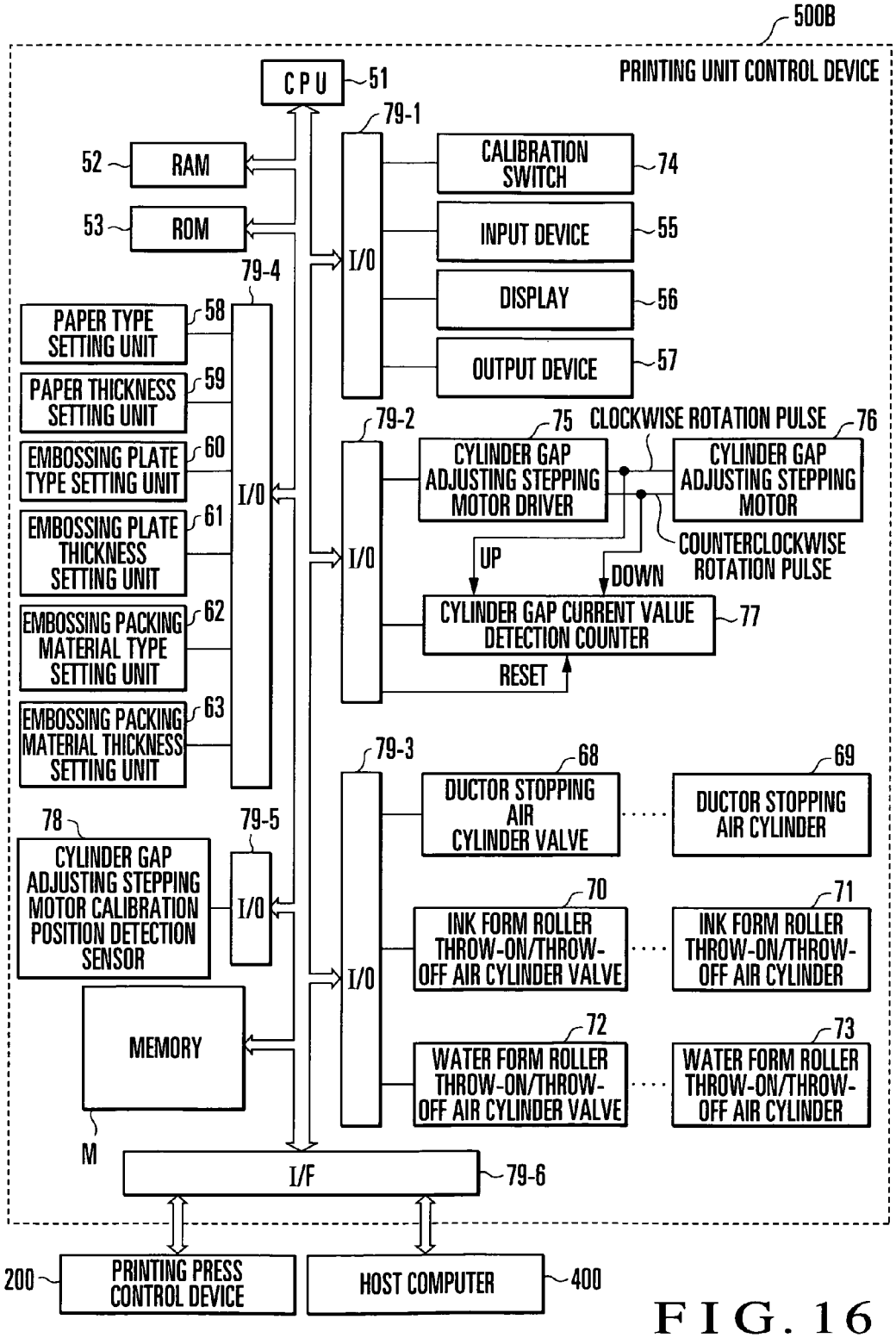
FIG. 16 is a block diagram showing a controller in a web offset printing press as the fifth embodiment the switch-over processing apparatus of the present invention which also serves as an embossing apparatus.

As shown in FIG. 16, the web offset printing press according to the present invention comprises a printing press control device 200 and printing unit control device 500B. In addition to the printing press control device 200, a host computer 400 is also connected to the printing unit control device 500B.

According to this embodiment, in the same manner as in the second embodiment, the host computer 400 sends a printing/embossing selection signal (a signal designating which one of printing operation and embossing operation is to be performed) to the printing unit control device 500B. In the same manner as in the second embodiment, a stepping motor adjusts a gap h between a blanket cylinder 86 and impression cylinder 85.

According to this embodiment, the printing unit control device 500B comprises a CPU 51, a RAM 52, a ROM 53, a calibration switch 74, an input device 55, a display 56, an output device 57, a paper type setting unit 58, a paper thickness setting unit 59, an embossing plate type setting unit 60, an embossing plate thickness setting unit 61, an embossing packing material type setting unit 62, an embossing packing material thickness setting unit 63, a stepping motor driver 75 for adjusting a gap between the blanket cylinder and impression cylinder, a stepping motor 76 for adjusting the gap between the blanket cylinder and impression cylinder, a counter (UP/DOWN counter) 77 for detecting the current value of the gap between the blanket cylinder and impression cylinder, a detection sensor 78 for detecting the calibration position of the stepping motor for adjusting the gap between the blanket cylinder and impression cylinder, a ductor stopping air cylinder valve 68, a ductor stopping air cylinder 69, an ink form roller throw-on/throw-off air cylinder valve 70, an ink form roller throw-on/throw-off air cylinder 71, a water form roller throw-on/throw-off air cylinder valve 72, a water form roller throw-on/throw-off air cylinder 73, input/output interfaces 79-1 to 79-6, and a memory M. The output device 57 includes an FD driver, printer, and the like.

Figure 17:
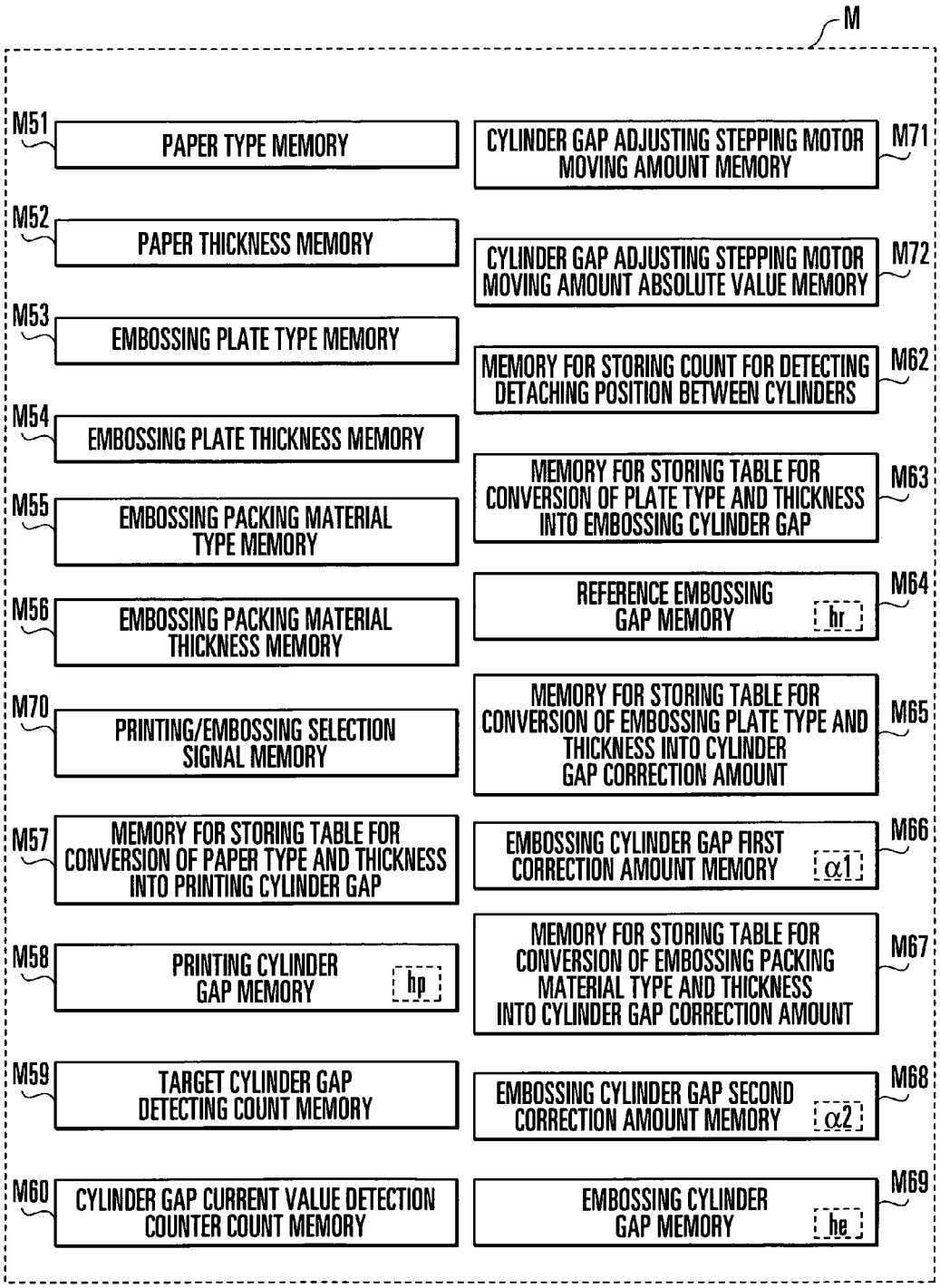
FIG. 17 is a block diagram showing the arrangement of a memory in a printing unit control device.

As shown in FIG. 17, the memory M comprises a paper type memory M51, a paper thickness memory M52, an embossing plate type memory M53, an embossing plate thickness memory M54, an embossing packing material type memory M55, an embossing packing material thickness memory M56, a printing/embossing selection signal memory M70, a memory M57 for storing a table for conversion of a paper type and thickness into a printing gap between the blanket cylinder and impression cylinder, a memory M58 for storing the printing gap between the blanket cylinder and impression cylinder, a target count memory M59 for detecting the gap between the blanket cylinder and impression cylinder, a count memory M60 for a counter for detecting the current value of the gap between the blanket cylinder and impression cylinder, a memory M71 for storing the moving amount of the stepping motor for adjusting the gap between the blanket cylinder and impression cylinder, a memory M72 for storing the absolute value of the moving amount of the stepping motor for adjusting the gap between the blanket cylinder and impression cylinder, a count memory M62 for detecting the detaching position between the blanket cylinder and impression cylinder, a memory M63 for storing a table for conversion of a paper type and thickness into an embossing gap between the blanket cylinder and impression cylinder, a memory M64 for storing a reference embossing gap between the blanket cylinder and impression cylinder, a memory M65 for storing a table for conversion of an embossing plate type and thickness into the correction amount of the gap between the blanket cylinder and impression cylinder, a memory M66 for storing the first correction amount of the embossing gap between the blanket cylinder and impression cylinder, a memory M67 for storing a table for conversion of an embossing packing material type and thickness into the correction amount of the gap between the blanket cylinder and impression cylinder, a memory M68 for storing the second correction amount of the embossing gap between the blanket cylinder and impression cylinder, and a memory M69 for storing the embossing gap between the blanket cylinder and impression cylinder. The functions of the respective memories in the memory M will be described later.

Upon obtaining various types of input information through the input/output interfaces 79-1 to 79-6, the CPU 51 operates in accordance with a program stored in the ROM 53 while accessing the RAM 52 and memory M. The ROM 53 stores, as the program specific to this embodiment, a printing/embossing selector program which controls switching between printing and embossing. This program can be provided in the form of a computer-readable storage medium such as an optical disk or magnetic disk.

Processing operation performed by the CPU 51 of the printing unit control device 500B using the printing/embossing selector program will be described in accordance with the flowcharts divided into FIGS. 18A to 18I.

To make a printing press serve also as an embossing apparatus, the operator inputs the type and thickness (paper thickness) of the paper to be subjected to printing and embossing, the type and thickness (plate thickness) of an embossing plate to be used, and the type and thickness (packing material thickness) of an embossing packing material to be used from the setting units 58 to 63. The input paper type and thickness, embossing plate type and thickness, and embossing packing material type and thickness are respectively stored in the memories M51 and M52, M53 and 54, and M55 and M56 (steps S501 to S512, FIG. 18A).

Upon reception of a printing/embossing selection signal (signal designating which one of printing operation and embossing operation is to be performed) transmitted from the host computer 400 (YES in step S513), the CPU 51 stores operation information (selection between printing/embossing) designated by the printing/embossing selection signal in the memory M70 (step S514). The CPU 51 also checks the presence/absence of an input of an impression throw-on signal from the printing press control device 200 in step S515.

[Printing]

When performing printing, the operator mounts a blanket 95 on a blanket cylinder 86 and a plate 94 on a plate cylinder 87 (see FIG. 12A). In this case, the host computer 400 transmits a printing/embossing selection signal which designates printing operation.

Figure 18A:
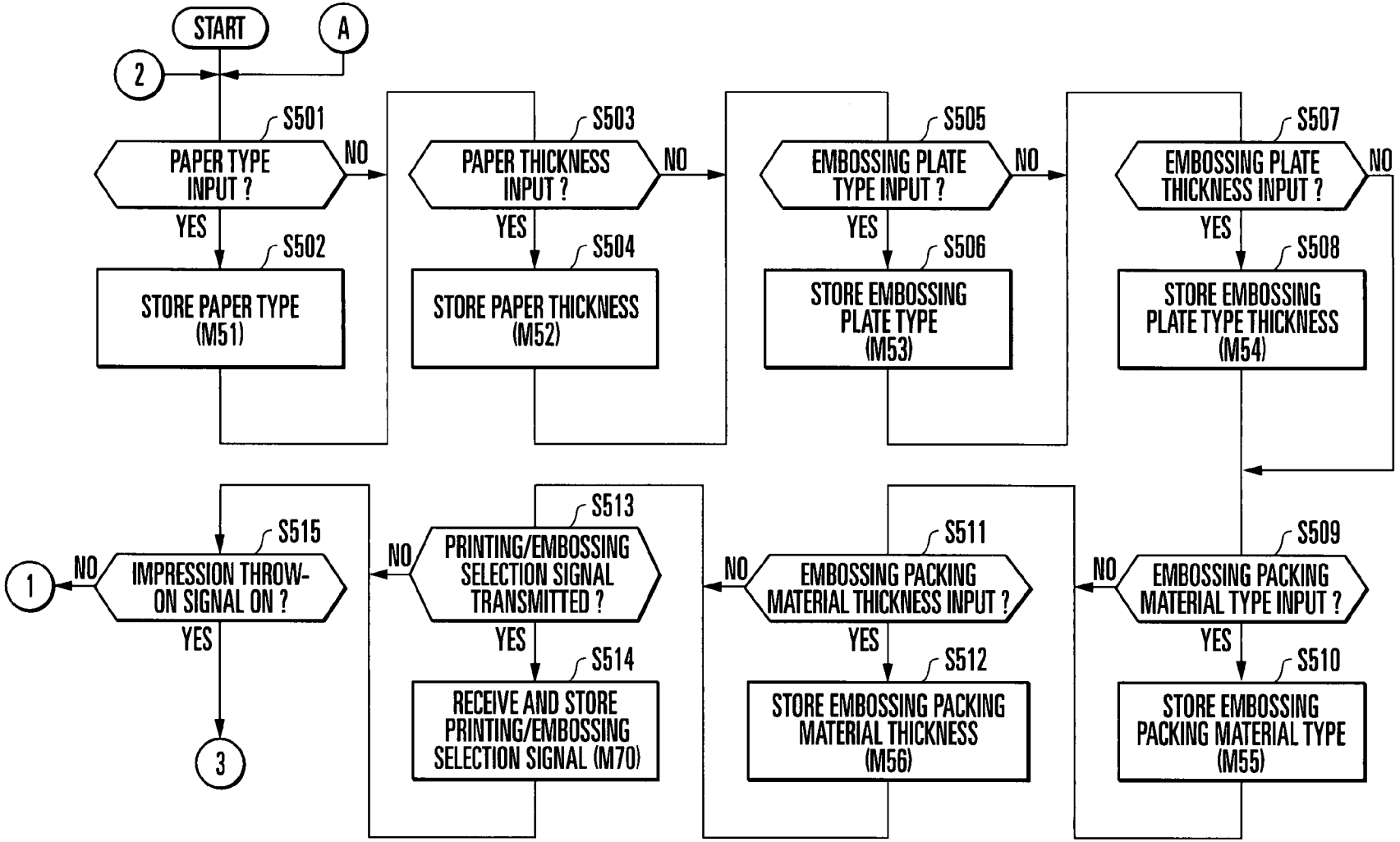
FIGS. 18A to 18I are flowcharts showing processing operation performed by the CPU of the printing unit control device.
Figure 18B:
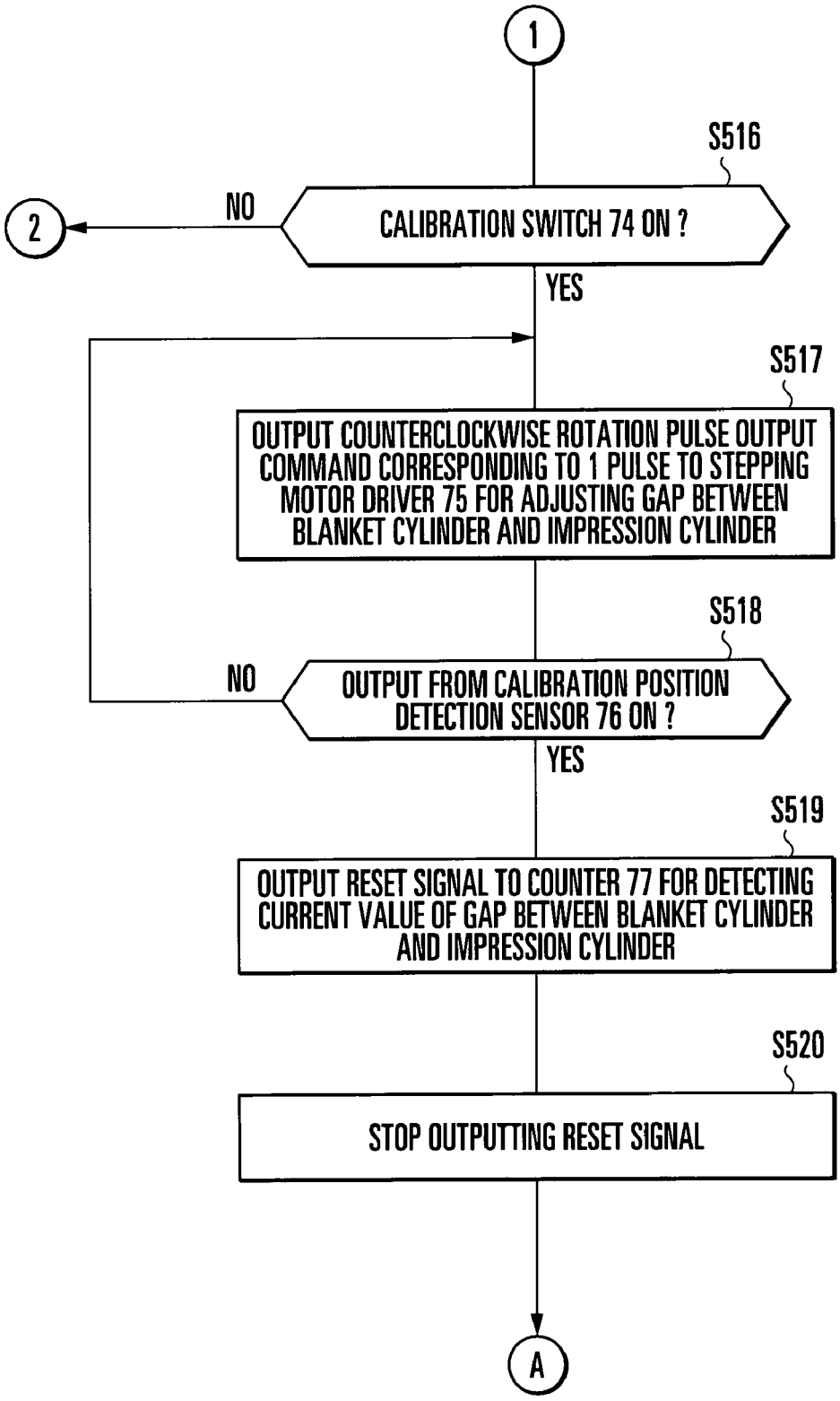
Figure 18C:
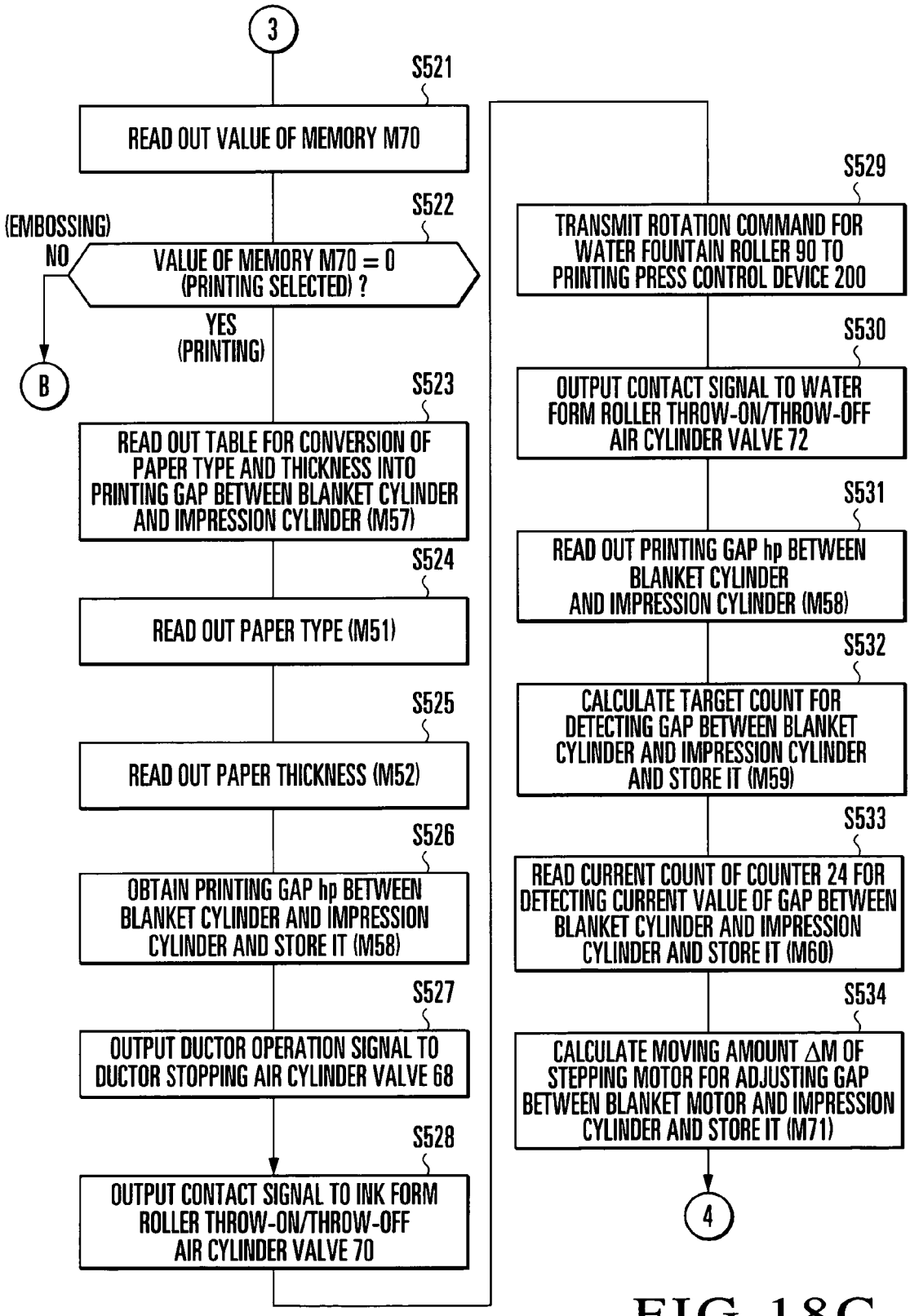
Figure 18D:
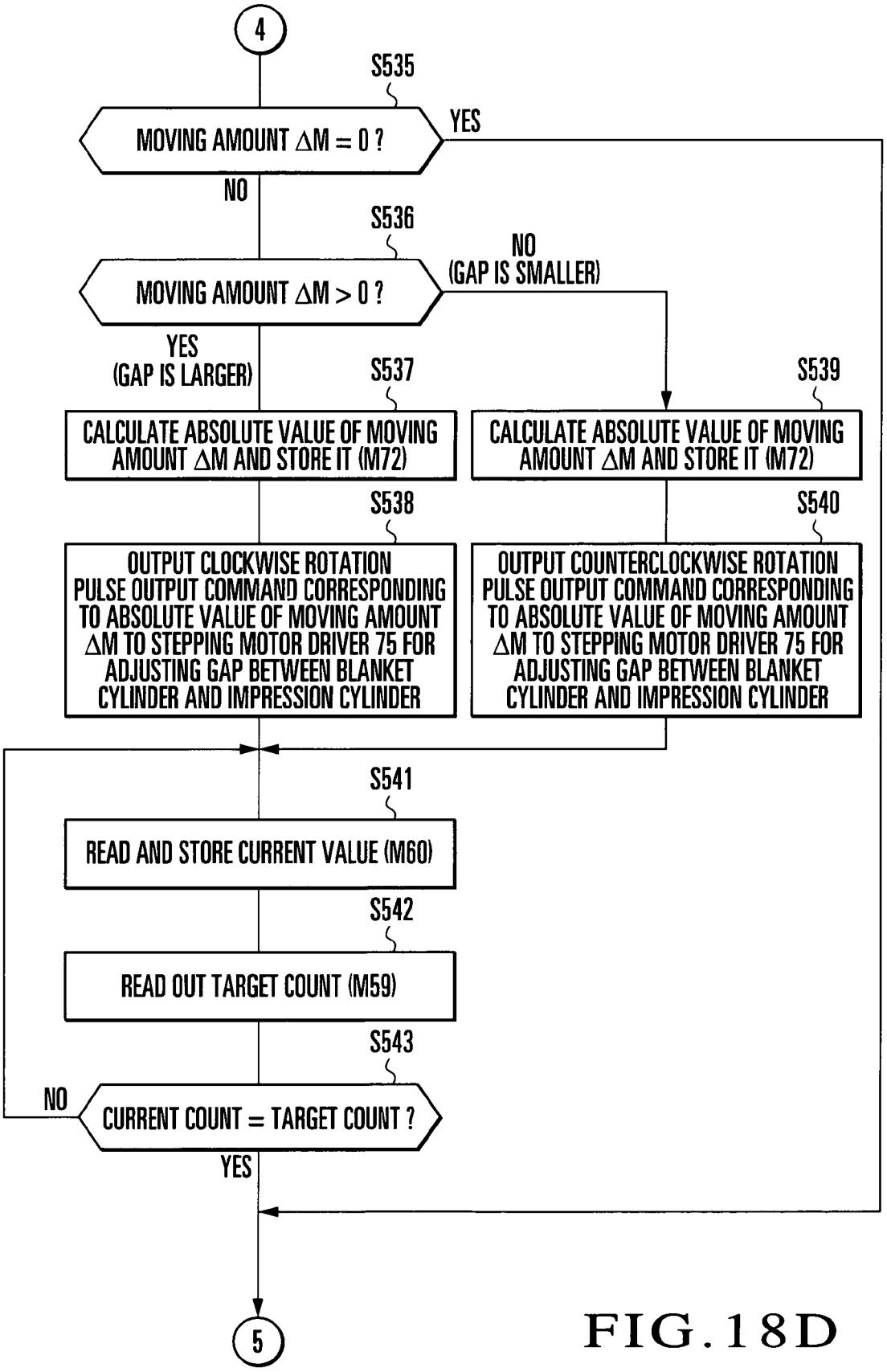
Figure 18E:
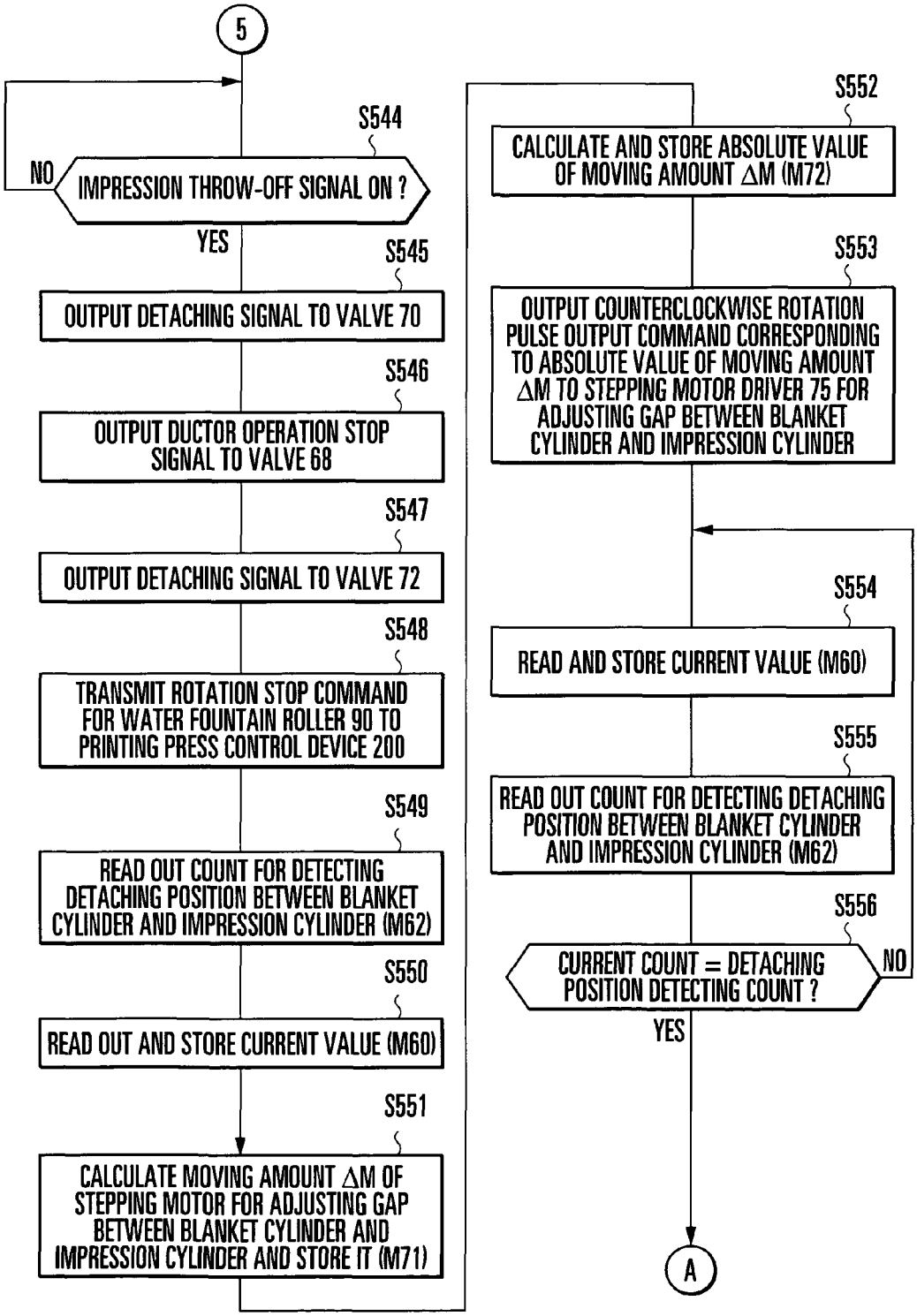
Figure 18F:
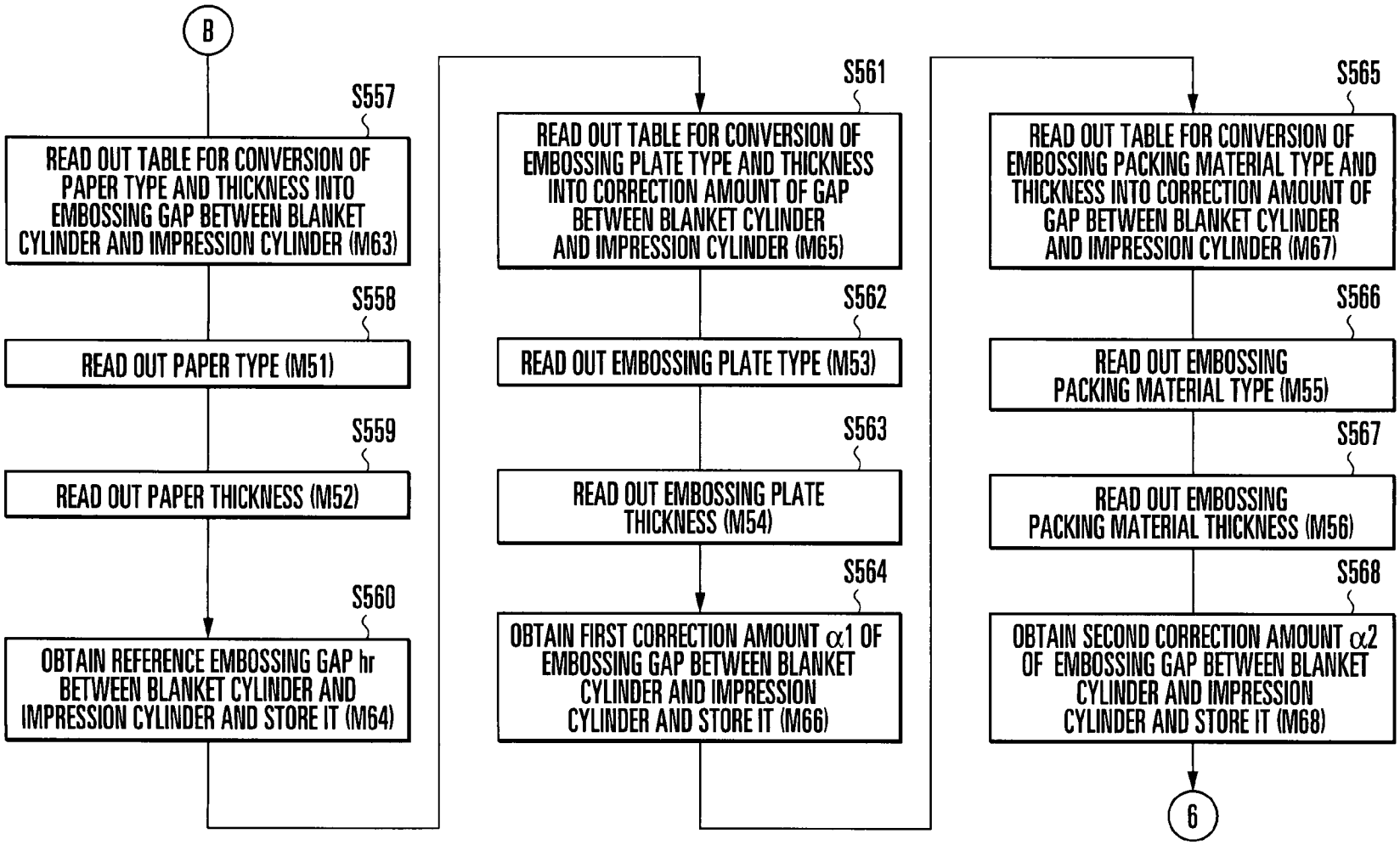
Figure 18G:
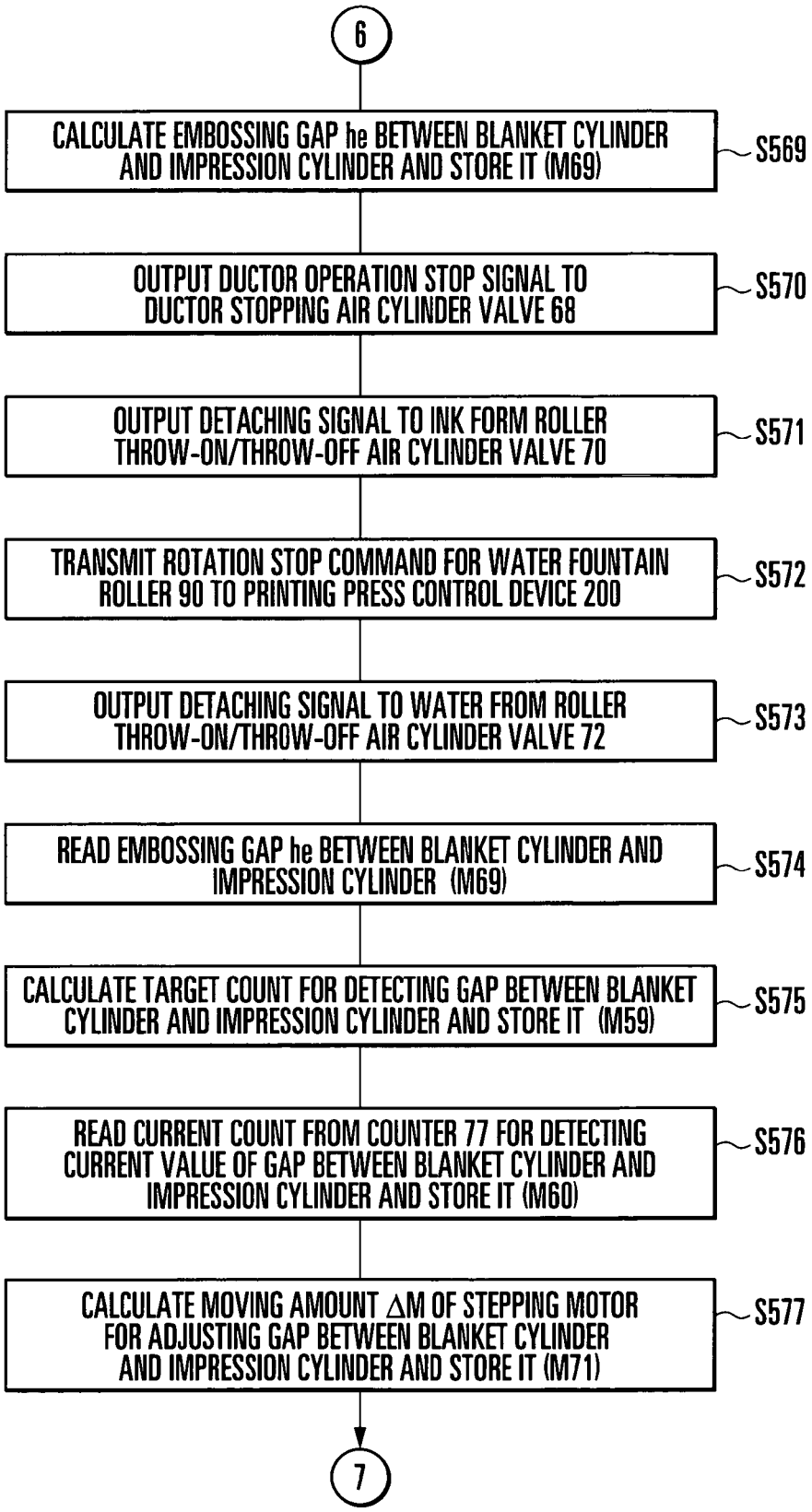
Figure 18H:
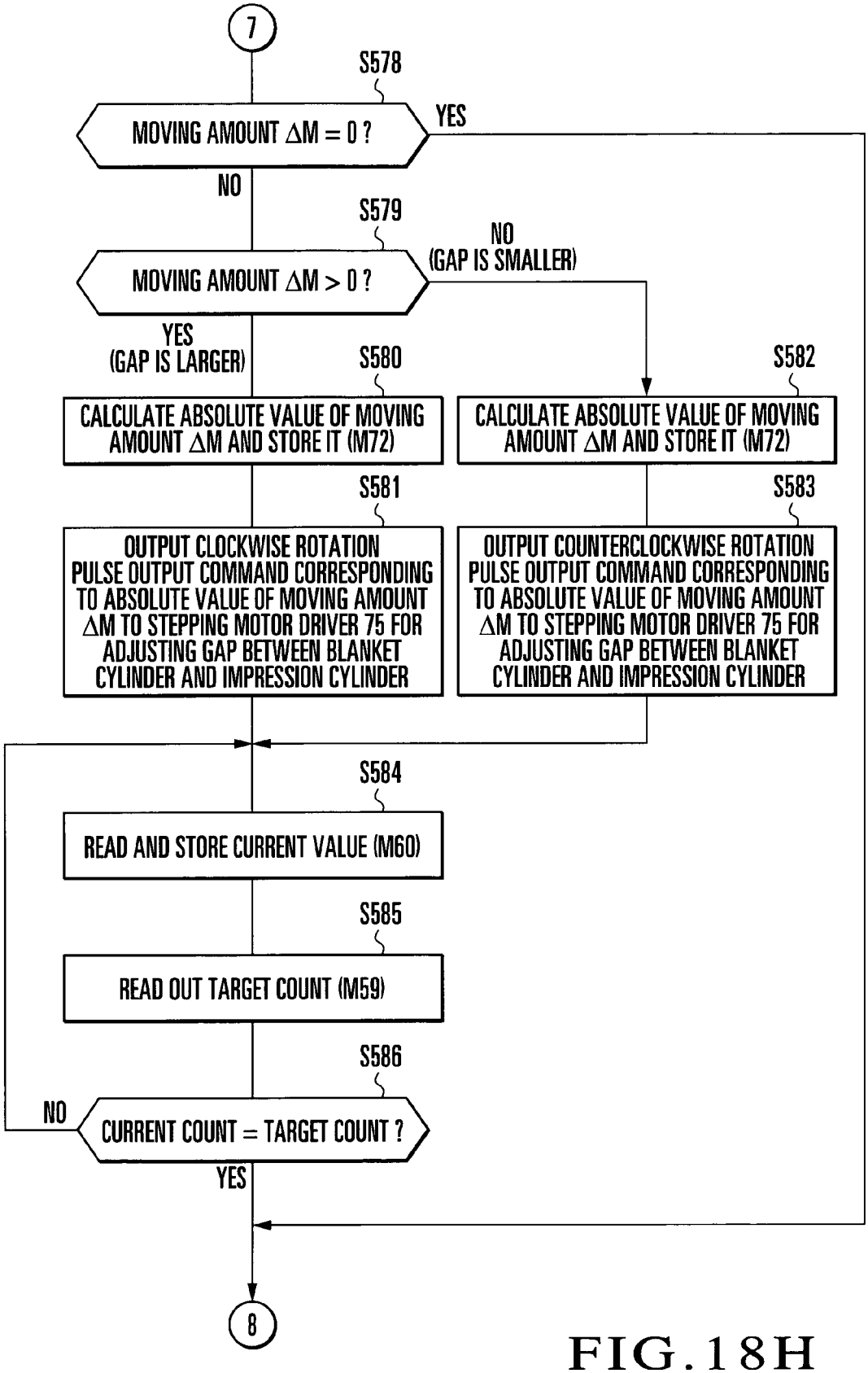
Figure 18I:
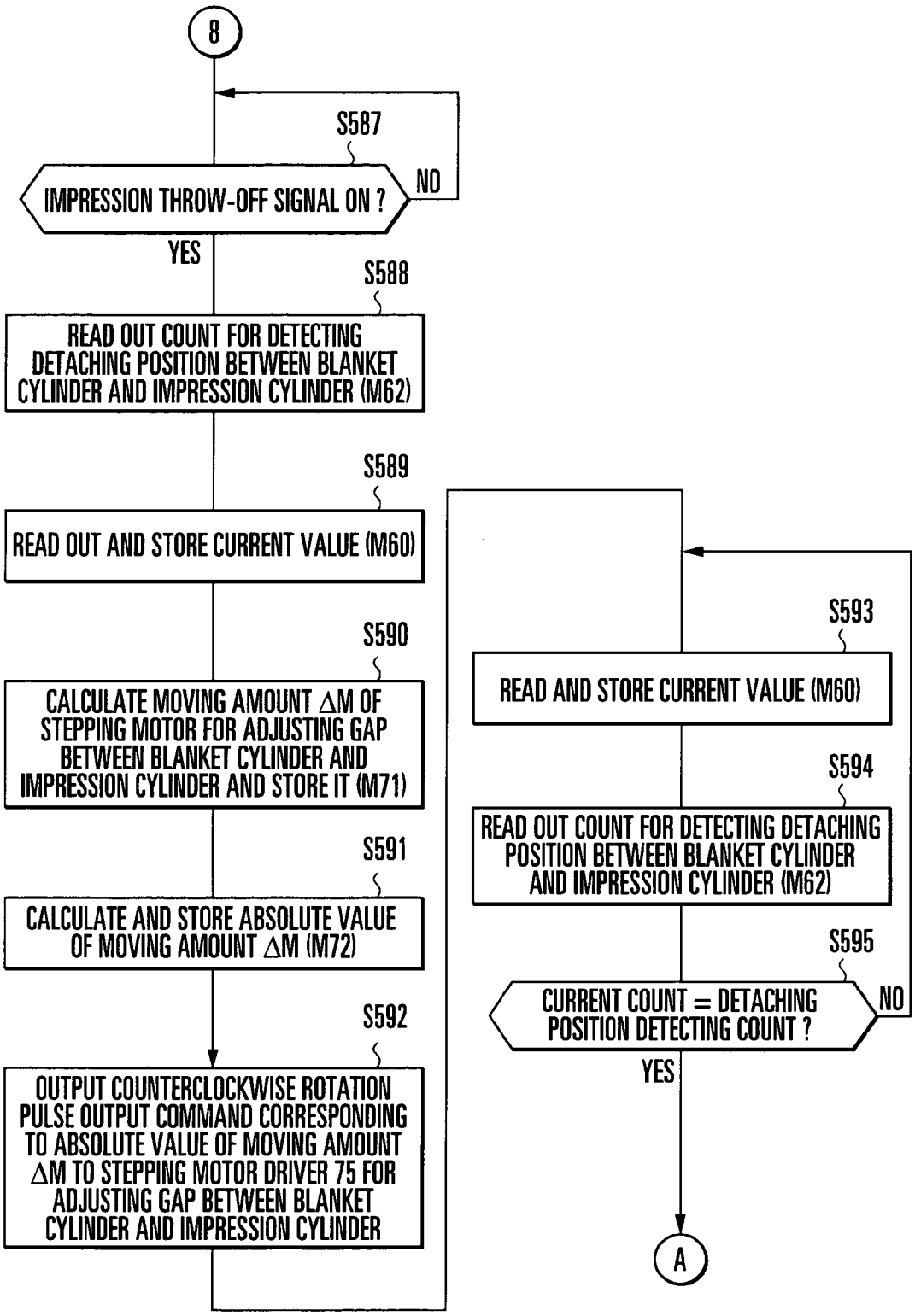

In this state, when an impression throw-on signal is input from the printing press control device 200 to the printing unit control device 500B (YES in step S515), the CPU 51 reads out operation information stored in the memory M70 (step S521, FIG. 18C). The CPU 51 checks that the printing operation is designated from the operation information (YES in step S522), and reads out from the memory M57 the table for conversion of the paper type and thickness into the printing gap between the coater cylinder and impression cylinder (step S523).

The CPU 51 reads out the paper type from the memory M51 (step S524) and the paper thickness from the memory M52 (step S525). Using the table for conversion of the paper type and thickness into the printing gap between the blanket cylinder and impression cylinder which is read out in step S523, the CPU 51 obtains a printing gap hp between the blanket cylinder and impression cylinder from the paper type and thickness read out in steps S524 and S525, and stores the obtained gap hp in the memory M58 (step S526).

The CPU 51 then outputs a ductor operation signal to the ductor stopping air cylinder valve 68 (step S527) to set an ink ductor roller 93 in a ductor operation state. Also, the CPU 51 outputs a contact signal to the ink form roller throw-on/throw-off air cylinder valve 70 (step S528) to bring ink form rollers 88 into contact with the plate cylinder 87. The CPU 51 also sends a water form roller rotation command to the printing press control device 200 (step S529) to start rotation of a water fountain roller 90. Also, the CPU 51 outputs a contact signal to the water form roller throw-on/throw-off air cylinder valve 72 (step S530) to bring water form rollers 91 into contact with the plate cylinder 87 and water fountain roller 90.

The CPU 51 reads out the printing gap hp between the blanket cylinder and impression cylinder from the memory M58 (step S531), calculates the target count for detecting the gap between the blanket cylinder and impression cylinder from the readout printing gap hp between the blanket cylinder and impression cylinder, and stores the calculated count in the memory M59 (step S532). The CPU 51 reads the current count of the counter 77 for detecting the current value of the gap between the blanket cylinder and impression cylinder (step S533), subtracts the current count from the target count for detecting the gap between the blanket cylinder and impression cylinder to obtain a moving amount ΔM of the stepping motor for adjusting the gap between the blanket cylinder and impression cylinder, and stores the moving amount ΔM in the memory M71 (step S534).

Then, in the same manner as in the second embodiment (step S235 (FIG. 8D) to step S244 (FIG. 8E)), the CPU 51 outputs a clockwise rotation pulse output command or counterclockwise rotation pulse output command corresponding to the absolute value of the moving amount ΔM to the stepping motor driver 75 for adjusting the gap between the blanket cylinder and impression cylinder, and rotates the stepping motor 76 for adjusting the gap between the blanket cylinder and impression cylinder, so the gap h between the blanket cylinder and impression cylinder is matched to the target printing gap hp (step S535 (FIG. 18D) to step S543 (FIG. 18D)).

After that, in step S544, the CPU 51 checks the presence/absence of an input of an impression throw-off signal from the printing press control device 200. During this checking, the impression cylinder 85, blanket cylinder 86, plate cylinder 87, ink form rollers 88, water form rollers 91, and water fountain roller 90 continue rotation, and the ink ductor roller 93 continues ductor operation. Hence, printing ink from the plate 94 which is supplied to the blanket 95 is transferred to the paper passing between the blanket cylinder 86 and impression cylinder 85.

[End of Printing Operation]

When printing is ended and an impression throw-off signal is supplied from the printing press control device 200 (YES in step S544), the CPU 51 outputs a detaching signal to the ink form roller throw-on/throw-off air cylinder valve 70 (step S545) to detach the ink form rollers 88 from the plate cylinder 87. The CPU 51 also outputs a ductor operation stop signal to the ductor stopping air cylinder valve 68 (step S546) to stop the ductor operation of the ink ductor roller 93. The CPU 51 also outputs a detaching signal to the water form roller throw-on/throw-off air cylinder valve 72 (step S547) to detach the water form rollers 91 from the plate cylinder 87 and water fountain roller 90. The CPU 51 also sends a water fountain roller rotation stop command to the printing press control device 200 (step S548) to stop rotation of the water fountain roller 90.

Then, in the same manner as in the second embodiment (steps S249 to S256 (FIG. 8E)), the CPU 51 reads out from the memory M62 the count for detecting the detaching position between the blanket cylinder and impression cylinder (step S549), subtracts the current count from the count for detecting the detaching position between the blanket cylinder and impression cylinder to obtain the moving amount ΔM of the stepping motor for adjusting the gap between the blanket cylinder and impression cylinder (steps S550 and S551), and rotates the stepping motor 76 for adjusting the gap between the blanket cylinder and impression cylinder counterclockwise by an amount corresponding to the absolute value of the moving amount ΔM of the stepping motor for adjusting the gap between the blanket cylinder and impression cylinder (steps S552 to S556) to detach the blanket cylinder 86 from the impression cylinder 85 and plate cylinder 87. Thus, the printing operation using the printing unit is ended.

[Embossing]

When performing embossing operation, the operator removes the plate 94 from the plate cylinder 87 and mounts an embossing plate 96 on the blanket cylinder 86 in place of the blanket 95 (see FIG. 12B). An embossing packing material 97 is interposed between the embossing plate 96 and blanket cylinder 86. In this case, the host computer 400 transmits a printing/embossing selection signal which designates embossing operation.

In this state, when an impression throw-on signal is input from the printing press control device 200 to the printing unit control device 500B (YES in step S515, FIG. 18A), the CPU 51 reads out operation information stored in the memory M70 (step S521, FIG. 18C). The CPU 51 confirms that the embossing operation is designated from the operation information (NO in step S222), and reads out from the memory M63 the table for conversion of the paper type and thickness into the embossing gap between the blanket cylinder and impression cylinder (step S557, FIG. 18F).

The CPU 51 then reads out the paper type from the memory M51 (step S558) and paper thickness from the memory M52 (step S559). Using the table (read out in step S557) for conversion of the paper type and thickness into the embossing gap between the blanket cylinder and impression cylinder, the CPU 51 obtains a reference embossing gap hr between the blanket cylinder and impression cylinder (step S560), and subtracts a first correction amount α1 (obtained in steps S561 to S564) of the embossing gap between the blanket cylinder and impression cylinder and a second correction amount α2 (obtained in steps S565 to S568) of the embossing gap between the blanket cylinder and impression cylinder from the reference gap hr to obtain the embossing gap he between the blanket cylinder and impression cylinder (step S569, FIG. 18G).

The CPU 51 then outputs a ductor operation stop signal to the ductor stopping air cylinder valve 68 (step S570) to stop the ductor operation of the ink ductor roller 93. The CPU 51 also outputs a detaching signal to the ink form roller throw-on/throw-off air cylinder valve 70 (step S571) to detach the ink form rollers 88 from the plate cylinder 87. The CPU 51 also sends a water fountain roller rotation stop command to the printing press control device 200 (step 572) to stop rotation of the water fountain roller 90. The CPU 51 also outputs a detaching signal to the water form roller throw-on/throw-off air cylinder valve 72 (step S573) to detach the water form rollers 91 from the plate cylinder 87 and water fountain roller 90.

The CPU 51 reads out an embossing gap he between the blanket cylinder and impression cylinder from the memory M69 (step S574), calculates the target count for detecting the gap between the blanket cylinder and impression cylinder from the readout embossing gap he between the blanket cylinder and impression cylinder, and stores the target count in the memory M59 (step S575). The CPU 51 reads the current count of the counter 77 for detecting the current value of the gap between the blanket cylinder and impression cylinder (step S576), subtracts the current count from the target count for detecting the gap between the blanket cylinder and impression cylinder to obtain a moving amount ΔM of the stepping motor for detecting the gap between the blanket cylinder and impression cylinder, and stores the moving amount ΔM in the memory M71 (step S577).

Then, in the same manner as in the second embodiment (step S278 (FIG. 8H) to step S287 (FIG. 8I)), the CPU 51 outputs a clockwise rotation pulse output command or counterclockwise rotation pulse output command corresponding to the absolute value of the moving amount ΔM to the stepping motor driver 75 for adjusting the gap between the blanket cylinder and impression cylinder to rotate the stepping motor 76 for adjusting the gap between the blanket cylinder and impression cylinder, so that the gap h between the blanket cylinder and impression cylinder is matched to the target embossing gap he (step S578 (FIG. 18H) to step S586 (FIG. 18H)).

After that, in step S587, the CPU 51 checks the presence/absence of an input of an impression throw-off signal from the printing press control device 200. During this checking, the impression cylinder 85, blanket cylinder 86, and plate cylinder 87 continue rotation. Thus, the embossing plate 96 as a die embosses the paper (printed paper) passing between the blanket cylinder 86 and impression cylinder 85.

[End of Embossing Operation]

When printing and embossing are ended and an impression throw-off signal is supplied from the printing press control device 200 (YES in step S587), the CPU 51 reads out the count for detecting the detaching position between the blanket cylinder and impression cylinder from the memory M62 (step S588), subtracts the current count from the count for detecting the detaching position between the blanket cylinder and impression cylinder to obtain the moving amount ΔM of the stepping motor for adjusting the gap between the blanket cylinder and impression cylinder (steps S589, S590), and rotates the stepping motor 76 for adjusting the gap between the blanket cylinder and impression cylinder counterclockwise by an amount corresponding to the absolute value of the moving amount ΔM of the stepping motor for adjusting the gap between the blanket cylinder and impression cylinder (steps S591 to S595), to detach the blanket cylinder 86 from the impression cylinder 85 and plate cylinder 87. Thus, the operation of embossing the printed paper using the printing unit is ended.

[Calibration]

When the calibration switch 74 is turned on (YES in step S516, FIG. 18B), the CPU 51 sends a counterclockwise rotation pulse output command corresponding to 1 pulse to the stepping motor driver 75 for adjusting the gap between the blanket cylinder and impression cylinder (step S517), and checks the state of the calibration position detection sensor 78 of the stepping motor 76 for adjusting the gap between the blanket cylinder and impression cylinder (step S518).

After repeating this operation, when the calibration position detection sensor 78 is turned on (YES in step S518), a reset signal is output to the counter 77 for detecting the current value of the gap between the blanket cylinder and impression cylinder (step S519) to set the count of the current value detection counter 77 to zero. Output of the reset signal to the current value detection counter 77 is stopped (step S520), and the counting operation starting from zero of the current value detection counter 77 is resumed.

[Sixth Embodiment]

Another exemplary web offset printing press which also serves as an embossing apparatus will be described as the sixth embodiment of the switch-over processing apparatus of the present invention.

Figure 19:
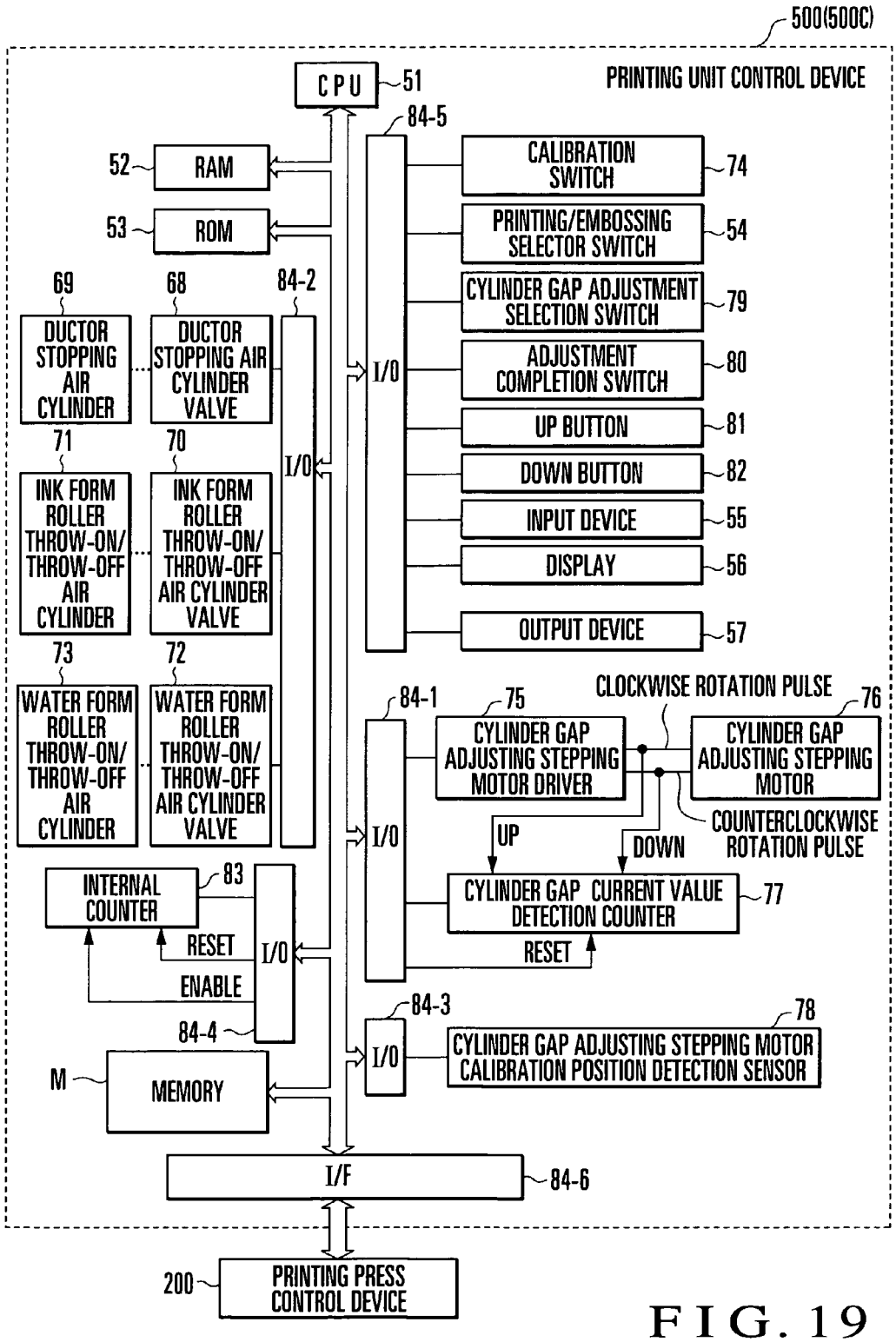
FIG. 19 is a block diagram showing a control unit in a web offset printing press as the sixth embodiment the switch-over processing apparatus of the present invention which also serves as an embossing apparatus.

As shown in FIG. 19, the web offset printing press according to this embodiment comprises a printing press control device 200 and printing unit control device 500C. According to this embodiment, in the same manner as in the third embodiment, first, a printing gap hp and embossing gap he are set as preset initial values, and thereafter changed to appropriate values in accordance of the teaching of the operator.

According to this embodiment, the printing unit control device 500C comprises a CPU 51, a RAM 52, a ROM 53, a calibration switch 74, a printing/embossing selector switch 54, a gap adjustment selection switch 79 for adjusting the gap between the blanket cylinder and impression cylinder, an adjustment completion switch 80, an UP button 81, a DOWN button 82, an input device 55, a display 56, an output device 57, a stepping motor driver 75 for adjusting the gap between the blanket cylinder and impression cylinder, a stepping motor 76 for adjusting the gap between the blanket cylinder and impression cylinder, a counter (UP/DOWN counter) 77 for detecting the current value of the gap between the blanket cylinder and impression cylinder, a calibration position detection sensor 78 for detecting the calibration position of the stepping motor for adjusting the gap between the blanket cylinder and impression cylinder, a ductor stopping air cylinder valve 68, a ductor stopping air cylinder 69, an ink form roller throw-on/throw-off air cylinder valve 70, an ink form roller throw-on/throw-off air cylinder 71, a water form roller throw-on/throw-off air cylinder valve 72, a water form roller throw-on/throw-off air cylinder 73, an internal counter 83, input/output interfaces 84-1 to 84-6, and a memory M.

Figure 20:
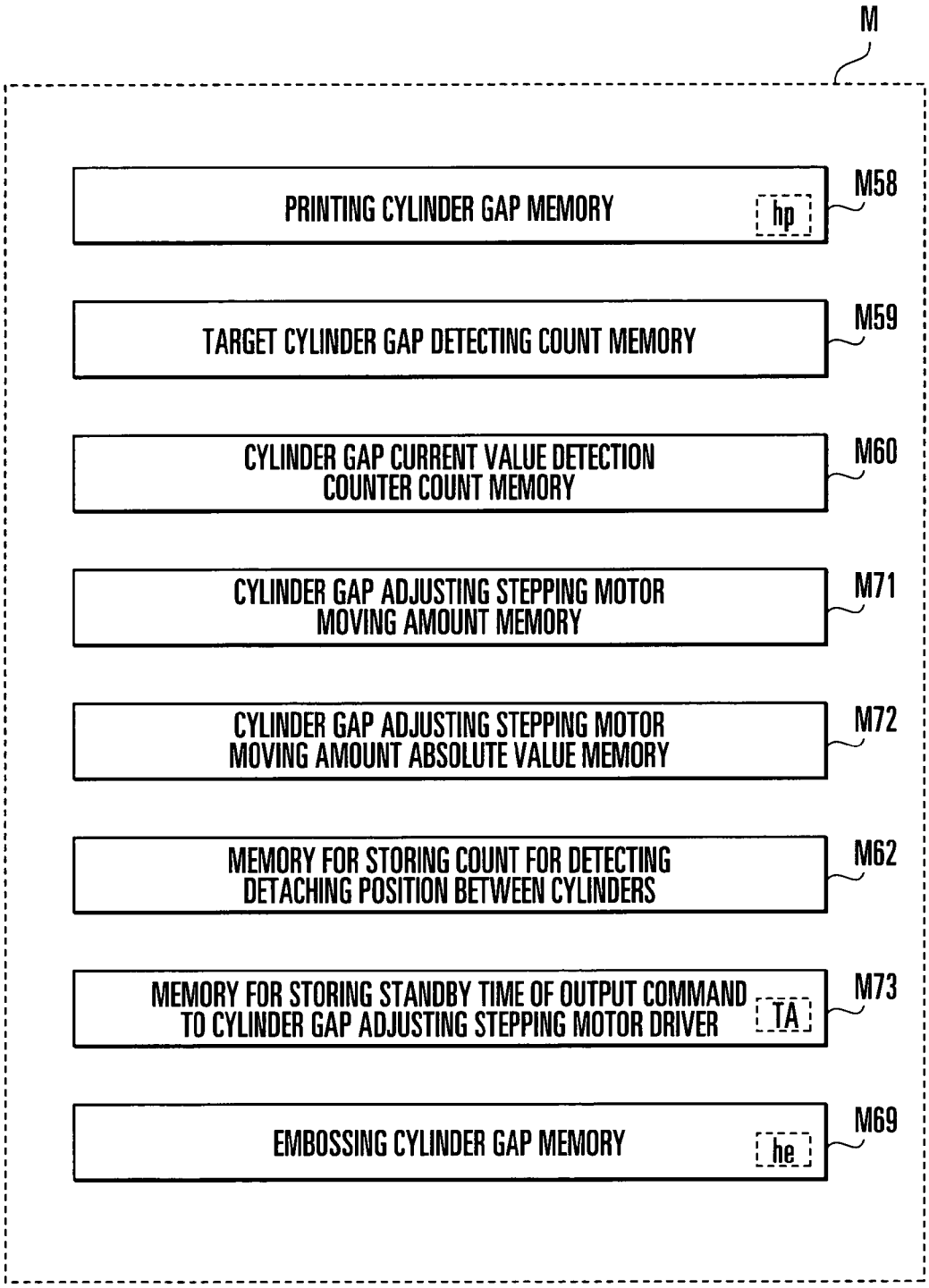
FIG. 20 is a block diagram showing the arrangement of a memory in a printing unit control device.
Figure 21A:
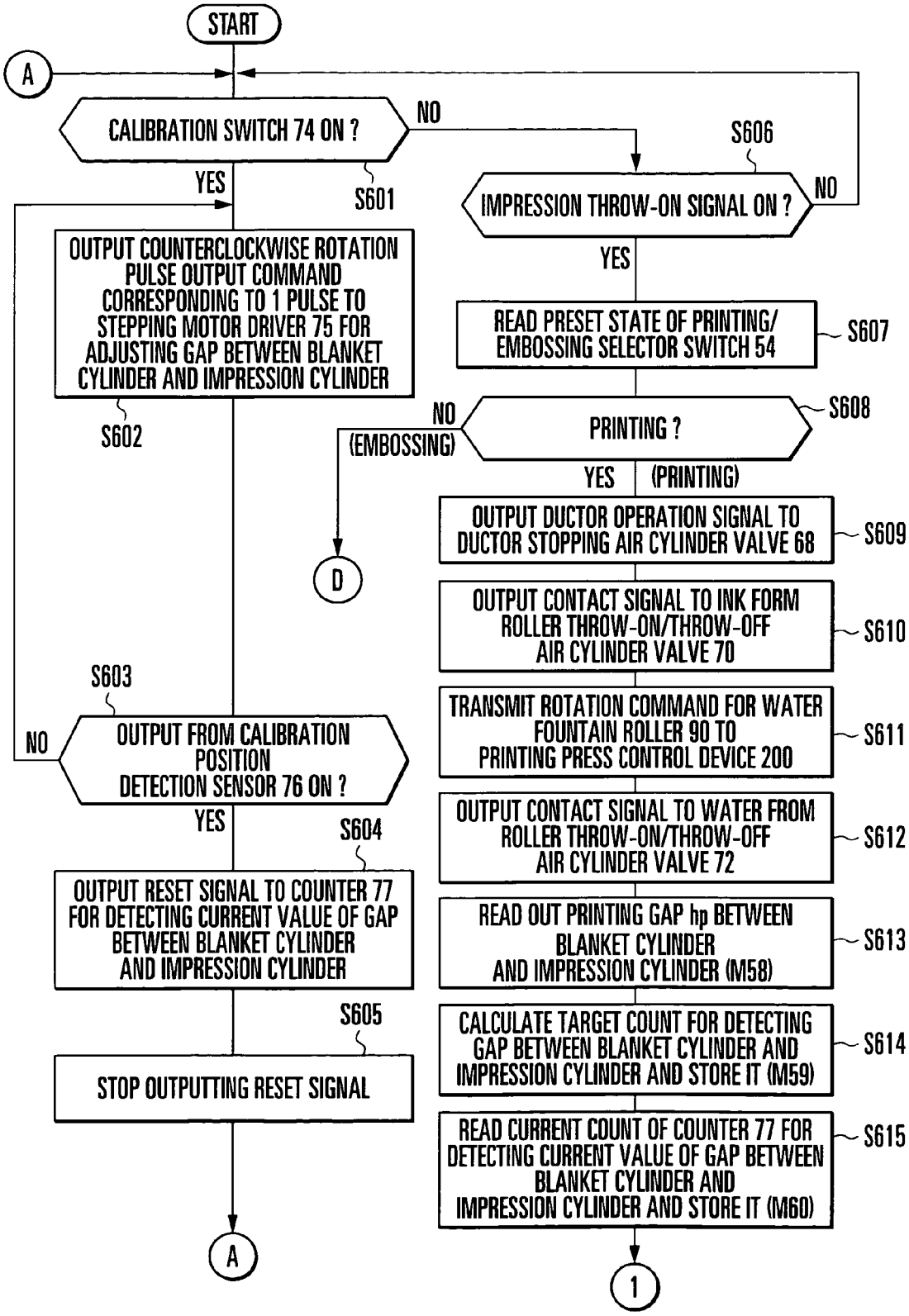
FIGS. 21A to 21H are flowcharts showing a processing operation performed by the CPU of the printing unit control device.
Figure 21B:
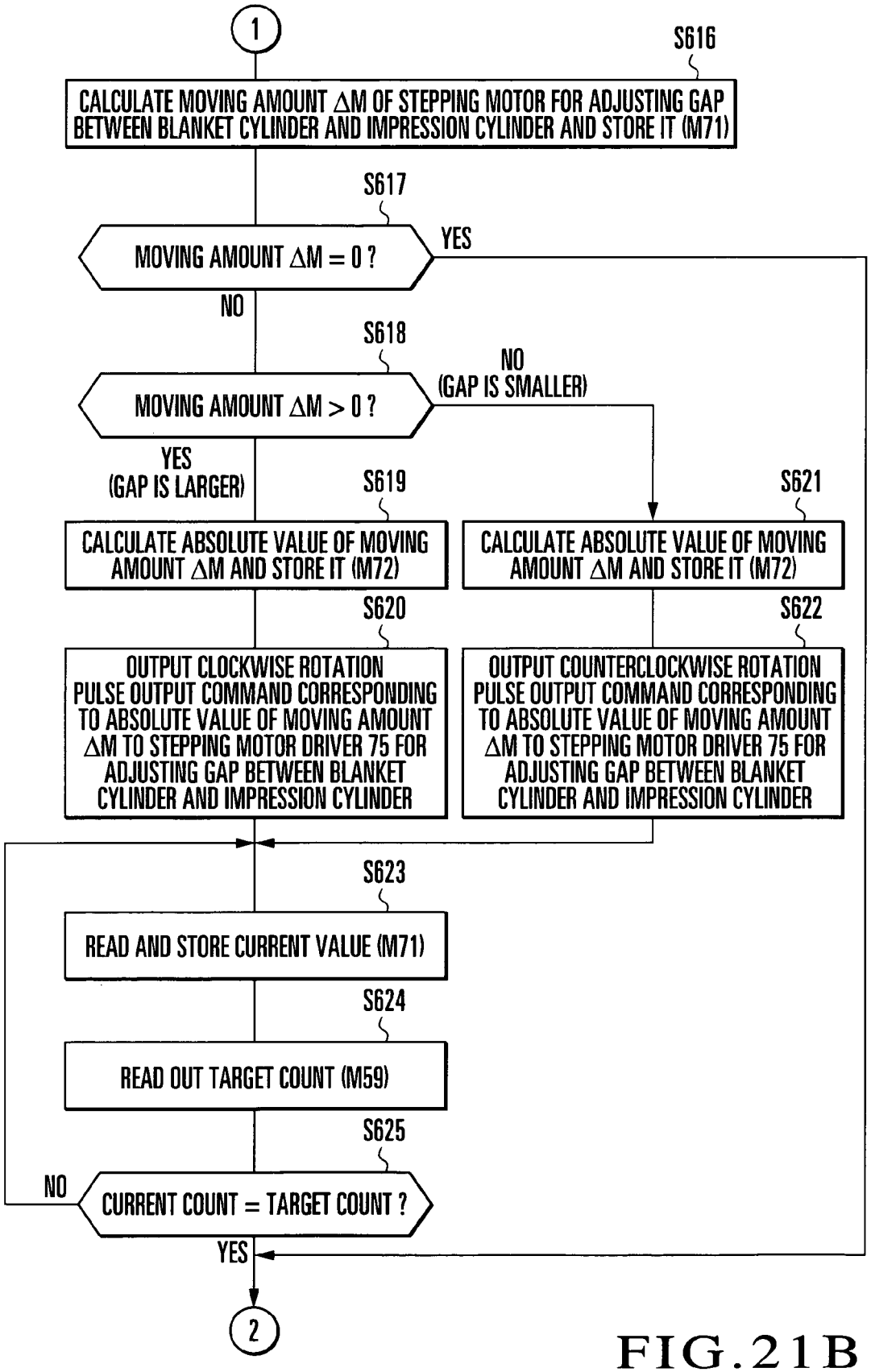
Figure 21C:
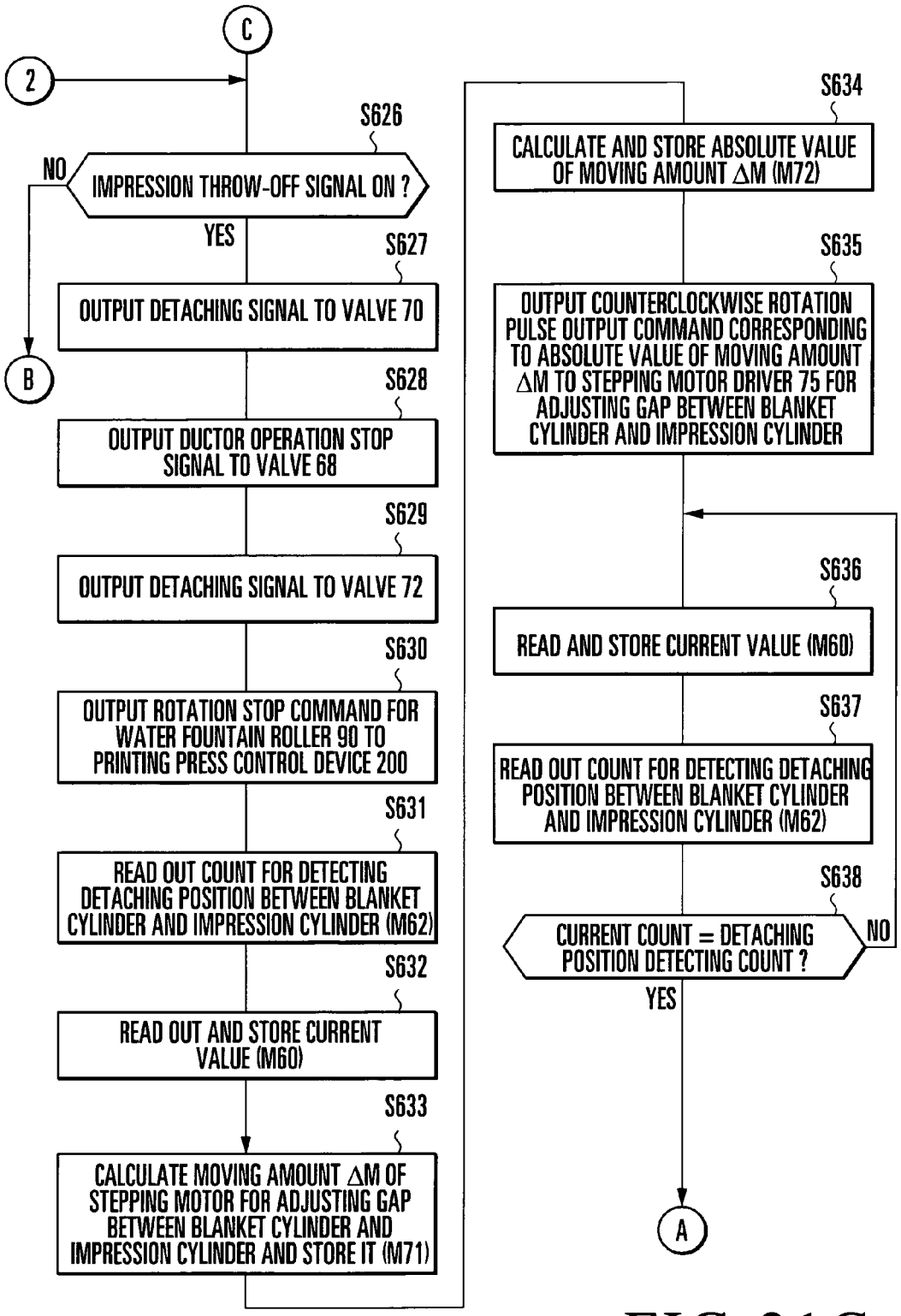
Figure 21D:
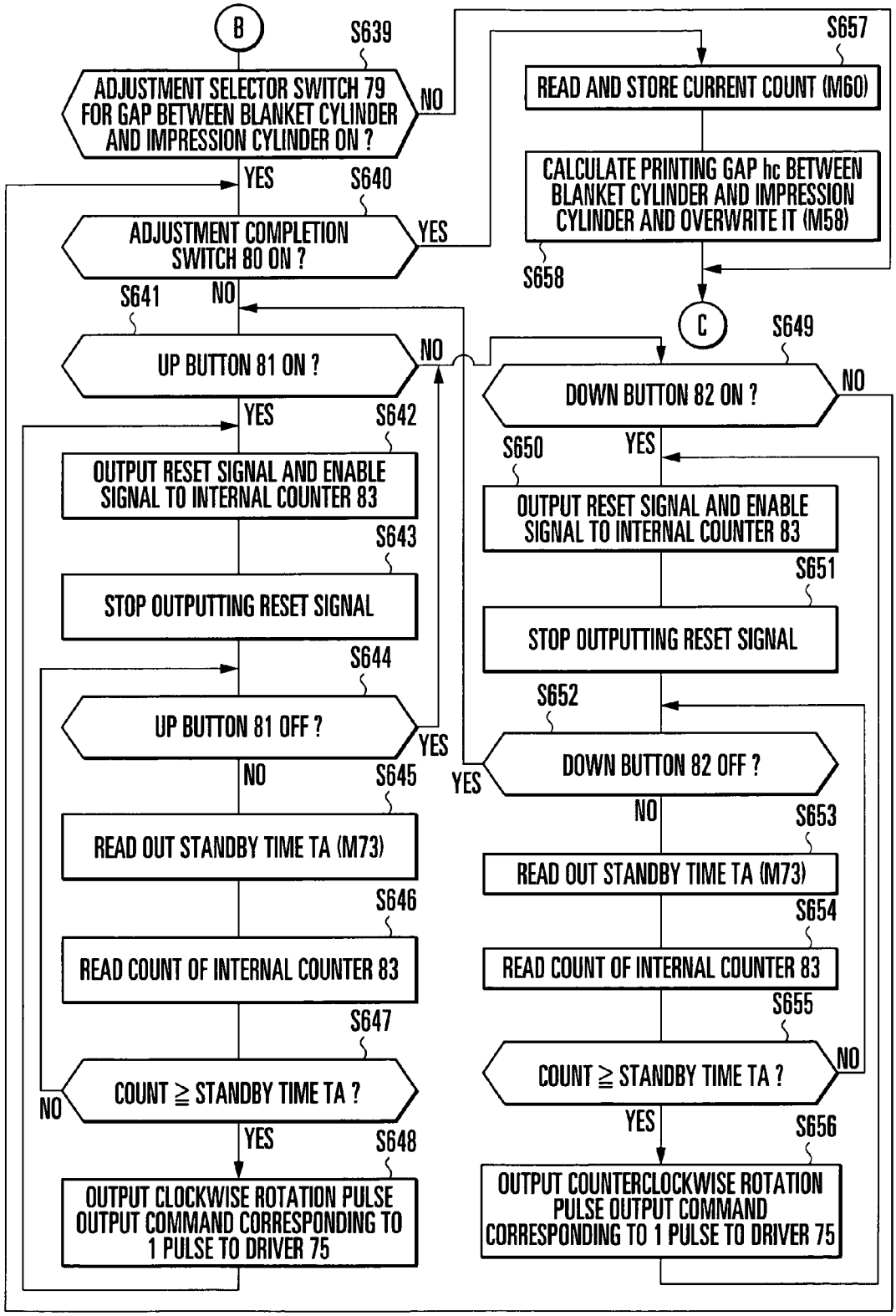
Figure 21E:
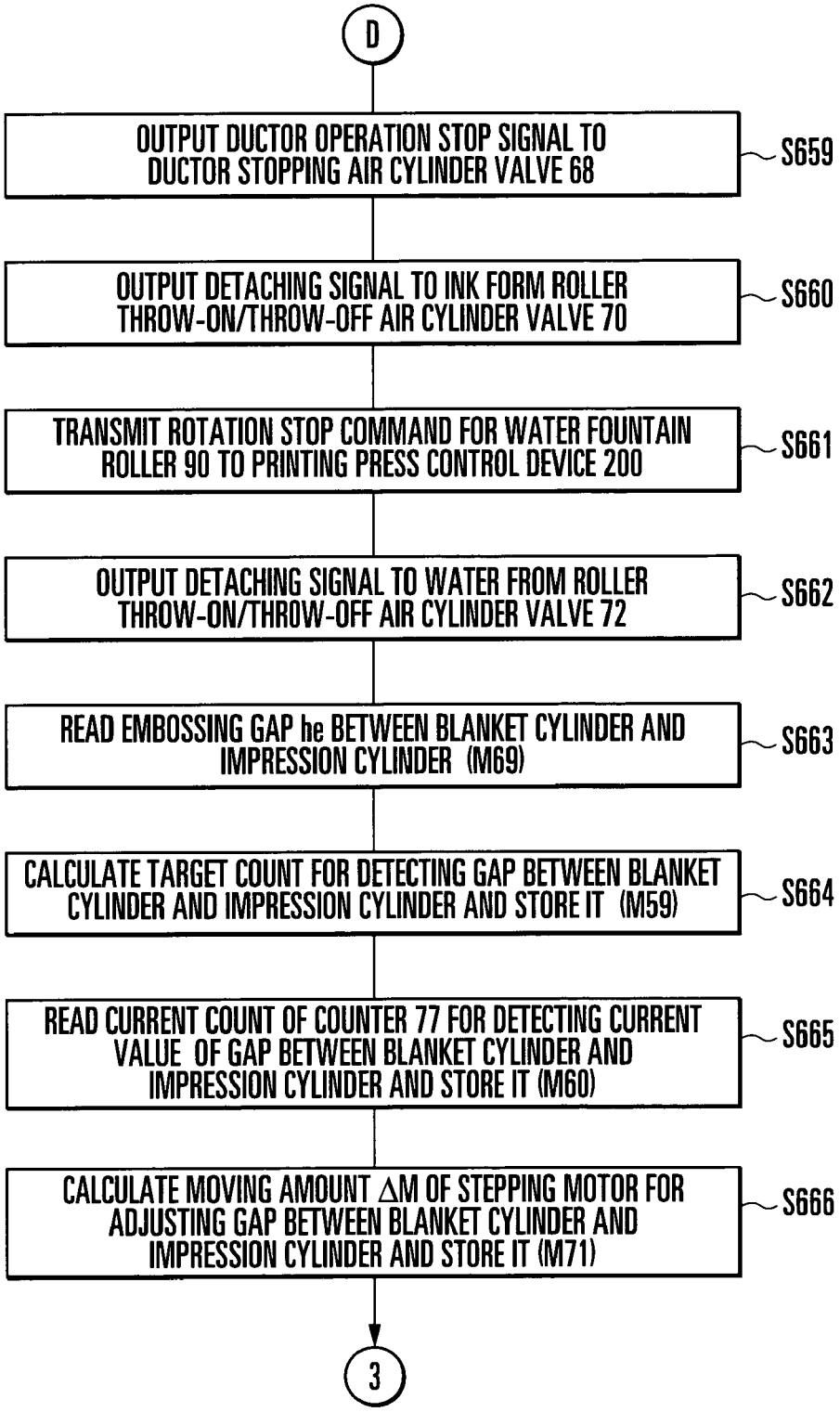
Figure 21F:
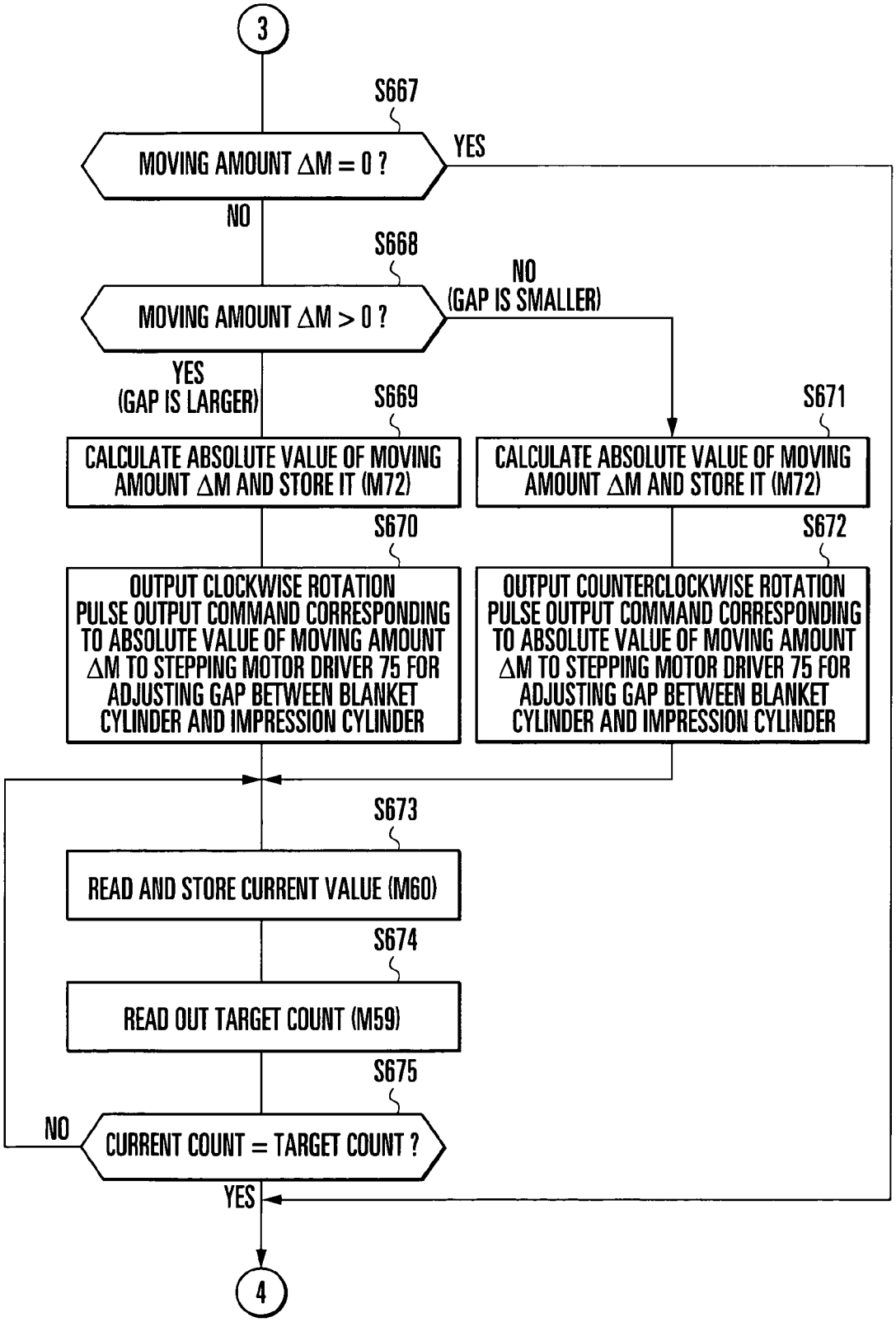
Figure 21G:
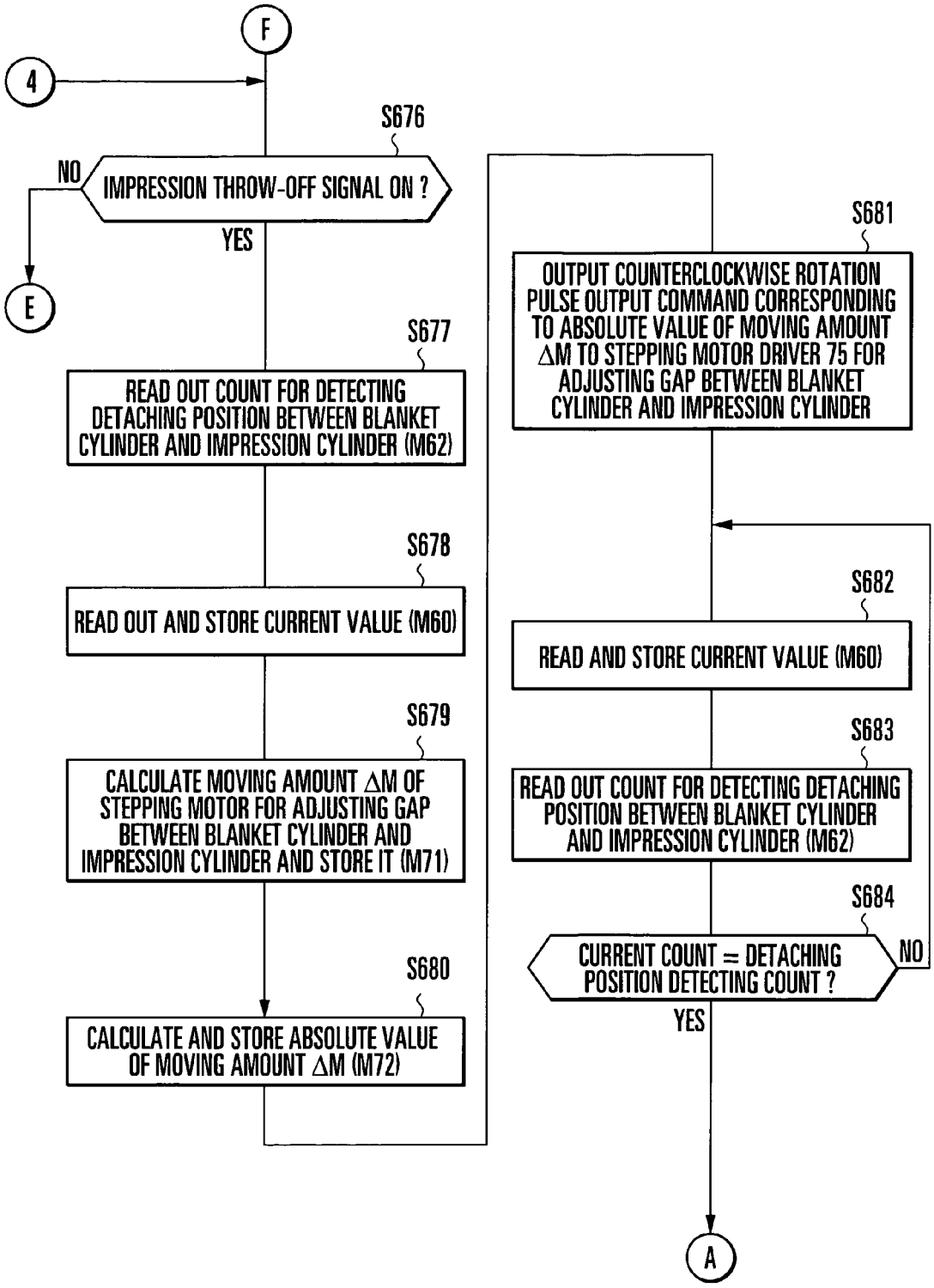
Figure 21H:
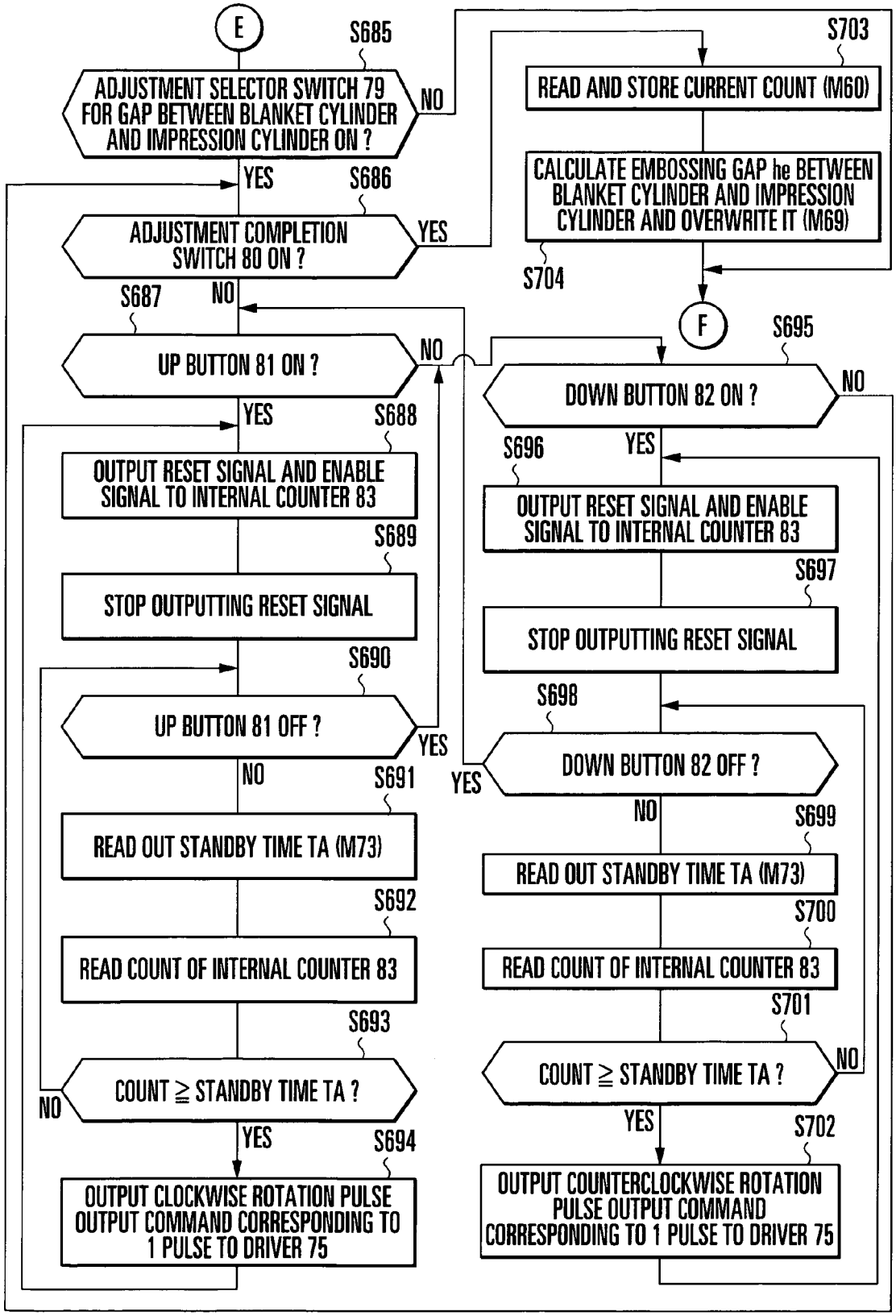

As shown in FIG. 20, the memory M comprises a memory M58 for storing a printing gap between the blanket cylinder and impression cylinder, a target count memory M59 for detecting the gap between the blanket cylinder and impression cylinder, a count memory M60 for a counter for detecting the current value of the gap between the blanket cylinder and impression cylinder, a memory M71 for storing the moving amount of the stepping motor for adjusting the gap between the blanket cylinder and impression cylinder, a memory M72 for storing the absolute value of the moving amount of the stepping motor for adjusting the gap between the blanket cylinder and impression cylinder, a count memory M62 for detecting the detaching position between the blanket cylinder and impression cylinder, a memory M73 for storing the standby time of an output command to the stepping motor driver for adjusting the gap between the blanket cylinder and impression cylinder, and a memory M69 for storing the embossing gap between the blanket cylinder and impression cylinder. The functions of the respective memories in the memory M will be described later.

Upon obtaining various types of input information through the input/output interfaces 84-1 to 84-6, the CPU 51 operates in accordance with a program stored in the ROM 53 while accessing the RAM 52 and memory M. The ROM 53 stores, as the program specific to this embodiment, a printing/embossing selector program which controls switching between printing and embossing. This program can be provided in the form of a computer-readable storage medium such as an optical disk or magnetic disk.

Processing operation performed by the CPU 51 of the printing unit control device 500C using the printing/embossing selector program will be described in accordance with the flowcharts divided into FIGS. 21A to 21H.

[Printing]

When performing printing, the operator mounts a blanket 95 on a blanket cylinder 86 and a plate 94 on a plate cylinder 87 (see FIG. 12A). The operator also switches the printing/embossing selector switch 54 to the printing side.

In this state, when an impression throw-on signal is input from the printing press control device 200 to the printing unit control device 500C (YES in step S606, FIG. 21A), the CPU 51 reads the preset state of the printing/embossing selector switch 54 (step S607). The CPU 51 confirms that the printing/embossing selector switch 54 is switched to the printing side (YES in step S608), and outputs a ductor operation signal to the ductor stopping air cylinder valve 68 (step S609) to set an ink ductor roller 93 to the ductor operation state. The CPU 51 also outputs a contact signal to the ink form roller throw-on/throw-off air cylinder valve 70 (step S610) to bring ink form rollers 88 into contact with the plate cylinder 87. The CPU 51 also sends a water fountain roller rotation command to the printing press control device 200 (step S611) to start rotation of a water fountain roller 90. The CPU 51 also outputs a contact signal to the water form roller throw-on/throw-off air cylinder valve 72 (step S612) to bring water form rollers 91 into contact with the plate cylinder 87 and water fountain roller 90.

The CPU 51 reads out the printing gap hp between the blanket cylinder and impression cylinder from the memory M58 (step S613), calculates the target count for detecting the gap between the blanket cylinder and impression cylinder from the readout printing gap hp between the blanket cylinder and impression cylinder, and stores the calculated count in the memory M59 (step S614). The CPU 51 reads the current count of the counter 77 for detecting the current value of the gap between the blanket cylinder and impression cylinder (step S615), subtracts the current count from the target count for detecting the gap between the blanket cylinder and impression cylinder to obtain a moving amount ΔM of the stepping motor for detecting the gap between the blanket cylinder and impression cylinder, and stores the moving amount ΔM in the memory M71 (step S616, FIG. 21B).

Then, in the same manner as in the third embodiment of the first invention (step S315 (FIG. 11B) to step S324 (FIG. 11C)), a clockwise rotation pulse output command or counterclockwise rotation pulse output command corresponding to the absolute value of the moving amount ΔM is output to the stepping motor driver 75 for adjusting the gap between the blanket cylinder and impression cylinder to rotate the stepping motor 76 for adjusting the gap between the blanket cylinder and impression cylinder, so the gap h between the blanket cylinder and impression cylinder is matched to the target printing gap hp (step S617 (FIG. 21B) to step S625 (FIG. 21B)).

After that, in step S626, the CPU 51 checks the presence/absence of an input of an impression throw-off signal from the printing press control device 200. During this checking, an impression cylinder 85, the blanket cylinder 86, the plate cylinder 87, the ink form rollers 88, the water form rollers 91, and the water fountain roller 90 continue rotation, and the ink ductor roller 93 continues ductor operation. Hence, printing ink from the plate 94 which is supplied to the blanket 95 is transferred to the paper passing between the blanket cylinder 86 and impression cylinder 85.

[Teaching of Printing Gap hp between Blanket Cylinder and Impression Cylinder]

The operator extracts the printed paper and checks the printing state. From this checking, if the operator determines that the current gap he between the blanket cylinder and impression cylinder should be adjusted, he turns on the gap adjustment selection switch 79 for adjusting the gap between the blanket cylinder and impression cylinder, and operates the UP button 81 or DOWN button 82. Thus, the operator teaches the printing gap hp between the blanket cylinder and impression cylinder (steps S639 to S658, FIG. 21D) in the same manner as in steps S335 to S354 (FIG. 11D) of the third embodiment.

[End of Printing Operation]

When printing is ended and an impression throw-off signal is supplied from the printing press control device 200 (YES in step S626, FIG. 21C), the CPU 51 outputs a detaching signal to the ink form roller throw-on/throw-off air cylinder valve 70 (step S627) to detach the ink form rollers 88 from the plate cylinder 87. The CPU 51 also outputs a ductor operation stop signal to the ductor stopping air cylinder valve 68 (step S628) to stop the ductor operation of the ink ductor roller 93. The CPU 51 also outputs a detaching signal to the water form roller throw-on/throw-off air cylinder valve 72 (step S629) to detach the water form rollers 91 from the plate cylinder 87 and water fountain roller 90. The CPU 51 also sends a water fountain roller rotation stop command to the printing press control device 200 (step S630) to stop rotation of the water fountain roller 90.

Then, in the same manner as in the third embodiment (steps S327 to S334 (FIG. 11C)), the CPU 51 reads out the count for detecting the detaching position between the blanket cylinder and impression cylinder from the memory M62 (step S631), subtracts the current count from the count for detecting the detaching position between the blanket cylinder and impression cylinder to obtain the moving amount ΔM of the stepping motor for adjusting the gap between the blanket cylinder and impression cylinder (steps S632 and S633), and rotates the stepping motor 76 for adjusting the gap between the blanket cylinder and impression cylinder counterclockwise by an amount corresponding to the absolute value of the moving amount ΔM of the stepping motor for adjusting the gap between the blanket cylinder and impression cylinder(steps S634 to S638), to detach the blanket cylinder 86 from the impression cylinder 85 and plate cylinder 87. Thus, the printing operation using the printing unit is ended.

[Embossing]

When performing embossing operation, the operator removes the plate 94 from the plate cylinder 87 and mounts an embossing plate 96 on the blanket cylinder 86 in place of the blanket 95 (see FIG. 12B). An embossing packing material 97 is interposed between the embossing plate 96 and blanket cylinder 86. Also, the printing/embossing selector switch 54 is switched to the embossing side.

In this state, when an impression throw-on signal is input from the printing press control device 200 to the printing unit control device 500C (YES in step S606, FIG. 21A), the CPU 51 reads the preset state of the printing/embossing selector switch 54 (step S607). The CPU 51 confirms that the printing/embossing selector switch 54 is switched to the embossing side (NO in step S608), and outputs a ductor operation stop signal to the ductor stopping air cylinder valve 68 (step S659, FIG. 21E) to stop the ductor operation of the ink ductor roller 93. The CPU 51 also outputs a detaching signal to the ink form roller throw-on/throw-off air cylinder valve 70 (step S660) to detach the ink form rollers 88 from the plate cylinder 87. The CPU 51 also sends a water fountain roller rotation stop command to the printing press control device 200 (step 661) to stop rotation of the water fountain roller 90. The CPU 51 also outputs a detaching signal to the water form roller throw-on/throw-off air cylinder valve 72 (step S662) to detach the water form rollers 91 from the plate cylinder 87 and water fountain roller 90.

The CPU 51 reads out the embossing gap he between the blanket cylinder and impression cylinder from the memory M69 (step S663), calculates the target count for detecting the gap between the blanket cylinder and impression cylinder from the readout embossing gap he between the blanket cylinder and impression cylinder, and stores the target count in the memory M59 (step S664). The CPU 51 reads the current count of the counter 77 for detecting the current value of the gap between the blanket cylinder and impression cylinder (step S665), subtracts the current count from the target count for detecting the gap between the blanket cylinder and impression cylinder to obtain the moving amount ΔM of the stepping motor for detecting the gap between the blanket cylinder and impression cylinder, and stores the moving amount ΔM in-the memory M71 (step S666).

Then, in the same manner as in the third embodiment (step S361 (FIG. 11F) to step S370 (FIG. 11G)), the CPU 51 outputs a clockwise rotation pulse output command or counterclockwise rotation pulse output command corresponding to the absolute value of the moving amount ΔM to the stepping motor driver 75 for adjusting the gap between the blanket cylinder and impression cylinder to rotate the stepping motor 76 for adjusting the gap between the blanket cylinder and impression cylinder, so that a gap h between the blanket cylinder and impression cylinder is matched to the target embossing gap he (step S667 (FIG. 21F) to step S675 (FIG. 21F)).

After that, in step S676, the CPU 51 checks the presence/absence of an input of an impression throw-off signal from the printing press control device 200. During this checking, the impression cylinder 85, blanket cylinder 86, and plate cylinder 87 continue rotation. Thus, the embossing plate 96 as a die embosses the paper (printed paper) passing between the blanket cylinder 86 and impression cylinder 85.

[Teaching of Embossing Gap hp between Blanket Cylinder and Impression Cylinder]

The operator extracts the embossed paper and checks the embossing state. From this checking, if the operator determines that the current gap he between the blanket cylinder and impression cylinder should be adjusted, he turns on the gap adjustment selection switch 79 for adjusting the gap between the blanket cylinder and impression cylinder, and operates the UP button 81 or DOWN button 82. Thus, the operator teaches the embossing gap he between the blanket cylinder and impression cylinder (steps S685 to S704, FIG. 21H) in the same manner as in steps S379 to S398 (FIG. 11H) of the third embodiment.

[End of Embossing Operation]

When printing and embossing are ended and an impression throw-off signal is supplied from the printing press control device 200 (YES in step S676, FIG. 21G), the CPU 51 reads out the count for detecting the detaching position between the blanket cylinder and impression cylinder from the memory M62 (step S677), subtracts the current count from the count for detecting the detaching position between the blanket cylinder and impression cylinder to obtain the moving amount ΔM of the stepping motor for adjusting the gap between the blanket cylinder and impression cylinder (steps S678, S679), and rotates the stepping motor 76 for adjusting the gap between the blanket cylinder and impression cylinder counterclockwise by an amount corresponding to the absolute value of the moving amount ΔM of the stepping motor for adjusting the gap between the blanket cylinder and impression cylinder (steps S680 to S684), to detach the blanket cylinder 86 from the impression cylinder 85 and plate cylinder 87. Thus, the operation of embossing the printed paper using the printing unit is ended.

[Calibration]

When the calibration switch 74 is turned on (YES in step S601, FIG. 21A), the CPU 51 sends a counterclockwise rotation pulse output command corresponding to 1 pulse to the stepping motor driver 75 for adjusting the gap between the blanket cylinder and impression cylinder (step S602) and checks the state of the calibration position detection sensor 78 of the stepping motor 76 for adjusting the gap between the blanket cylinder and impression cylinder (step S603).

After repeating this operation, when the calibration position detection sensor 78 is turned on (YES in step S603), a reset signal is output to the counter 77 for detecting the current value of the gap between the blanket cylinder and impression cylinder (step S604) to set the count of the current value detection counter 77 to zero. Output of the reset signal to the current value detection counter 77 is stopped (step S605), and the counting operation starting from zero of the current value detection counter 77 is resumed.

In the first to third embodiments described above, the embossing plate 45 is mounted on the coater cylinder 41 in place of the coating transfer body (the coating plate 44, blanket, or the like), and the embossing plate 45 as the die embosses the paper passing between the coater cylinder 41 and embossing plate 45. In this manner, in the above embodiments, as the coater also serves as the embossing apparatus, a dedicated embossing machine or dedicated embossing unit is unnecessary. As a result, printed paper can be embossed requiring only a smaller space and a low cost.

In the fourth to sixth embodiments described above, the embossing plate 96 is mounted on the blanket cylinder 86 in place of the blanket 95, and the embossing plate 96 as the die embosses the paper passing between the blanket cylinder 86 and impression cylinder 85. In this manner, in the above embodiments, as the web offset printing press also serves as the embossing apparatus, a dedicated embossing machine or dedicated embossing unit is unnecessary. As a result, printed paper can be embossed requiring only a smaller space and a low cost.

The above first to sixth embodiments will be summarized. The switch-over processing apparatus as the embodiment of the present invention comprises first and second cylinders arranged to oppose each other, a plurality of mounted bodies to be separately mounted on either one of the first and second cylinders (second cylinder in this case), and a control device which switches control for at least the first and second cylinders in accordance with the mounted body mounted on the second cylinder.

Concerning the relation with the first to third embodiments, the first and second cylinders respectively correspond to the impression cylinder 40 and coater cylinder 41. The plurality of mounted bodies differently process a sheet passing between the first and second cylinders. Of the mounted bodies, one corresponds to the embossing plate 45, and another one corresponds to a coating transfer body such as the coating plate 44. The control device corresponds to any one of the coater control devices 100A to 100C. The control device will be further described with reference to FIG. 22.

Figure 22:
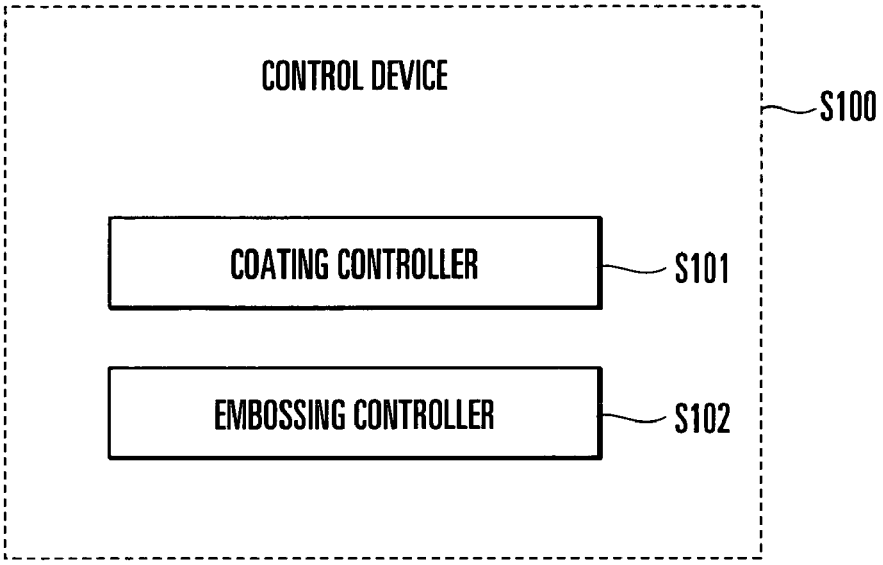
FIG. 22 is a block diagram showing an arrangement of the control device.

A control device 100 shown in FIG. 22 comprises a coating controller 101 and embossing controller 102. The coating controller 101 controls coating of applying the varnish supplied from the varnish supply device 43 or 50 to the sheet through the coating plate 44. Concerning the first embodiment, the coating controller 101 performs the process of step S116 in FIG. 4B to step S146 in FIG. 4D. Concerning the second embodiment, the coating controller 101 performs the process of step S223 in FIG. 8C to step S256 in FIG. 8E. Concerning the third embodiment, the coating controller 101 performs the process of step S309 in FIG. 11A to step S334 in FIG. 11C. The coating controller 101 particularly sets the varnish supply device 43 or 50 in a varnish supply state (e.g., steps S120 and S121 in FIG. 4B) and controls the gap between the coater cylinder 41 and impression cylinder 40 to the coating gap (e.g., steps S116 to S119 in FIG. 4B, step S122 in FIG. 4B to step S138 in FIG. 4D) in response to a coating command.

The embossing controller 102 controls embossing using the embossing plate 45 as the die. Concerning the first embodiment, the embossing controller 102 performs the process of step S147 in FIG. 4E to step S184 in FIG. 4H. Concerning the second embodiment, the embossing controller 102 performs the process of step S257 in FIG. 8F to step S295 in FIG. 8I. Concerning the third embodiment, the embossing controller 102 performs the process of step S335 in FIG. 11D to step S378 in FIG. 11G. The embossing controller 102 particularly sets the varnish supply device 43 or 50 in a varnish supply stop state (e.g., steps S160 and S161 in FIG. 4F) and controls the gap between the coater cylinder 41 and impression cylinder 40 to the embossing gap (e.g., step S147 in FIG. 4E to step S159 in FIG. 4F, step S162 in FIG. 4F to step S178 in FIG. 4H) in response to an embossing command.

The relation with the fourth to sixth embodiments will be described. The first and second cylinders respectively correspond to the impression cylinder 85 and blanket cylinder 86. The plurality of mounted bodies differently process a sheet passing between the first and second cylinders. Of the mounted bodies, one corresponds to the embossing plate 96, and another one corresponds to the blanket 95. The control device corresponds to any one of the printing unit control devices 500A to 500C. The control device will be further described with reference to FIG. 23.

Figure 23:
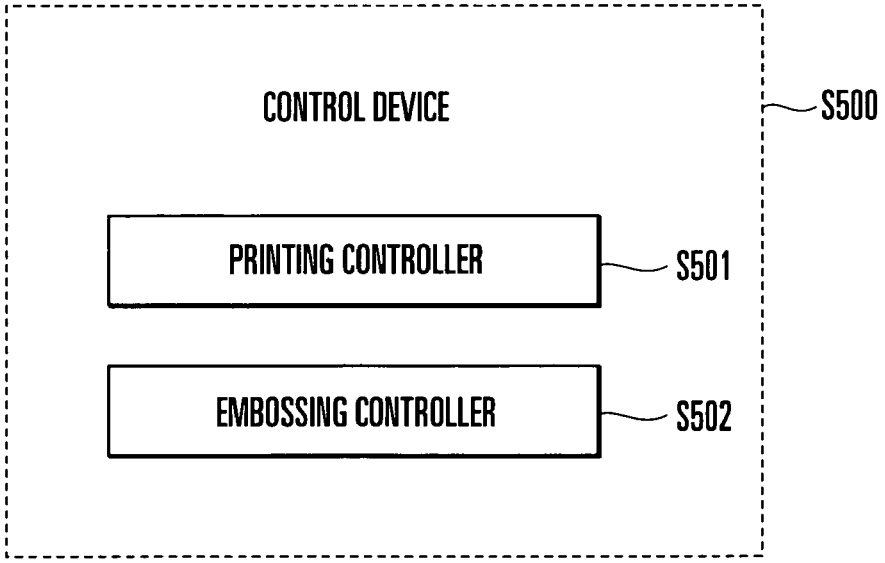
FIG. 23 is a block diagram showing another arrangement of the control apparatus.

A control device 500 shown in FIG. 23 comprises a printing controller 501 and embossing controller 502. The printing controller 501 controls printing of transferring the ink supplied from the ink supply device 92 onto a sheet through the blanket 95. Concerning the fourth embodiment, the driving controller 501 performs the process of step S416 in FIG. 15B to step S450 in FIG. 15D. Concerning the fifth embodiment, the printing controller 501 performs the process of step S523 in FIG. 18C to step S556 in FIG. 18E. Concerning the sixth embodiment, the printing controller 501 performs the process of step S609 in FIG. 21A to step S638 in FIG. 21C. The printing controller 501 particularly sets the ink supply device 92 in the ink supply state (e.g., steps S420 to S423 in FIG. 15B) and controls the gap between the blanket cylinder 86 and impression cylinder 85 to the printing gap (e.g., steps S416 to S419 in FIG. 15B, step S428 in FIG. 15B to step S440 in FIG. 15D) in response to a printing command.

The embossing controller 102 controls embossing employing the embossing plate 96 as the die. Concerning the fourth embodiment, the embossing controller 502 performs the process of step S451 in FIG. 15E to step S490 in FIG. 15H. Concerning the fifth embodiment, the embossing controller 502 performs the process of step S557 in FIG. 18F to step S595 in FIG. 18I. Concerning the sixth embodiment, the embossing controller 502 performs the process of step S639 in FIG. 21D to step S684 in FIG. 21G. The embossing controller 502 particularly sets the ink supply device 92 in the ink supply stop state (e.g., steps S464 to S467 in FIG. 15F) and controls the gap between the blanket cylinder 86 and impression cylinder 85 to the embossing gap (e.g., step S451 in FIG. 15E to step S463 in FIG. 15F, step S468 in FIG. 15F to step S484 in FIG. 15H) in response to an embossing command.

Although a processing target sheet is exemplified by paper, the processing target sheet can be of any type other than paper. For example, a film made of a synthetic resin, vinyl, or the like, a plastic sheet, a decorative laminated sheet, or a wrapping paper board such as a corrugated board can be a processing target sheet. The sheet to be embossed can be a sheet which is coated with varnish, a printed sheet, or a sheet which is not coated with varnish or not printed.

What is claimed is:

1. A switch-over processing method comprising the steps of:

performing a first process on a sheet passing between a first cylinder and a second cylinder with a first mounted body being mounted on a circumferential surface of the second cylinder arranged to oppose the first cylinder; and performing a second process different from the first process on the sheet passing between the first cylinder and the second cylinder with a second mounted body being mounted on a circumferential surface of the second cylinder in place of the first mounted body, wherein the step of performing the second process employs an embossing plate as the second mounted body, and the second process comprises an embossing step which employs the embossing plate as a die, wherein the step of performing the first process employs an impression cylinder as the first cylinder, a coater cylinder as the second cylinder, and a coating transfer body as the first mounted body, and the first process comprises a coating step of applying varnish supplied from a varnish supply device to the sheet through the transfer body, wherein the coating step comprises the steps of setting the varnish supply device in a varnish supply state, and controlling a gap between the coater cylinder and the impression cylinder to a coating gap, and the embossing step comprises the steps of setting the varnish supply device in a varnish supply stop state, and controlling the gap between the coater cylinder and the impression cylinder to an embossing gap, wherein the controlling the gap between the coater cylinder and the impression cylinder to an embossing gap comprises the steps of obtaining the embossing gap between the coater cylinder and the impression cylinder in accordance with a type and thickness of i) the sheet, ii) an embossing packing material interposed between the embossing plate and the coater cylinder, and iii) the embossing plate.

* * * * *